US011744277B2

(12) United States Patent
Bowen et al.

(10) Patent No.: US 11,744,277 B2
(45) Date of Patent: Sep. 5, 2023

(54) NICOTINE LIQUID FORMULATIONS FOR AEROSOL DEVICES AND METHODS THEREOF

(71) Applicant: JUUL Labs, Inc., San Francisco, CA (US)

(72) Inventors: Adam Bowen, San Francisco, CA (US); Chenyue Xing, San Francisco, CA (US)

(73) Assignee: JUUL Labs, Inc., San Francisco, CA (US)

( * ) Notice: Subject to any disclaimer, the term of this patent is extended or adjusted under 35 U.S.C. 154(b) by 0 days.

(21) Appl. No.: 17/993,459

(22) Filed: Nov. 23, 2022

(65) Prior Publication Data

US 2023/0157347 A1 May 25, 2023

Related U.S. Application Data

(63) Continuation of application No. 16/585,382, filed on Sep. 27, 2019, now Pat. No. 11,510,433, which is a (Continued)

(51) Int. Cl.
*A24B 15/16* (2020.01)
*A24B 15/167* (2020.01)
(Continued)

(52) U.S. Cl.
CPC ..... *A24B 15/16* (2013.01); *A24B 15/167* (2016.11); *A24B 15/301* (2013.01); *A24B 15/32* (2013.01); *A24F 40/10* (2020.01)

(58) Field of Classification Search
CPC ..... A24B 15/16; A24B 15/167; A24B 15/301; A24B 15/32; A24F 40/10
See application file for complete search history.

(56) References Cited

U.S. PATENT DOCUMENTS 374,584 A 12/1887 Joseph et al.
576,653 A 2/1897 Frank et al.
(Continued)

FOREIGN PATENT DOCUMENTS

CA 2641869 A1 5/2010
CN 85106876 A 9/1986
(Continued)

OTHER PUBLICATIONS

Adam, et al. Investigation of tobacco pyrolysis gases and puff-by-puff resolved cigarette smoke by single photon ionisation (SPI)-time-of-flight mass spectrometry (TOFMS), Beitrage zur Tabakforschung International/Contributions to Tobacco Research, 2009, pp. 203-226.
(Continued)

*Primary Examiner* — Dana Ross
*Assistant Examiner* — Joe E Mills, Jr.
(74) *Attorney, Agent, or Firm* — Mintz, Levin, Cohn, Ferris, Glovsky and Popeo, P.C.

(57) ABSTRACT

A nicotine liquid formulation comprising nicotine, an acid, and a biologically acceptable liquid carrier, wherein heating an amount of said nicotine liquid formulation using low temperature electronic vaporization device, i.e., an electronic cigarette, generates an inhalable aerosol, and wherein at least about 50% of said acid in said amount is in said aerosol, and wherein at least about 90% of said nicotine in said amount is in said aerosol.

25 Claims, 7 Drawing Sheets

Related U.S. Application Data continuation of application No. 15/101,303, filed as application No. PCT/US2014/064690 on Nov. 7, 2014, now Pat. No. 10,463,069.

(60) Provisional application No. 61/912,507, filed on Dec. 5, 2013.

(51) Int. Cl.

| | |
|---|---|
| ***A24B 15/30*** | (2006.01) |
| ***A24B 15/32*** | (2006.01) |
| ***A24F 40/10*** | (2020.01) |

(56) References Cited

U.S. PATENT DOCUMENTS 595,070 A 12/1897 Ernest
720,007 A 2/1903 Dexter
799,844 A 9/1905 Albert et al.
968,160 A 8/1910 Edward
969,076 A 8/1910 Pender
1,163,183 A 12/1915 Stoll
1,299,162 A 4/1919 Fisher
1,505,748 A 8/1924 Louis
1,552,877 A 9/1925 Phillipps et al.
1,632,335 A 6/1927 Hiering
1,706,244 A 3/1929 Louis
1,845,340 A 2/1932 Ritz
1,972,118 A 9/1934 Mcdill
1,998,683 A 4/1935 Montgomery
2,031,363 A 2/1936 Elof
2,039,559 A 5/1936 Segal
2,104,266 A 1/1938 McCormick
2,159,698 A 5/1939 Harris et al.
2,177,636 A 10/1939 Coffelt et al.
2,195,260 A 3/1940 Rasener
2,231,909 A 2/1941 Hempel
2,327,120 A 8/1943 McCoon
2,460,427 A 2/1949 Musselman et al.
2,483,304 A 9/1949 Rudolf
2,502,561 A 4/1950 Ludwig
2,765,949 A 10/1956 Swan
2,830,597 A 4/1958 Kummli
2,860,638 A 11/1958 Bartolomeo
2,897,958 A 8/1959 Tarleton et al.
2,935,987 A 5/1960 Ackerbauer
3,146,937 A 9/1964 Vesak et al.
3,258,015 A 6/1966 Herbert et al.
3,271,719 A 9/1966 Ovshinsky
3,292,634 A 12/1966 Beucler et al.
3,373,915 A 3/1968 Wiederecht et al.
3,420,360 A 1/1969 Young
3,443,827 A 5/1969 Peter et al.
3,456,645 A 7/1969 Brock
3,479,561 A 11/1969 Janning
3,567,014 A 3/1971 Feigelman
3,675,661 A 7/1972 Weaver
3,707,017 A 12/1972 Paquette et al.
3,792,704 A 2/1974 Parker
3,815,597 A 6/1974 Goettelman
3,861,523 A 1/1975 Fountain et al.
3,941,300 A 3/1976 Troth
4,020,853 A 5/1977 Nuttall
4,049,005 A 9/1977 Hernandez et al.
4,066,088 A 1/1978 Ensor
4,207,976 A 6/1980 Herman
4,215,708 A 8/1980 Bron
4,219,032 A 8/1980 Tabatznik et al.
4,303,083 A 12/1981 Burruss, Jr.
4,312,367 A 1/1982 Seeman et al.
4,506,683 A 3/1985 Cantrell et al.
4,519,319 A 5/1985 Howlett
4,520,938 A 6/1985 Finke
4,579,858 A 4/1986 Ferno et al.
4,595,024 A 6/1986 Greene et al.
4,597,961 A 7/1986 Etscorn
4,648,393 A 3/1987 Landis et al.
4,708,151 A 11/1987 Shelar
4,735,217 A 4/1988 Gerth et al.
4,771,796 A 9/1988 Myer et al.
4,793,365 A 12/1988 Sensabaugh et al.
4,794,323 A 12/1988 Zhou et al.
4,798,310 A 1/1989 Kasai et al.
4,813,536 A 3/1989 Willis
4,819,665 A 4/1989 Roberts et al.
4,830,028 A 5/1989 Lawson et al.
4,836,224 A 6/1989 Lawson et al.
4,846,199 A 7/1989 Rose
4,848,374 A 7/1989 Chard et al.
4,848,563 A 7/1989 Robbins
4,893,639 A 1/1990 White
4,907,606 A 3/1990 Lilja et al.
4,941,483 A 7/1990 Ridings et al.
4,944,317 A 7/1990 Thal
4,947,874 A 8/1990 Brooks et al.
4,947,875 A 8/1990 Brooks et al.
5,005,759 A 4/1991 Bouche
5,020,548 A 6/1991 Farrier et al.
5,027,836 A 7/1991 Shannon et al.
5,031,646 A 7/1991 Lippiello et al.
5,042,509 A 8/1991 Banerjee et al.
5,050,621 A 9/1991 Creighton et al.
5,060,671 A 10/1991 Counts et al.
5,065,776 A 11/1991 Lawson et al.
5,076,297 A 12/1991 Farrier et al.
5,105,831 A 4/1992 Banerjee et al.
5,105,838 A 4/1992 White et al.
5,123,530 A 6/1992 Lee
5,133,368 A 7/1992 Neumann et al.
5,141,004 A 8/1992 Porenski
5,144,962 A 9/1992 Counts et al.
5,152,456 A 10/1992 Ross et al.
5,183,062 A 2/1993 Clearman et al.
5,224,498 A 7/1993 Deevi et al.
5,240,012 A 8/1993 Ehrman et al.
5,249,586 A 10/1993 Morgan et al.
5,261,424 A 11/1993 Sprinkel, Jr. et al.
5,269,237 A 12/1993 Baker et al.
5,269,327 A 12/1993 Counts et al.
5,303,720 A 4/1994 Banerjee et al.
5,322,075 A 6/1994 Deevi et al.
5,324,498 A 6/1994 Streusand et al.
5,372,148 A 12/1994 McCafferty et al.
5,388,574 A 2/1995 Ingebrethsen et al.
5,449,078 A 9/1995 Akers
5,456,269 A 10/1995 Kollasch
5,497,791 A 3/1996 Bowen et al.
5,529,078 A 6/1996 Rehder et al.
5,579,934 A 12/1996 Buono et al.
5,591,368 A 1/1997 Fleischhauer et al.
5,605,226 A 2/1997 Hernlein
5,626,866 A 5/1997 Ebert et al.
5,641,064 A 6/1997 Goserud
5,649,552 A 7/1997 Cho et al.
5,666,977 A 9/1997 Higgins et al.
5,666,978 A 9/1997 Counts et al.
5,708,258 A 1/1998 Counts et al.
5,730,118 A 3/1998 Hermanson
5,730,158 A 3/1998 Collins et al.
5,746,587 A 5/1998 Racine et al.
5,810,164 A 9/1998 Rennecamp
5,819,756 A 10/1998 Mielordt
5,845,649 A 12/1998 Saito et al.
5,865,185 A 2/1999 Ripley et al.
5,878,752 A 3/1999 Adams et al.
5,881,884 A 3/1999 Podosek
5,894,841 A 4/1999 Voges
5,931,828 A 8/1999 Durkee
5,934,289 A 8/1999 Watkins et al.
5,938,018 A 8/1999 Keaveney et al.
5,944,025 A 8/1999 Cook et al.
5,954,979 A 9/1999 Counts et al.
5,967,310 A 10/1999 Hill
5,975,415 A 11/1999 Zehnal

(56) References Cited

U.S. PATENT DOCUMENTS 5,979,460 A 11/1999 Matsumura
5,994,025 A 11/1999 Iwasa et al.
5,996,589 A 12/1999 St. et al.
6,053,176 A 4/2000 Adams et al.
6,089,857 A 7/2000 Matsuura et al.
6,095,153 A 8/2000 Kessler et al.
6,102,036 A 8/2000 Slutsky et al.
6,125,853 A 10/2000 Susa et al.
6,155,268 A 12/2000 Takeuchi
6,164,287 A 12/2000 White
6,196,232 B1 3/2001 Chkadua
6,211,194 B1 4/2001 Westman et al.
6,234,169 B1 5/2001 Bulbrook et al.
6,269,966 B1 8/2001 Pallo et al.
6,324,261 B1 11/2001 Merte
6,344,222 B1 2/2002 Cherukuri et al.
6,349,728 B1 2/2002 Pham
6,358,060 B2 3/2002 Pinney et al.
6,381,739 B1 4/2002 Breternitz et al.
6,386,371 B1 5/2002 Parsons
6,431,363 B1 8/2002 Hacker
6,446,793 B1 9/2002 Layshock
6,510,982 B2 1/2003 White et al.
6,532,965 B1 3/2003 Abhulimen et al.
6,536,442 B2 3/2003 St. Charles et al.
6,557,708 B2 5/2003 Polacco
6,598,607 B2 7/2003 Adiga et al.
6,603,924 B2 8/2003 Brown et al.
6,606,998 B1 8/2003 Gold
6,612,404 B2 9/2003 Sweet et al.
6,615,840 B1 9/2003 Fournier et al.
6,622,867 B2 9/2003 Menceles
6,655,379 B2 12/2003 Clark et al.
6,672,762 B1 1/2004 Faircloth et al.
6,688,313 B2 2/2004 Wrenn et al.
6,726,006 B1 4/2004 Funderburk et al.
6,772,756 B2 8/2004 Shayan
6,799,576 B2 10/2004 Farr
6,803,545 B2 10/2004 Blake et al.
6,805,545 B2 10/2004 Slaboden
6,810,883 B2 11/2004 Felter et al.
6,827,573 B2 12/2004 St. Charles et al.
6,874,507 B2 4/2005 Farr
6,893,654 B2 5/2005 Pinney et al.
6,909,840 B2 6/2005 Harwig et al.
6,954,979 B2 10/2005 Logan
7,000,775 B2 2/2006 Gelardi et al.
7,015,796 B2 3/2006 Snyder
7,025,066 B2 4/2006 Lawson et al.
D557,209 S 12/2007 Ahlgren et al.
7,374,048 B2 5/2008 Mazurek
7,428,905 B2 9/2008 Mua
7,488,171 B2 2/2009 St. Charles et al.
D590,990 S 4/2009 Hon
D590,991 S 4/2009 Hon
7,546,703 B2 6/2009 Johnske et al.
7,621,403 B2 11/2009 Althoff et al.
7,644,823 B2 1/2010 Gelardi et al.
D611,409 S 3/2010 Green et al.
7,726,320 B2 6/2010 Robinson et al.
7,766,013 B2 8/2010 Wensley et al.
7,767,698 B2 8/2010 Warchol et al.
D624,238 S 9/2010 Turner et al.
7,801,573 B2 9/2010 Yazdi et al.
7,815,332 B1 10/2010 Smith
7,832,410 B2 11/2010 Hon
7,886,507 B2 2/2011 McGuinness, Jr.
D642,330 S 7/2011 Turner
D644,375 S 8/2011 Zhou
7,988,034 B2 8/2011 Pezzoli
8,003,080 B2 8/2011 Rabinowitz et al.
D649,932 S 12/2011 Symons
8,079,371 B2 12/2011 Robinson et al.
D653,803 S 2/2012 Timmermans et al.
8,141,701 B2 3/2012 Hodges
8,156,944 B2 4/2012 Han
8,251,060 B2 8/2012 White et al.
8,308,624 B2 11/2012 Travers et al.
8,314,235 B2 11/2012 Dixit et al.
8,322,350 B2 12/2012 Lipowicz
D674,748 S 1/2013 Ferber et al.
8,371,310 B2 2/2013 Brenneise
8,375,957 B2 2/2013 Hon
8,381,739 B2 2/2013 Gonda
8,387,612 B2 3/2013 Damani et al.
8,443,534 B2 5/2013 Goodfellow et al.
8,464,867 B2 6/2013 Holloway et al.
D686,987 S 7/2013 Vanstone et al.
1,067,531 A1 7/2013 MacGregor
8,479,747 B2 7/2013 O'Connell
8,490,629 B1 7/2013 Shenassa et al.
8,511,318 B2 8/2013 Hon
8,539,959 B1 9/2013 Scatterday
8,541,401 B2 9/2013 Mishra et al.
D691,324 S 10/2013 Saliman
8,550,069 B2 10/2013 Alelov
D695,450 S 12/2013 Benassayag et al.
8,596,460 B2 12/2013 Scatterday
D700,572 S 3/2014 Esses
8,671,952 B2 3/2014 Winterson et al.
8,707,965 B2 4/2014 Newton
D704,629 S 5/2014 Liu
D704,634 S 5/2014 Eidelman et al.
8,714,150 B2 5/2014 Alelov
D707,389 S 6/2014 Liu
8,741,348 B2 6/2014 Hansson et al.
8,794,245 B1 8/2014 Scatterday
8,794,434 B2 8/2014 Scatterday et al.
8,809,261 B2 8/2014 Elsohly et al.
8,820,330 B2 9/2014 Bellinger et al.
8,851,081 B2 10/2014 Fernando et al.
8,851,083 B2 10/2014 Oglesby et al.
8,881,737 B2 11/2014 Collett et al.
8,899,238 B2 12/2014 Robinson et al.
8,905,040 B2 12/2014 Scatterday et al.
8,910,641 B2 12/2014 Hon
8,915,254 B2 12/2014 Monsees et al.
8,919,561 B2 12/2014 Boisseau
8,925,555 B2 1/2015 Monsees et al.
8,931,492 B2 1/2015 Scatterday
D725,310 S 3/2015 Eksouzian
D725,823 S 3/2015 Scatterday et al.
8,991,402 B2 3/2015 Bowen et al.
9,004,073 B2 4/2015 Tucker et al.
9,010,335 B1 4/2015 Scatterday
9,072,321 B2 7/2015 Liu
9,089,166 B1 7/2015 Scatterday
9,095,175 B2 8/2015 Terry et al.
9,215,895 B2 12/2015 Bowen et al.
9,220,302 B2 12/2015 DePiano et al.
9,226,526 B2 1/2016 Liu
9,254,002 B2 2/2016 Chong et al.
9,255,277 B2 2/2016 Bakker et al.
9,271,525 B2 3/2016 Liu
9,271,529 B2 3/2016 Alima
9,272,103 B2 3/2016 Storz
9,277,768 B2 3/2016 Xiu
9,277,769 B2 3/2016 Liu
9,282,772 B2 3/2016 Tucker et al.
9,282,773 B2 3/2016 Greim et al.
9,289,014 B2 3/2016 Tucker et al.
9,308,336 B2 4/2016 Newton
9,315,890 B1 4/2016 Frick et al.
9,319,865 B2 4/2016 Van Phan et al.
9,326,547 B2 5/2016 Tucker et al.
9,345,269 B2 5/2016 Liu
9,351,522 B2 5/2016 Safari
9,380,810 B2 7/2016 Rose et al.
9,420,829 B2 8/2016 Thorens et al.
9,427,022 B2 8/2016 Levin et al.
9,456,632 B2 10/2016 Hon
9,462,832 B2 10/2016 Lord et al.
9,497,995 B2 11/2016 Liu
9,510,624 B2 12/2016 Li et al.

(56) References Cited

U.S. PATENT DOCUMENTS 9,538,781 B2 1/2017 Zheng
9,554,597 B2 1/2017 Liu
9,596,881 B2 3/2017 Chiolini et al.
9,623,592 B2 4/2017 Liu
9,629,391 B2 4/2017 Dube et al.
9,635,886 B2 5/2017 Tu et al.
9,642,397 B2 5/2017 Dai et al.
9,648,905 B2 5/2017 Levitz et al.
9,675,108 B2 6/2017 Liu
9,682,203 B2 6/2017 Dähne et al.
9,682,204 B2 6/2017 Matsumoto et al.
9,687,025 B2 6/2017 Cyphert et al.
9,687,027 B2 6/2017 Poston et al.
9,693,584 B2 7/2017 Hearn et al.
9,717,274 B2 8/2017 Daehne et al.
9,717,279 B2 8/2017 Hon
10,952,468 B2 3/2021 Bowen et al.
2001/0015209 A1 8/2001 Zielke
2001/0032643 A1 10/2001 Hochrainer et al.
2001/0032795 A1 10/2001 Weinstein et al.
2001/0052480 A1 12/2001 Kawaguchi et al.
2002/0043554 A1 4/2002 White et al.
2002/0059939 A1 5/2002 Fox
2002/0078951 A1 6/2002 Nichols et al.
2002/0175164 A1 11/2002 Dees et al.
2003/0005926 A1 1/2003 Jones et al.
2003/0089377 A1 5/2003 Hajaligol et al.
2004/0002520 A1 1/2004 Soderlund et al.
2004/0031495 A1 2/2004 Steinberg
2004/0050382 A1 3/2004 Goodchild
2004/0099266 A1 5/2004 Cross et al.
2004/0149296 A1 8/2004 Rostami et al.
2004/0149624 A1 8/2004 Wischusen et al.
2004/0173229 A1 9/2004 Crooks et al.
2004/0182403 A1 9/2004 Andersson et al.
2004/0191322 A1 9/2004 Hansson
2004/0221857 A1 11/2004 Dominguez
2004/0237974 A1 12/2004 Min
2005/0016549 A1 1/2005 Banerjee et al.
2005/0016550 A1 1/2005 Katase
2005/0034723 A1 2/2005 Bennett et al.
2005/0061759 A1 3/2005 Doucette
2005/0118545 A1 6/2005 Wong
2005/0145533 A1 7/2005 Seligson
2005/0169849 A1 8/2005 Farr
2005/0172976 A1 8/2005 Newman et al.
2005/0244521 A1 11/2005 Strickland et al.
2005/0268911 A1 12/2005 Cross et al.
2006/0018840 A1 1/2006 Lechuga-Ballesteros et al.
2006/0054676 A1 3/2006 Wischusen
2006/0102175 A1 5/2006 Nelson
2006/0150991 A1 7/2006 Lee
2006/0157072 A1 7/2006 Albino et al.
2006/0191546 A1 8/2006 Takano et al.
2006/0191548 A1 8/2006 Strickland et al.
2006/0196518 A1 9/2006 Hon
2006/0243290 A1 11/2006 Reich et al.
2006/0254948 A1 11/2006 Herbert et al.
2006/0255105 A1 11/2006 Sweet
2007/0006889 A1 1/2007 Kobal et al.
2007/0045288 A1 3/2007 Nelson
2007/0062548 A1 3/2007 Horstmann et al.
2007/0074734 A1 4/2007 Braunshteyn et al.
2007/0098148 A1 5/2007 Sherman
2007/0102013 A1 5/2007 Adams et al.
2007/0144514 A1 6/2007 Yeates et al.
2007/0163610 A1 7/2007 Lindell et al.
2007/0215164 A1 9/2007 Mehio
2007/0235046 A1 10/2007 Gedevanishvili
2007/0267031 A1 11/2007 Hon
2007/0267033 A1 11/2007 Mishra et al.
2007/0277816 A1 12/2007 Morrison et al.
2007/0280652 A1 12/2007 Williams
2007/0283972 A1 12/2007 Monsees et al.
2008/0000763 A1 1/2008 Cove
2008/0023003 A1 1/2008 Rosenthal
2008/0029095 A1 2/2008 Esser
2008/0092912 A1 4/2008 Robinson et al.
2008/0121610 A1 5/2008 Nagata et al.
2008/0138423 A1 6/2008 Gonda
2008/0149118 A1 6/2008 Oglesby et al.
2008/0216828 A1 9/2008 Wensley et al.
2008/0228214 A1 9/2008 Hoan et al.
2008/0241255 A1 10/2008 Rose et al.
2008/0257367 A1 10/2008 Paterno et al.
2008/0276947 A1 11/2008 Martzel
2008/0286340 A1 11/2008 Andersson et al.
2008/0302375 A1 12/2008 Andersson et al.
2009/0004249 A1 1/2009 Gonda
2009/0023819 A1 1/2009 Axelsson
2009/0095287 A1 4/2009 Emarlou
2009/0095311 A1 4/2009 Han
2009/0111287 A1 4/2009 Lindberg et al.
2009/0126745 A1 5/2009 Hon
2009/0133691 A1 5/2009 Yamada et al.
2009/0151717 A1 6/2009 Bowen et al.
2009/0230117 A1 9/2009 Fernando et al.
2009/0255534 A1 10/2009 Paterno
2009/0267252 A1 10/2009 Ikeyama
2009/0272379 A1 11/2009 Thorens et al.
2009/0283103 A1 11/2009 Nielsen et al.
2009/0288668 A1 11/2009 Inagaki
2009/0288669 A1 11/2009 Hutchens
2009/0293892 A1 12/2009 Williams et al.
2009/0293895 A1 12/2009 Axelsson et al.
2010/0000672 A1 1/2010 Fogle
2010/0006092 A1 1/2010 Hale et al.
2010/0024834 A1 2/2010 Oglesby et al.
2010/0031968 A1 2/2010 Sheikh et al.
2010/0156193 A1 6/2010 Rhodes et al.
2010/0163063 A1 7/2010 Fernando et al.
2010/0186757 A1 7/2010 Crooks et al.
2010/0200006 A1 8/2010 Robinson et al.
2010/0200008 A1 8/2010 Taieb
2010/0236562 A1 9/2010 Hearn et al.
2010/0242974 A1 9/2010 Pan
2010/0242976 A1 9/2010 Katayama et al.
2010/0260688 A1 10/2010 Warchol et al.
2010/0275938 A1 11/2010 Roth et al.
2010/0276333 A1 11/2010 Couture
2010/0307116 A1 12/2010 Fisher
2011/0005535 A1 1/2011 Xiu
2011/0030706 A1 2/2011 Gibson et al.
2011/0036346 A1 2/2011 Cohen et al.
2011/0041861 A1 2/2011 Sebastian et al.
2011/0049226 A1 3/2011 Moreau et al.
2011/0094523 A1 4/2011 Thorens et al.
2011/0108023 A1 5/2011 McKinney et al.
2011/0155153 A1 6/2011 Thorens et al.
2011/0162667 A1 7/2011 Burke et al.
2011/0168194 A1 7/2011 Hon
2011/0180433 A1 7/2011 Rennecamp
2011/0192397 A1 8/2011 Saskar et al.
2011/0226236 A1 9/2011 Buchberger
2011/0226266 A1 9/2011 Tao
2011/0232654 A1 9/2011 Mass
2011/0236002 A1 9/2011 Oglesby et al.
2011/0240047 A1 10/2011 Adamic
2011/0265806 A1 11/2011 Alarcon et al.
2011/0268809 A1 11/2011 Brinkley et al.
2011/0274628 A1 11/2011 Borschke
2011/0277780 A1 11/2011 Terry et al.
2011/0278189 A1 11/2011 Terry et al.
2011/0293535 A1 12/2011 Kosik et al.
2011/0315701 A1 12/2011 Everson
2012/0006342 A1 1/2012 Rose et al.
2012/0039981 A1 2/2012 Pedersen et al.
2012/0060853 A1 3/2012 Robinson et al.
2012/0111347 A1 5/2012 Hon
2012/0152265 A1 6/2012 Dube et al.
2012/0192880 A1 8/2012 Dube et al.
2012/0199146 A1 8/2012 Marangos
2012/0204889 A1 8/2012 Xiu
2012/0227753 A1 9/2012 Newton

(56) References Cited

U.S. PATENT DOCUMENTS

2012/0255567 A1 10/2012 Rose et al.
2012/0260927 A1 10/2012 Liu
2012/0261286 A1 10/2012 Holloway et al.
2012/0267383 A1 10/2012 Van Rooyen
2012/0273589 A1 11/2012 Hon
2012/0285475 A1 11/2012 Liu
2012/0291791 A1 11/2012 Pradeep
2012/0325227 A1 12/2012 Robinson et al.
2012/0325228 A1* 12/2012 Williams ..... A24B 15/167 131/328
2013/0042865 A1 2/2013 Monsees et al.
2013/0068239 A1 3/2013 Youn
2013/0081642 A1 4/2013 Safari
2013/0098377 A1 4/2013 Borschke et al.
2013/0140200 A1 6/2013 Scatterday
2013/0152922 A1 6/2013 Scatterday
2013/0186416 A1 7/2013 Gao et al.
2013/0192615 A1 8/2013 Tucker et al.
2013/0192617 A1 8/2013 Thompson
2013/0199528 A1 8/2013 Goodman et al.
2013/0213417 A1 8/2013 Chong et al.
2013/0213419 A1 8/2013 Tucker et al.
2013/0228191 A1 9/2013 Newton
2013/0247924 A1 9/2013 Scatterday et al.
2013/0248385 A1 9/2013 Scatterday et al.
2013/0255702 A1 10/2013 Griffith et al.
2013/0276802 A1 10/2013 Scatterday
2013/0284190 A1 10/2013 Scatterday et al.
2013/0284191 A1 10/2013 Scatterday et al.
2013/0298905 A1 11/2013 Levin et al.
2013/0312742 A1 11/2013 Monsees et al.
2013/0313139 A1 11/2013 Scatterday et al.
2013/0319435 A1 12/2013 Flick
2013/0319440 A1 12/2013 Capuano
2013/0333700 A1 12/2013 Buchberger
2013/0333712 A1 12/2013 Scatterday
2013/0340775 A1 12/2013 Juster et al.
2014/0000638 A1 1/2014 Sebastian et al.
2014/0007891 A1 1/2014 Liu
2014/0014124 A1 1/2014 Glasberg et al.
2014/0014126 A1 1/2014 Peleg et al.
2014/0041655 A1 2/2014 Barron et al.
2014/0041658 A1 2/2014 Goodman et al.
2014/0053856 A1 2/2014 Liu
2014/0053858 A1 2/2014 Liu
2014/0060552 A1 3/2014 Cohen
2014/0060556 A1 3/2014 Liu
2014/0083442 A1 3/2014 Scatterday
2014/0096781 A1 4/2014 Sears et al.
2014/0096782 A1 4/2014 Ampolini et al.
2014/0109921 A1 4/2014 Chen
2014/0116455 A1 5/2014 Youn
2014/0123990 A1 5/2014 Timmermans
2014/0144429 A1 5/2014 Wensley et al.
2014/0150810 A1 6/2014 Hon
2014/0166028 A1 6/2014 Fuisz et al.
2014/0174459 A1 6/2014 Burstyn
2014/0190501 A1 7/2014 Liu
2014/0190503 A1 7/2014 Li et al.
2014/0196731 A1 7/2014 Scatterday
2014/0196735 A1 7/2014 Liu
2014/0202472 A1 7/2014 Levitz et al.
2014/0202474 A1 7/2014 Peleg et al.
2014/0209105 A1 7/2014 Sears et al.
2014/0216450 A1 8/2014 Liu
2014/0217092 A1 8/2014 Kawka et al.
2014/0230835 A1 8/2014 Saliman
2014/0261474 A1 9/2014 Gonda
2014/0261486 A1 9/2014 Potter et al.
2014/0261487 A1 9/2014 Chapman et al.
2014/0261507 A1 9/2014 Balder
2014/0270727 A1 9/2014 Ampolini et al.
2014/0271946 A1 9/2014 Kobal et al.
2014/0299137 A1 10/2014 Kieckbusch et al.
2014/0301721 A1 10/2014 Ruscio et al.
2014/0305450 A1 10/2014 Xiang
2014/0345631 A1 11/2014 Bowen et al.
2014/0345633 A1 11/2014 Talon et al.
2014/0345635 A1 11/2014 Rabinowitz et al.
2014/0355969 A1 12/2014 Stern
2014/0366898 A1 12/2014 Monsees et al.
2014/0378790 A1 12/2014 Cohen
2015/0020823 A1 1/2015 Lipowicz et al.
2015/0020824 A1 1/2015 Bowen et al.
2015/0020825 A1 1/2015 Galloway et al.
2015/0020830 A1 1/2015 Koller
2015/0020831 A1 1/2015 Weigensberg et al.
2015/0027457 A1 1/2015 Janardhan et al.
2015/0027468 A1 1/2015 Li et al.
2015/0027472 A1 1/2015 Amir
2015/0034103 A1 2/2015 Hon
2015/0034104 A1 2/2015 Zhou
2015/0038567 A1 2/2015 Herkenroth et al.
2015/0040929 A1 2/2015 Hon
2015/0101625 A1 4/2015 Newton et al.
2015/0122252 A1 5/2015 Frija
2015/0122274 A1 5/2015 Cohen et al.
2015/0128965 A1 5/2015 Lord
2015/0128966 A1 5/2015 Lord
2015/0128967 A1 5/2015 Robinson et al.
2015/0128976 A1 5/2015 Verleur et al.
2015/0136153 A1 5/2015 Lord
2015/0136158 A1 5/2015 Stevens et al.
2015/0142387 A1 5/2015 Alarcon et al.
2015/0144147 A1 5/2015 Li et al.
2015/0150308 A1 6/2015 Monsees et al.
2015/0157054 A1 6/2015 Liu
2015/0157056 A1 6/2015 Bowen et al.
2015/0164141 A1 6/2015 Newton
2015/0164144 A1 6/2015 Liu
2015/0164147 A1 6/2015 Verleur et al.
2015/0181928 A1 7/2015 Liu
2015/0189695 A1 7/2015 Xiang
2015/0196059 A1 7/2015 Liu
2015/0196060 A1 7/2015 Wensley et al.
2015/0208729 A1 7/2015 Monsees et al.
2015/0208731 A1 7/2015 Malamud et al.
2015/0216237 A1 8/2015 Wensley et al.
2015/0223521 A1 8/2015 Menting et al.
2015/0224268 A1 8/2015 Henry et al.
2015/0237917 A1 8/2015 Lord
2015/0237918 A1 8/2015 Liu
2015/0245654 A1 9/2015 Memari et al.
2015/0245660 A1 9/2015 Lord
2015/0257445 A1 9/2015 Henry, Jr. et al.
2015/0258289 A1 9/2015 Henry, Jr. et al.
2015/0272220 A1 10/2015 Spinka et al.
2015/0272222 A1 10/2015 Spinka et al.
2015/0282525 A1 10/2015 Plojoux et al.
2015/0282527 A1 10/2015 Henry, Jr. et al.
2015/0305409 A1 10/2015 Verleur et al.
2015/0313275 A1 11/2015 Anderson et al.
2015/0313285 A1 11/2015 Waller et al.
2015/0320114 A1 11/2015 Wu
2015/0335074 A1 11/2015 Leung
2015/0351456 A1 12/2015 Johnson et al.
2015/0359264 A1 12/2015 Fernando et al.
2015/0366265 A1 12/2015 Lansing
2015/0366266 A1 12/2015 Chen
2016/0021931 A1 1/2016 Hawes et al.
2016/0021932 A1 1/2016 Silvestrini et al.
2016/0021933 A1 1/2016 Thorens et al.
2016/0021934 A1 1/2016 Cadieux et al.
2016/0029694 A1 2/2016 Malgat et al.
2016/0029697 A1 2/2016 Shafer
2016/0029698 A1 2/2016 Xiang
2016/0044967 A1 2/2016 Bowen et al.
2016/0044968 A1 2/2016 Bowen et al.
2016/0053988 A1 2/2016 Quintana
2016/0057811 A1 2/2016 Alarcon et al.
2016/0058071 A1 3/2016 Hearn
2016/0058072 A1 3/2016 Liu
2016/0073692 A1 3/2016 Alarcon et al.
2016/0081393 A1 3/2016 Black

(56) References Cited

U.S. PATENT DOCUMENTS

| | | | |
|---|---|---|---|
| 2016/0081395 | A1 | 3/2016 | Thorens et al. |
| 2016/0095355 | A1 | 4/2016 | Hearn |
| 2016/0106154 | A1 | 4/2016 | Lord |
| 2016/0106155 | A1 | 4/2016 | Reevell |
| 2016/0106936 | A1 | 4/2016 | Kimmel |
| 2016/0109115 | A1 | 4/2016 | Lipowicz |
| 2016/0120218 | A1 | 5/2016 | Schennum et al. |
| 2016/0120220 | A1 | 5/2016 | Malgat et al. |
| 2016/0120227 | A1 | 5/2016 | Levitz et al. |
| 2016/0120228 | A1 | 5/2016 | Rostami et al. |
| 2016/0135503 | A1 | 5/2016 | Liu |
| 2016/0143359 | A1 | 5/2016 | Xiang |
| 2016/0143365 | A1 | 5/2016 | Liu |
| 2016/0157524 | A1 | 6/2016 | Bowen et al. |
| 2016/0166564 | A1 | 6/2016 | Myers et al. |
| 2016/0174603 | A1 | 6/2016 | Abayarathna et al. |
| 2016/0174611 | A1 | 6/2016 | Monsees et al. |
| 2016/0200463 | A1 | 7/2016 | Hodges et al. |
| 2016/0227839 | A1 | 8/2016 | Zuber et al. |
| 2016/0227840 | A1 | 8/2016 | Xiang et al. |
| 2016/0242466 | A1 | 8/2016 | Lord et al. |
| 2016/0249680 | A1 | 9/2016 | Liu et al. |
| 2016/0250201 | A1 | 9/2016 | Rose et al. |
| 2016/0278435 | A1 | 9/2016 | Choukroun et al. |
| 2016/0295924 | A1 | 10/2016 | Liu |
| 2016/0295926 | A1 | 10/2016 | Zuber |
| 2016/0302471 | A1 | 10/2016 | Bowen et al. |
| 2016/0302483 | A1 | 10/2016 | Liu |
| 2016/0302484 | A1 | 10/2016 | Gupta et al. |
| 2016/0302486 | A1 | 10/2016 | Eroch |
| 2016/0309784 | A1 | 10/2016 | Silvestrini et al. |
| 2016/0324215 | A1 | 11/2016 | Mironov et al. |
| 2016/0331033 | A1 | 11/2016 | Hopps et al. |
| 2016/0331038 | A1 | 11/2016 | Farine et al. |
| 2016/0331040 | A1 | 11/2016 | Nakano et al. |
| 2016/0338402 | A1 | 11/2016 | Buehler et al. |
| 2016/0338410 | A1 | 11/2016 | Batista et al. |
| 2016/0338411 | A1 | 11/2016 | Liu |
| 2016/0345627 | A1 | 12/2016 | Liu et al. |
| 2016/0345630 | A1 | 12/2016 | Mironov et al. |
| 2016/0366939 | A1 | 12/2016 | Alarcon et al. |
| 2016/0368670 | A1 | 12/2016 | Beardsall |
| 2016/0371464 | A1 | 12/2016 | Bricker |
| 2016/0374390 | A1 | 12/2016 | Liu |
| 2016/0374398 | A1 | 12/2016 | Amir |
| 2017/0019951 | A1 | 1/2017 | Louveau et al. |
| 2017/0049155 | A1 | 2/2017 | Liu |
| 2017/0064999 | A1 | 3/2017 | Perez et al. |
| 2017/0071257 | A1 | 3/2017 | Lin |
| 2017/0079329 | A1 | 3/2017 | Zitzke |

FOREIGN PATENT DOCUMENTS

| | | | |
|---|---|---|---|
| CN | 1122213 | A | 5/1996 |
| CN | 1541577 | A | 11/2004 |
| CN | 1607950 | A | 4/2005 |
| CN | 1887126 | A | 1/2007 |
| CN | 101742985 | A | 6/2010 |
| CN | 101756352 | A | 6/2010 |
| CN | 101869356 | A | 10/2010 |
| CN | 102316850 | A | 1/2012 |
| CN | 102355914 | A | 2/2012 |
| CN | 102612361 | A | 7/2012 |
| CN | 102754924 | A | 10/2012 |
| CN | 102892413 | A | 1/2013 |
| CN | 102933199 | A | 2/2013 |
| CN | 105263345 | A | 1/2016 |
| DE | 4200639 | A1 | 7/1992 |
| DE | 19854005 | A1 | 5/2000 |
| DE | 19854012 | A1 | 5/2000 |
| EP | 0148749 | A2 | 7/1985 |
| EP | 0283672 | A2 | 9/1988 |
| EP | 0532194 | A1 | 3/1993 |
| EP | 0535695 | A2 | 4/1993 |
| EP | 1458388 | A1 | 9/2004 |
| EP | 1618803 | A1 | 1/2006 |
| EP | 1618803 | B1 | 12/2008 |
| EP | 2022349 | A1 | 2/2009 |
| EP | 2022350 | A1 | 2/2009 |
| EP | 2110033 | A1 | 10/2009 |
| EP | 2325093 | B1 | 6/2012 |
| EP | 2609821 | A1 | 7/2013 |
| EP | 2152313 | B1 | 9/2014 |
| EP | 2856893 | A1 | 4/2015 |
| EP | 2908675 | A1 | 8/2015 |
| EP | 2319934 | B1 | 9/2015 |
| EP | 2915443 | A1 | 9/2015 |
| EP | 3024343 | A2 | 6/2016 |
| EP | 3062646 | A1 | 9/2016 |
| EP | 3065581 | A2 | 9/2016 |
| EP | 3068244 | A1 | 9/2016 |
| EP | 3214957 | B1 | 9/2017 |
| ES | 2118034 | A1 | 9/1998 |
| GB | 1025630 | A | 4/1966 |
| GB | 1065678 | A | 4/1967 |
| IE | S2005-0051 | | 2/2005 |
| IE | S2005-0563 | | 8/2005 |
| IE | S2005-0615 | | 9/2005 |
| JP | S61254170 | A | 11/1986 |
| JP | 62-278975 | | 12/1987 |
| JP | 64-37276 | A | 2/1989 |
| JP | 02-145179 | A | 6/1990 |
| JP | H02145179 | A | 6/1990 |
| JP | 03-049671 | | 3/1991 |
| JP | 03-180166 | | 8/1991 |
| JP | 09-075058 | | 3/1997 |
| JP | 10-501999 | A | 2/1998 |
| JP | 11-178563 | | 7/1999 |
| JP | 2000203639 | A | 7/2000 |
| JP | 2000236865 | A | 9/2000 |
| JP | 2001165437 | A | 6/2001 |
| JP | 2005034021 | A | 2/2005 |
| JP | 2006504430 | A5 | 2/2006 |
| JP | 2006524494 | A | 11/2006 |
| JP | 2009108082 | A | 5/2009 |
| JP | 2010531188 | A | 9/2010 |
| JP | 2010532672 | A | 10/2010 |
| JP | 2013505240 | A | 2/2013 |
| JP | 2016513030 | A | 5/2016 |
| JP | 6877141 | B2 | 12/2016 |
| KR | 0193885 | B1 | 6/1999 |
| KR | 20100034029 | A | 3/2010 |
| MX | 2015015175 | A | 1/2016 |
| RU | 94815 | U1 | 6/2010 |
| UA | 67598 | U | 2/2012 |
| WO | 1995001137 | A1 | 6/1994 |
| WO | 1997012639 | A1 | 10/1995 |
| WO | WO-9712639 | A1 | 4/1997 |
| WO | 2000028842 | A1 | 11/1999 |
| WO | 2003082031 | A1 | 12/2002 |
| WO | 2003094900 | A1 | 5/2003 |
| WO | 2003056948 | A1 | 7/2003 |
| WO | 2003055486 | A1 | 10/2003 |
| WO | 2003103387 | A2 | 12/2003 |
| WO | WO-2004002446 | A1 | 1/2004 |
| WO | 2004064548 | A1 | 8/2004 |
| WO | 2004076289 | A2 | 9/2004 |
| WO | 2004080216 | A1 | 9/2004 |
| WO | 2005020726 | A1 | 3/2005 |
| WO | 2006004646 | A1 | 1/2006 |
| WO | 2006015070 | A1 | 2/2006 |
| WO | WO-2006053082 | A2 | 5/2006 |
| WO | WO-2006082571 | A1 | 8/2006 |
| WO | 2007026131 | A1 | 3/2007 |
| WO | 2007078273 | A1 | 7/2007 |
| WO | 2008077271 | A1 | 7/2008 |
| WO | 2008121610 | A1 | 10/2008 |
| WO | 2009001085 | A2 | 12/2008 |
| WO | WO-2009079641 | A2 | 6/2009 |
| WO | 2010023561 | A1 | 3/2010 |
| WO | 2011033396 | A2 | 3/2011 |
| WO | 2011038104 | A2 | 3/2011 |
| WO | WO-2011034723 | A1 | 3/2011 |
| WO | 2011117580 | A2 | 9/2011 |

(56) References Cited

FOREIGN PATENT DOCUMENTS

| | | | |
|---|---|---|---|
| WO | WO-2011109849 | A1 | 9/2011 |
| WO | 2012021972 | A1 | 2/2012 |
| WO | 2012027350 | A2 | 3/2012 |
| WO | 2012085207 | A1 | 6/2012 |
| WO | 2012120487 | A2 | 9/2012 |
| WO | WO-2012134380 | A1 | 10/2012 |
| WO | WO-2013013808 | A1 | 1/2013 |
| WO | 2013044537 | A1 | 4/2013 |
| WO | 2013050934 | A1 | 4/2013 |
| WO | 2013083631 | A1 | 6/2013 |
| WO | 2013083635 | A1 | 6/2013 |
| WO | 2013089551 | A1 | 6/2013 |
| WO | WO-2013088230 | A1 | 6/2013 |
| WO | 2013098398 | A2 | 7/2013 |
| WO | WO-2013116558 | A1 | 8/2013 |
| WO | WO-2013116561 | A1 | 8/2013 |
| WO | 2013142678 | A1 | 9/2013 |
| WO | 2014004648 | A1 | 1/2014 |
| WO | 2014040915 | A1 | 3/2014 |
| WO | 2014093127 | A2 | 6/2014 |
| WO | 2014101734 | A1 | 7/2014 |
| WO | 2014118286 | A2 | 8/2014 |
| WO | 2014139611 | A1 | 9/2014 |
| WO | 2014140087 | A1 | 9/2014 |
| WO | 2014150245 | A1 | 9/2014 |
| WO | 2014150704 | A2 | 9/2014 |
| WO | 2014151434 | A2 | 9/2014 |
| WO | 2014159250 | A1 | 10/2014 |
| WO | 2014159982 | A1 | 10/2014 |
| WO | 2014177859 | A1 | 11/2014 |
| WO | 2014187763 | A1 | 11/2014 |
| WO | 2014187770 | A2 | 11/2014 |
| WO | 2014190079 | A2 | 11/2014 |
| WO | WO-2014182736 | A1 | 11/2014 |
| WO | 2014205263 | A1 | 12/2014 |
| WO | 2015006652 | A1 | 1/2015 |
| WO | 2015009862 | A2 | 1/2015 |
| WO | 2015028815 | A1 | 3/2015 |
| WO | 2015040180 | A2 | 3/2015 |
| WO | 2015042412 | A1 | 3/2015 |
| WO | 2015058387 | A1 | 4/2015 |
| WO | 2015063126 | A1 | 5/2015 |
| WO | 2015066136 | A1 | 5/2015 |
| WO | 2015073975 | A1 | 5/2015 |
| WO | 2015082652 | A1 | 6/2015 |
| WO | 2015089711 | A1 | 6/2015 |
| WO | 2015091258 | A1 | 6/2015 |
| WO | WO-2015084544 | A1 | 6/2015 |
| WO | 2015101651 | A1 | 7/2015 |
| WO | 2015109616 | A1 | 7/2015 |
| WO | 2015124878 | A1 | 8/2015 |
| WO | 2015148547 | A1 | 10/2015 |
| WO | 2015149647 | A1 | 10/2015 |
| WO | 2015157893 | A1 | 10/2015 |
| WO | 2015157901 | A1 | 10/2015 |
| WO | WO-2015148649 | A2 | 10/2015 |
| WO | 2015165067 | A1 | 11/2015 |
| WO | 2015168828 | A1 | 11/2015 |
| WO | 2015169127 | A1 | 11/2015 |
| WO | 2015175979 | A1 | 11/2015 |
| WO | 2015179292 | A1 | 11/2015 |
| WO | 2015179641 | A1 | 11/2015 |
| WO | WO-2015167629 | A1 | 11/2015 |
| WO | 2015193456 | A1 | 12/2015 |
| WO | 2016012769 | A1 | 1/2016 |
| WO | 2016014652 | A1 | 1/2016 |
| WO | 2016020675 | A1 | 2/2016 |
| WO | 2016030661 | A1 | 3/2016 |
| WO | 2016040575 | A1 | 3/2016 |
| WO | 2016041114 | A1 | 3/2016 |
| WO | 2016041140 | A1 | 3/2016 |
| WO | 2016050247 | A1 | 4/2016 |
| WO | 2016054580 | A1 | 4/2016 |
| WO | 2016058189 | A1 | 4/2016 |
| WO | 2016062777 | A1 | 4/2016 |
| WO | 2016063775 | A1 | 4/2016 |
| WO | 2016065606 | A1 | 5/2016 |
| WO | 2016071705 | A1 | 5/2016 |
| WO | 2016071706 | A1 | 5/2016 |

OTHER PUBLICATIONS

Baker et al., The pyrolysis of tobacco ingredients, J. Anal. Appl. Pyrolysis, Mar. 2004, pp. 223-311, vol. 7, No. 1.

Baker, et al., An overview of the effects of tobacco ingredients on smoke chemistry and toxicity, Food and Chemical Toxicology, 42S, 2004.

Baker, et al., The effect of tobacco ingredients on smoke chemistry. Part II: Casing ingredients, Food and Chemical Toxicology, 42S, 2004.

Bao, et al., An improved headspace solid-phase microextraction method for the analysis of free-base nicotine in particulate phase of mainstream cigarette smoke, Analytica ChimicActa, 49-54, 2010.

Bastin, et al., Salt Selection and Optimization Procedures for Pharmaceutical New Chemical Entities, Organic Process Research & Development, 4, 2000, pp. 427-435.

Bates, Tobacco Additives: Cigarette Engineering and Nicotine Addiction, ASH UK Report, 1999.

Bertholon, et al. Comparison of the aerosol produced by electronic cigarettes with conventional cigarettes and the shisha, Revue des maladies respiratories, 2013, pp. 752-757.

Bertholon, et al. Electronic cigarettes: a short review, Respiration, 2013, pp. 433-438.

Bombick et al., Chemical and biological studies of a new cigarette that primarily heats tobacco; Part 2: In vitro toxicology of mainstream smoke condensate, Food and Chemical Toxicology, Mar. 1998, pp. 183-190, vol. 36, No. 3.

Bombick et al., Chemical and biological studies of a new cigarette that primarily heats tobacco; Part 3: In vitro toxicity of whole smoke, Food and Chemical Toxicology, Mar. 1998, pp. 191-197, vol. 36, No. 3.

Borgerding et al., Chemical and biological studies of a new cigarette that primarily heats tobacco; Part 1: Chemical composition of mainstream smoke, Food and Chemical Toxicology, Mar. 1998, pp. 169-182, vol. 36, No. 3.

Bowen et al., U.S. Appl. No. 15/309,554 entitled Systems and methods for aerosolizing a smokeable material, filed Nov. 8, 2016.

Bradley, et al., Electronic cigarette aerosol particle size distribution measurements, Inhal. Toxicol., Dec. 2012, pp. 976-984, vol. 24, No. 14.

Brown, Electronic cigarettes: product characterization and design considerations, Tobacco control 23, 2014, pp. ii4-ii10.

Brown, et al., Caffeine and Cigarette Smoking: Behavioral, Cardiovascular, and Metabolic Interactions, Pharmacology Biochemistry and Behavior, 1989, pp. 565-570, 1989, vol. 34.

Bullen et al. Effect of an electronic nicotine delivery device (e cigarette) on desire to smoke and withdrawal, user preferences and nicotine delivery: randomized cross-over trial, Tobacco Control, Apr. 2010, pp. 98-103, vol. 19, No. 2.

Bullen, et al. Study protocol for a randomized controlled trial of electronic cigarettes versus nicotine patch for smoking cessation, BMC public health, 2013, p. 210.

Burch et al., Effect of pH on nicotine absorption and side effects produced by aerosolized nicotine, Journal of Aerosol Medicine: Deposition, Clearance, and Effects in the Lung, 1993, pp. 45-52, vol. 6, No. 1.

Cahn, et al., Electronic cigarettes as a harm reduction strategy for tobacco control: a step forward or a repeat of past mistakes?, Journal of public health policy, 2011, pp. 16-31.

Caldwell, et al., A Systematic Review of Nicotine by Inhalation: Is There a Role for the Inhaled Route?, Nicotine & Tobacco Research, 2012, pp. 1-13.

Callicutt, The role of ammonia in the transfer of nicotine from tobacco to mainstream smoke, Regulatory Toxicology and Pharmacology, 2006, p. 46.

(56) References Cited

OTHER PUBLICATIONS

Caponnetto, et al., EffiCiency and Safety of an eLectronic cigAreTte (ECLAT) as tobacco cigarettes substitute: a prospective 12-month randomized control design study, 2013, 12 pages.
Caponnetto, et al., The emerging phenomenon of electronic cigarettes, Expert review of respiratory medicine, 2012, pp. 63-74.
Capponnetto, et al., Successful smoking cessation with cigarettes in smokers with a documented history of recurring relapses: a case series, Journal of Medical Case Reports, 2011, 6 pages, vol. 5, No. 1.
Cheng, Chemical evaluation of electronic cigarettes, Tobacco control, 2014, pp. ii11-ii17.
Cisternino, et al., Coexistence of Passive and Proton Antiporter-Mediated Processes in Nicotine Transport at the Mouse Blood-Brain Barrier, The AAPS Journal, Apr. 2013, vol. 15, No. 2.
Clayton, et al., Spectroscopic investigations into the acid-base properties of nicotine at different temperatures, Analytical Methods, 2013, pp. 81-88, vol. 5.
Dawkins, et al., Acute electronic cigarette use: nicotine delivery and subjective effects in regular users, Psychopharmacology, 2013, 9 pages.
Dawkins, et al., Nicotine derived from the electronic cigarette improves time-based prospective memory in abstinent smokers, Psychopharmacology, 2013, pp. 377-384.
Dawkins, et al., The electronic-cigarette: effects on desire to smoke, withdrawal symptoms and cognition, Addictive behaviors, 2012, pp. 970-973.
Dezelic, M., et al., Determination of structure of some salts of nicotine, pyridine and N-methylpyrrolidine on the basis of their infra-red spectra, Spectrochimica Acta, 1967, pp. 1149-1158.
Dixon, On the Transfer of Nicotine from Tobacco to the Smoker. A Brief Review of Ammonia and "pH" Factors, Contributions to Tobacco Research, Jul. 2000, pp. 103-113, vol. 19, No. 2.
Dong, et al., A Simple Technique for Determining the pH of Whole Cigarette Smoke, Contributions to Tobacco Research, Apr. 2000, pp. 33-48, vol. 19, No. 1.
Drummond, et al., Electronic cigarettes. Potential harms and benefits, Annals of the American Thoracic Society, 2014, pp. 236-242.
ECF; Any interest in determining nicotine—by DVAP, 2009, 8 pages, Retrieved from.
E-Cigarette Forum, pg-gv-peg (discussion/posting), Apr. 8, 2011, 7 pages. Retrieved from: https://e-cigarette-forum.com/forum/threads/pg-vg-peg.177551.
Effros, et al., The In Vivo pH of the Extravascular Space of the Lung, The Journal of Clinical Investigation, 1969, pp. 1983-1996, vol. 48.
Eissenberg, Electronic nicotine delivery devices: Ineffective nicotine delivery and craving suppression after acute administration, Tobacco Control, 2010, pp. 87-88.
Etter, et al., Analysis of refill liquids for electronic cigarettes, Addiction, 2013, pp. 1671-1679.
Etter, Levels of saliva cotinine in electronic cigarette users, Addiction, 2014, pp. 825-829.
Farsalinos, et al., Characteristics, perceived side effects and benefits of electronic cigarette use: a worldwide survey of more than 19,000 consumers, International Journal of Environmental Research and Public Health, 2014, pp. 4356-4373.
Farsalinos, et al., Electronic cigarettes do not damage the heart, European Society of Cardiology, Aug. 25, 2012, 4 pages. Retrieved from: (http://www.escardio.org/The-ESC/Press-Office/Press-releases/Electronic-cigarettes-do-not-damage-the-heart).
Farsalinos, et al., Evaluating nicotine levels selection and patterns of electronic cigarette use in a group of "vapers" who had achieved complete substitution of smoking, Substance Abuse: research and treatment, 2013, pp. 139-146.
Farsalinos, et al., Impact of flavor variability on electronic cigarette use experience: an internet survey, International journal of environmental research and public health, 2013, pp. 7272-7282.
Farsalinos, et al., Nicotine absorption from electronic cigarette use: comparison between first and new-generation devices, Scientific Reports, 2014. p. 4133.
Farsalinos, et al., Safety evaluation and risk assessment of electronic cigarettes as tobacco cigarette substitutes: a systematic review, Therapeutic Advances in Drug Safety 5.2, 2014, pp. 67-86.
Flouris et al., Acute impact of active and passive electronic cigarette smoking on serum cotinine and lung function, Inhalation Toxicology, Feb. 2013, pp. 91-101, vol. 25, No. 2.
Food & Drug Administration; Warning letter to The Compounding Pharmacy, Apr. 9, 2002, 3 pages, Retrieved from: http://www.fda.gov/ICECI/EnfocementActions/WarningLetters/2002/ucm144843.htm.
Fournier, Thermal Pathways for the Transfer of Amines, Including Nicotine, to the Gas Phase and Aerosols, Heterocycles, 2001, pp. 59-74, vol. 55, No. 1.
Gonda, et al., Smoking cessation approach via deep lung delivery of'clean' nicotine, RDD Europe, 2009, pp. 57-61.
Goniewicz et al., Nicotine levels in electronic cigarettes; Nicotine Tobacco Research, Jan. 2013, pp. 158-166, vol. 15, No. 1.
Goniewicz, et al., Nicotine content of electronic cigarettes, its release in vapour and its consistency across batches: regulatory implications, Addiction, 2014, pp. 500-507.
Grotenhermen et al., Developing science-based pers e limits for driving under the influence of cannabis (DUIC): findings and recommendations by an expert panel, Sep. 2005, 49 pages. Retrieved from: http://www.canormi.org/healthfacts/DUICreport.2005.pdf.
Harris, Warning cigarettes may be about to become fashionable again, Engineering & Technology 6.1, 2011, pp. 38-31.
Harvest Vapor, American Blend Tobacco (product info.), Oct. 2014, 2 pages. Retrieved from: (http://harvestvapor.com/).
Hatton et al., U.S. Appl. No. 15/396,584 entitled Leak-resistant vaporizer cartridges for use with cannabinoids, filed Dec. 31, 2016.
Henningfield, et al., Estimation of available nicotine content of six smokeless tobacco products, Tobacco Control, 1995, pp. 57-61, vol. 4.
Heyder, Alveolar deposition of inhaled particles in humans, American Industrial Hygiene Association Journal, 2010, pp. 864-866.
E-Cigarette Forum, Any interest in determining nicotine—by DVAP, 2009, 8 pages, Retrieved from: https://www.e-cigarette-forum.com/forum/threads/any-interest-in-determining-nicotine-bY-dvap.35922/.
E-Cigarette Forum, pg-gv-peg (discussion/posting), Apr. 8, 2011, 7 pages. Retrieved from: https://www.e-cigarette-forum.com/forum/threads/any-interest-in-determining-nicotine-bY-dvap.35922/.
Hurt, et al. Treating tobacco dependence in a medical setting, A Cancer Journal for Clinicians, Sep. 2009, pp. 314-326, vol. 59, No. 5.
Hurt, et al., Prying Open the Door to the Tobacco Industry's Secrets About Nicotine, The Journal of the American Medical Association, 1998, pp. 1173-1181.
Inchem, Benzoic Acid, JECFA Evaluation Summary, Mar. 2005, 2 pages. Retrieved from: http://www.inchem.org/documents/jecfa/feceval/jec_184.htm.
Inchem, Levulinic Acid, JECFA Evaluation Summary, Mar. 2003, 1 page, Retrieved from: .http://www.inchem.org/documents/jecfa/feceval/jec_1266.htm.
Inchem, Pyruvic Acid, JECFA Evaluation Summary, Jan. 2003, 1 page. Retrieved from: http://www.inchem.org/documents/jecfa/feceval/jec_2072.htm.
Inchem, Sorbic Acid, JECFA Evaluation Summary, May 2005, 1 page. Retrieved from: http://www.inchem.org/documents/jecfa/feceval/jec_2181 .htm.
Ingebrethsen, et al., Electronic cigarette aerosol particle size distribution measurements, Inhalation Toxicology, Dec. 2012, pp. 976-984, vol. 24, No. 14.
Keithly, et al., Industry research on the use and effects of levulinic acid: A case study in cigarette additives, Nicotine & Tobacco Research, 2005, pp. 761-771, vol. 7, No. 5.
Kosmider, et al. Electronic cigarette—a safe substitute for tobacco cigarette or a new threat?, Przeglad Tekarski, 2012, pp. 1084-1089 vol. 69, No. 10. [including English language translation thereof].

(56) References Cited

OTHER PUBLICATIONS

Kuo et al., Appendix D: Particle size—U.S. sieve size and tyler screen mesh equivalents, Applications of Turbulent and Multiphase Combustion, John Wiley & Sons, Inc. May 2012, pp. 541-543.
Lauterbach, A Critical Assessment of Recent Work on the Application of Gas/Particle Partitioning Theories to Cigarette Smoke, Contributions to Tobacco Research, Jul. 2000, pp. 65-83, vol. 19, No. 2.
Lauterbach, Comment on Gas/Particle Partitioning of Two Acid-Base Active Compounds in Mainstream Tobacco Smoke: Nicotine and Ammonia, J. Agric. Food Chem., 2010, pp. 9287-9288, vol. 58, No. 16.
Lauterbach, Comparison of Mainstream Cigarette Smoke pH With Mainstream E-Cigarette Aerosol Ph, Tob. Sci. Res. Conf., 2013, p. 78.
Lauterbach, Free-base nicotine in tobacco products. Part 1. Determination of free-base nicotine in the particulate phase of mainstream cigarette smoke and the relevance of these findings to product design parameters, Regulatory Toxicology and Pharmacology, 2010, 19 pages.
Lauterbach, GC-MS analysis of e-liquids taken from e-cigarettes and e-liquids (e-juice) before use in e-cigarettes, Presentation Slides CORESTA, 2013, 17 pages.
Lee, et al., Airway irritation and cough evoked by inhaled cigarette smoke: Role of neuronal nicotinic acetylcholine receptors, Pulmonary Pharmacology & Therapeutics, 2007, pp. 354-364, vol. 20.
Leffingwell, et al., Basic chemical constituents of tobacco: production, chemistry and Technology, Blackwell Science, 1999, pp. 265-284.
Leffingwell, et al., Tobacco Flavoring for Smoking Products, R.J. Reynolds Tobacco Company, 1972, 75 pages.
Lim, et al., Inhalation of e-cigarette cartridge solution aggravates allergen-induced airway inflammation and hyper-responsiveness in mice, Toxicological research, 2014, 18, vol. 30, No. 1.
Lippiello, et al., Enhancement of Nicotine Binding to Nicotinic Receptors by Nicotine Levulinate and Levulinic Acid, 1989, 27 pages.
Lux, et al., Generation of a submicrometre nicotine aerosol for inhalation, Med. & Biol. Eng. & Comput., 1988, pp. 232-234, vol. 26.
Lux, et al., Subjective Responses to Inhaled and Intravenous Injected Nicotine, American Society for Clinical Pharmacology and Therapeutics, 1988, p. 186.
MacDougall, et al., Selective Cardiovascular Effects of Stress and Cigarette Smoking, Journal of Human Stress, 1983, pp. 13-21, vol. 9, No. 3.
Maier, et al., Polypropylene: the definitive user's guide and databook, 1998, pp. 122-124.
McCann et al., Detection of carcinogens as mutagens in the salmonella/microsome test: Assay of 300 chemicals: Discussion, Proc. Nat. Acad. Sci., Mar. 1976, pp. 950-954, vol. 73, No. 3.
McQueen, et al., Interviews with "vapers": implications for future research with electronic cigarettes, Nicotine & Tobacco Research, 2011, pp. 860-867, vol. 13, No. 9.
McRobbie, et al., Electronic cigarettes for smoking cessation and reduction, Cochrane Database Syst., Rev 12, 2012, 61 pages.
Merriam-Webster Dictionary, Definition of "aerosol", Merriam-Webster Dictionary, [online], no date, retrieved from the Internet, [retrieved Jun. 8, 2017], <URL: https://www.merriam-webster.com/dictionary/aerosol>.
Mirriam-Webster Online Dictionary; Lighter, 2013, 2 pages. Retrieved from: http://www.merriam-webster.com/dictionary/lighter?show=0&t=1357320593.
Monsees et al., U.S. Appl. No. 15/257,748 entitled Cartridge for use with a vaporizer device, filed Sep. 6, 2016.
Monsees et al., U.S. Appl. No. 15/257,760 entitled Vaporizer apparatus, filed Sep. 6, 2016.
Monsees et al., U.S. Appl. No. 15/257,768 entitled Vaporizer apparatus, filed Sep. 6, 2016.
Monsees et al., U.S. Appl. No. 15/379,898 entitled Vaporization device systems and methods, filed Dec. 15, 2016.
Monsees et al., U.S. Appl. No. 15/368,539 entitled Low temperature electronic vaporization device and methods, filed Dec. 2, 2016.
Monsees, et al., U.S. Appl. No. 15/165,972 entitled Portable devices for generating an inhalable vapor, filed May 26, 2016.
Monsees, et al., U.S. Appl. No. 15/166,001 entitled Electronic vaporization device, filed May 26, 2016.
Monsees, et al.; U.S. Appl. No. 15/165,954 entitled Devices for vaporization of a substance, filed May 26, 2016.
Monsees, U.S. Appl. No. 12/115,400 entitled Method and System for Vaporization of a Substance, filed May 5, 2008.
Oldendorf, et al., Blood-brain barrier penetration abolished by N-methyl quaternization of nicotine, Proc. Natl. Acad. Sci, 1993, pp. 307-311, vol. 90.
Oldendorf, et al., pH Dependence of Blood-Brain Barrier Permeability to Lactate and Nicotine, Stroke, 1979, pp. 577-581, vol. 10, No. 5, 1979.
Omole, et al., Review of alternative practices to cigarette smoking and nicotine replacement therapy: how safe are they?, South African Family Practice, 2011, pp. 154-160, vol. 53, No. 2.
Pachke, et al., Effects of Ingredients on Cigarette Smoke Composition and Biological Activity: A Literature Overview, Contributions to Tobacco Research, Aug. 2002, pp. 107-247. vol. 20, No. 2.
Pankow, A consideration of the role of gas/particle partitioning in the deposition of nicotine and other tobacco smoke compounds in the respiratory tract, Chemical research in toxicology, 2001, pp. 1465-1481, vol. 14, No. 11.
Pankow, et al., Conversion of Nicotine in Tobacco Smoke to Its Volatile and Available Free-Base form Through the Action of Gaseous Ammonia, Envir. Sci. Technol., 1997, 13 pages, vol. 31, No. 8.
Perfetti, Investigation of Nicotine Transfer to Mainstream Smoke I, Synthesis of Nicotine Salts, 1978, 17 pages.
Perfetti, Structural study of nicotine salts, Beitrage zur Tabakforschung International, Contributions to Tobacco Research, Jun. 1983, pp. 43-54, vol. 12, No. 2.
Perfetti, The transfer of Nicotine form nicotine salts to mainstream smoke, 2000, 36 pages. https://www.industrydocumentslibrary.ucstedu/tobacco/docs/#id=rzwp0187.
Polosa, et al. Effectiveness and tolerability of electronic cigarette in real-life: a 24-month prospective observational study, Internal and Emergency Medicine, 2014, 10 pages, vol. 9, No. 5.
Polosa, et al., A fresh look at tobacco harm reduction: the case for the electronic cigarette, Harm Reduction Journal, 2013, 11 pages, vol. 10, No. 1.
Polosa, et al., Effect of an electronic nicotine delivery device (e-Cigarette) on smoking reduction and cessation: a prospective 6-month pilot study, 2011, 786.
Polosa, et al., Effect of smoking abstinence and reduction in asthmatic smokers switching to electronic cigarettes: evidence for harm reversal, International Journal of Environmental Research and Public Health, 2014, pp. 4965-4977, vol. 11, No. 5.
Prignot, Electronic Nicotine Delivery Systems (Electronic Cigarettes, Cigars, Pipes), Louvain Medical, Dec. 2013, pp. 695-703, vol. 132, No. 10. [including English language translation thereof].
Riggs, et al., The Thermal Stability of Nicotine Salts, R.J. Reynolds Tobacco Company, 2000, 15 pages.
RJ Reynolds Records, Nicotine Salts, Nov. 9, 1990, 6 pages. Retrieved from.
Rose, Nicotine and non-nicotine factors in cigarette addiction, Psychopharmacology, 2006, pp. 274-285, vol. 184.
Rose, Pulmonary Delivery of Nicotine Pyruvate: Sensory and Pharmacokinetic Characteristics, Experimental and Clinical Psychopharmacology, 2010, pp. 385-394, vol. 18, No. 5.
Sahu, et al., Particle Size Distribution of Mainstream and Exhaled Cigarette Smoke and Predictive Deposition in Human Reparatory Tract, Aerosol and Air Quality Research, 2013, pp. 324-332, vol. 13.
Scenihr, Addictiveness and Attractiveness of Tobacco Additives, Scientific Committee on Emerging and Newly Identified Health Risks, Nov. 12, 2010, 119 pages.
Schripp, et al., Does e-cigarette consumption cause passive vaping?, Indoor Air, 2013, pp. 25-31, vol. 23, No. 1.

(56) References Cited

OTHER PUBLICATIONS

Schroeder, et al., Electronic cigarettes and nicotine clinical pharmacology, Tobacco Control, 2014, pp. ii30-ii35.
Seeman, et al., On the Deposition of Volatiles and Semivolatiles from Cigarette Smoke Aerosols Relative Rates of Transfer of Nicotine and Ammonia from Particles to the Gas Phase, Chemical Research in Toxicology, 2004, pp. 1020-1037, vol. 17.
Seeman, et al., The form of nicotine in tobacco. Thermal transfer of nicotine and nicotine acid salts to nicotine in the gas phase, J Aric Food Chem., Dec. 1999, pp. 5133-5145, vol. 47, No. 12.
Seeman, et al., The possible role of ammonia toxicity on the exposure, deposition, retention, and the bioavailability of nicotine during smoking, Food and Chemical Toxicology, 2008, pp. 1863-1881, vol. 46.
Seeman, Possible Role of Ammonia on the Deposition, Retention, and Absorption of Nicotine in Humans while Smoking, Chemical Research in Toxicology, 2007, pp. 326-343, vol. 20, No. 3.
Seeman, Using "Basic Principles" to Understand Complex Science: Nicotine Smoke Chemistry and Literature Analogies, Journal of Chemical Education, 2005, pp. 1577-1583, vol. 82, No. 10.
Sensabaugh, et al., A New Technique for Determining the pH of Whole Tobacco Smoke, Tobacco Science, No Date, pp. 25-30.
Shahab, et al., Novel Delivery Systems for Nicotine Replacement Therapy as an Aid to Smoking Cessation and for Harm Reduction: Rationale, and Evidence for Advantages over Existing Systems, CNS Drugs, 2013, pp. 1007-1019, vol. 27.
Snowdon, Harm reduction and tobacco: a new opportunity or a step too far?, Drugs and Alcohol Today, 2013, pp. 86-91, vol. 13, No. 2.
Stepanov, et al., Bringing attention to e-cigarette pH as an important element for research and regulation, Tobacco Control, Jul. 2015, pp. 413-414, vol. 24, No. 4.
Stevenson, et al., The Secret and Soul of Marlboro, Public Health Then and Now, American Journal of Public Health, 2008, pp. 1184-1194, vol. 98, No. 7.
Teague, Implications and Activities Arising from Correlation of Smoke pH with Nicotine Impact, Other Smoke Qualities and Cigarette Sales, 1983, 22 pages.
Tomar, et al., Review of the evidence that pH is a determinant of nicotine dosage from oral use of smokeless tobacco, Tobacco Control, 1997, pp. 219-225, vol. 6.
Torikai, et al., Effects of temperature, atmosphere and pH on the generation of smoke compounds during tobacco pyrolysis, Food and Chemical Toxicology, Sep. 2004, pp. 1409-1417, vol. 42, No. 9.
Torrie, Nicotine inhaler gives instant 'hit', 2013, 2 pages. Retrieved from: http://www.stuff.co.nz/national/health/8822875/Nicotine-inhaler-gives-instant-hit.
Travell, The Influence of the Hydrogen Ion Concentration on the Absorption of Alkaloids from the Stomach, The Journal of Pharmacology, Jan. 1940, pp. 21-33.
Trehy, et al., Analysis of electronic cigarette cartridges, refill solutions, and smoke for nicotine and nicotine related impurities, Journal of Liquid Chromatography & Related Technologies, 2011, pp. 1442-1458, vol. 34, No. 14.
Uchiyama, et al., Determination of carbonyl compounds generated from the E-cigarette using coupled silica cartridges impregnated with hydroquinone and 2, 4-dinitrophenylhydrazine, followed by high-performance liquid chromatography, Analytical sciences, 2013, pp. 1219-1222, vol. 29, No. 12.
Unknown Author, A Randomized Placebo-Controlled Trial of a Nicotine Inhaler and Nicotine Patches for Smoking cessation, 5 pages.
Unknown Author, Cigbuyer.com, Inside E-Cigarette Liquids and Vapor, Oct. 4, 2013, 7 pages.
US Surgeon General, How Tobacco Smoke Causes Disease: The Biology and Behavioral Basis for Smoking-Attributable Disease: A Report of the Surgeon General, U.S. Department of Health and Human Services, 2010.
Vansickel, et al., A clinical laboratory model for evaluating the acute effects of electronic cigarettes Nicotine delivery profile and cardiovascular and subjective effects, Cancer Epidemiology Biomarkers Prevention, Jul. 2010, pp. 1945-1953, vol. 19, No. 8.
Vansickel, et al., Electronic cigarettes: effective nicotine delivery after acute administration, Nicotine & Tobacco Research, Jan. 2013, pp. 267-270, vol. 15, No. 1.
Ward, Green leaf threshing and redrying tobacco, Section 10B, in Tobacco Production, Chemistry and Technology, Jul. 1999, pp. 330-333.
Wayne, et al., Brand differences of free-base nicotine delivery in cigarette smoke: the view of the tobacco industry documents, Tobacco Control, 2006, pp. 189-198, vol. 15.
Weiss, The Effect of pH on Nicotine-Induced Contracture and Ca45 Movements in Frog Sartorius Muscle, The Journal of Pharmacology and Experimental Therapeutics, 1966, pp. 605-612, vol. 154, No. 3.
Wells, Glycerin as a constituent of cosmetics and toilet preparations, Journal of the Society of Cosmetic Chemists, Jan. 1958, pp. 19-25, vol. 9, No. 1.
World Health Organization, Health Effects of Interactions Between Tobacco Use and Exposure to Other Agents, Environmental Health Criteria 211, 1999, 83 pages. Retrieved from: http://www.inchem.org/documents/ehc/ehc/ehc211.htm.
Wynn, et al., The pharmacist "toolbox" for smoking cessation: a review of methods, medicines, and novel means to help patients along the path of smoking reduction to smoking cessation, Journal of Pharmacy Practice, 2012, pp. 591-599, vol. 25, No. 6.
Youtube, Firefly Vaporizor Review w/ Usage Tips by The Vape Critic, Feb. 2015, 1 page. (http://www.youtube.com/watch?v=1J38NOAV7w1).
Zenzen, et al., Reduced exposure evaluation of an Electrically Heated Cigarette Smoking System. Part 2: Smoke chemistry and in vitro toxicological evaluation using smoking regimens reflecting human puffing behavior, Regulatory Toxicology and Pharmacology, 2012, pp. S11-S34, vol. 64, No. 2.
Zhang, et al. In vitro particle size distributions in electronic and conventional cigarette aerosols suggest comparable deposition patterns, Nicotine Tobacco Research, Feb. 2013, pp. 501-508, vol. 15, No. 2.
Burn and Rand, Action of Nicotine on the Heart, British Medical Journal, pp. 137-139 (Jan. 18, 1958).
Notice of Opposition to European Patent No. 2 993 999 B1 by JT International S.A., 38 pages (Oct. 26, 2021).
Notice of Opposition to European Patent No. 2 993 999 B1 by Nicoventures Trading Limited, 26 pages (Oct. 26, 2021).
Notice of Opposition to European Patent No. 2 993 999 B1 by Philip Morris Products S.A., 22 pages (Oct. 27, 2021).
Preliminary Opinion of the Opposition Division to the Oppositions in European Patent No. 2 993 999 B1, 17 pages (Aug. 30, 2022).
U.S. Appl. No. 17/171,976, filed Feb. 9, 2021.

* cited by examiner

NICOTINE LIQUID FORMULATIONS FOR AEROSOL DEVICES AND METHODS THEREOF

CROSS REFERENCE

This application is a continuation of U.S. application Ser. No. 16/585,382 filed Sep. 27, 2019, issued as U.S. Pat. No. 11,510,433, which is a continuation of U.S. application Ser. No. 15/101,303 filed Jun. 2, 2016, issued as U.S. Pat. No. 10,463,069, which is a Section 371 US national phase of International Application No. PCT/US2014/64690 filed Nov. 7, 2014, which claims the benefit of U.S. Provisional Application Ser. No. 61/912,507, filed Dec. 5, 2013, which is incorporated herein by reference in its entirety.

SUMMARY OF THE INVENTION

In some aspects, provided herein is a method of generating an inhalable aerosol comprising nicotine for delivery to a user comprising using low temperature electronic vaporization device, i.e. an electronic cigarette, comprising a nicotine liquid formulation and a heater, wherein the nicotine liquid formulation comprises said nicotine, an acid, and a biologically acceptable liquid carrier, wherein using the electronic cigarette comprises: providing an amount of said nicotine liquid formulation to said heater; said heater forming an aerosol by heating said amount of said nicotine liquid formulation, wherein at least about 50% of said acid in said amount is in said aerosol, and wherein at least about 90% of said nicotine in said amount is in said aerosol.

In some embodiments, said amount comprises about 4 μL of said nicotine liquid formulation. In some embodiments, said amount comprises about 4.5 mg of said nicotine liquid formulation. In some embodiments, a concentration of said nicotine is from about 0.5% (w/w) to about 20% (w/w). In some embodiments, a molar ratio of said acid to said nicotine is from about 0.25:1 to about 4:1. In some embodiments, said acid comprises one or more acidic functional groups, and wherein a molar ratio of said acidic functional groups to said nicotine is from about 0.25:1 to about 4:1. In some embodiments, said acid and said nicotine form a nicotine salt. In some embodiments, said nicotine is stabilized in said nicotine salt in said inhalable aerosol. In some embodiments of the methods described herein, said inhalable aerosol comprises one or more of said nicotine, said acid, said carrier, and said nicotine salt. In some embodiments of the methods described herein, one or more particles of said inhalable aerosol are sized for delivery to alveoli in a lung of said user. In some embodiments of the methods described herein, said acid is selected from the group consisting of: benzoic acid, pyruvic acid, salicylic acid, levulinic acid, succinic acid, and citric acid. In some embodiments of the methods described herein, said acid is selected from the group consisting of: benzoic acid, pyruvic acid, and salicylic acid. In some embodiments of the methods described herein, said acid is benzoic acid. In some embodiments of the methods described herein, said concentration is from about 2% (w/w) to about 6% (w/w). In some embodiments of the methods described herein, said concentration is about 5% (w/w). In some embodiments of the methods described herein, said biologically acceptable liquid carrier comprises from about 20% to about 50% of propylene glycol and from about 80% to about 50% of vegetable glycerin. In some embodiments of the methods described herein, said biologically acceptable liquid carrier comprises about 30% propylene glycol and about 70% vegetable glycerin. In some embodiments of the methods described herein, said heater heats said amount of said nicotine liquid formulation from about 150° C. to about 250° C. In some embodiments of the methods described herein, said heater heats said amount of said nicotine liquid formulation from about 180° C. to about 220° C. In some embodiments of the methods described herein, said heater heats said amount of said nicotine liquid formulation to about 200° C. In some embodiments of the methods described herein, said nicotine liquid formulation further comprises an additional acid selected from said group consisting of: benzoic acid, pyruvic acid, salicylic acid, levulinic acid, malic acid, succinic acid, and citric acid. In some embodiments of the methods described herein, said additional acid forms an additional nicotine salt. In some embodiments of the methods described herein, at least about 60% a to about 90% of said acid in said amount is in said aerosol. In some embodiments of the methods described herein, at least about 70% to about 90% of said acid in said amount is in said aerosol. In some embodiments of the methods described herein, at least about 80% to about 90% of said acid in said amount is in said aerosol. In some embodiments of the methods described herein, more than about 90% of said acid in said amount is in said aerosol.

In some aspects, provided herein is a method of generating an inhalable aerosol comprising nicotine for delivery to a user comprising using low temperature electronic vaporization device, i.e. an electronic cigarette, comprising a nicotine liquid formulation and a heater, wherein the nicotine liquid formulation comprises: said nicotine at a concentration from about 0.5% (w/w) to about 20% (w/w); an acid at a molar ratio of said acid to said nicotine from about 0.25:1 to about 4:1; and a biologically acceptable liquid carrier; wherein using the electronic cigarette comprises: providing an amount of said nicotine liquid formulation to said heater; said heater forming an aerosol by heating said amount of said nicotine liquid formulation, wherein at least about 50% of said acid in said amount is in said aerosol, and wherein at least about 90% of said nicotine in said amount is in said aerosol.

In some aspects, provided herein is a method of generating an inhalable aerosol comprising nicotine for delivery to a user comprising using low temperature electronic vaporization device, i.e. an electronic cigarette, comprising a nicotine liquid formulation and a heater, wherein the nicotine liquid formulation comprises: nicotine at a concentration from about 2% (w/w) to about 6% (w/w); an acid at a molar ratio of said acid to said nicotine from about 1:1 to about 4:1; and a biologically acceptable liquid carrier; wherein using the electronic cigarette comprises: providing an amount of said nicotine liquid formulation to a heater, the heater forming an aerosol by heating said amount of said nicotine liquid formulation, wherein at least about 50% of said acid in said amount is in said aerosol, and wherein at least about 90% of said nicotine in said amount is in said aerosol.

In some aspects, provided herein is a method of generating an inhalable aerosol comprising nicotine for delivery to a user comprising using low temperature electronic vaporization device, i.e. an electronic cigarette, comprising a nicotine liquid formulation and a heater, wherein the nicotine liquid formulation comprises: nicotine at a concentration from about 2% (w/w) to about 6% (w/w); an acid at a molar ratio of said acid to said nicotine from about 1:1 to about 4:1; and a biologically acceptable liquid carrier; wherein using the electronic cigarette comprises: providing an amount of said nicotine liquid formulation to a heater; the heater forming an aerosol by heating said amount of said nicotine liquid formulation, wherein at least about 90% of said acid in said amount is in said aerosol, and wherein at least about 90% of said nicotine in said amount is in said aerosol.

In some aspects, provided herein is a method of generating an inhalable aerosol comprising nicotine for delivery to a user comprising using low temperature electronic vaporization device, i.e. an electronic cigarette, comprising a nicotine liquid formulation and a heater, wherein the nicotine liquid formulation comprises: nicotine at a concentration from about 2% (w/w) to about 6% (w/w); benzoic acid at a molar ratio of said benzoic acid to said nicotine of about 1:1; and a biologically acceptable liquid carrier; wherein using the electronic cigarette comprises: providing an amount of said nicotine liquid formulation to a heater; the heater forming an aerosol by heating said amount of said nicotine liquid formulation, wherein at least about 90% of said benzoic acid in said amount is in said aerosol, and wherein at least about 90% of said nicotine in said amount is in said aerosol.

In some aspects, provided herein is a cartridge for use with low temperature electronic vaporization device, i.e. an electronic cigarette, said cartridge comprising a fluid compartment configured to be in fluid communication with a heating element, said fluid compartment comprising a nicotine formulation comprising said nicotine, an acid, and a biologically acceptable liquid carrier, wherein using said electronic cigarette comprises: providing an amount of said nicotine liquid formulation to said heater; said heater forming an aerosol by heating said amount of said nicotine liquid formulation, wherein at least about 50% of said acid in said amount is in said aerosol, and wherein at least about 90% of said nicotine in said amount is in said aerosol.

In some embodiments of the cartridges described herein, said amount comprises about 4 μL of said nicotine liquid formulation. In some embodiments of the cartridges described herein, said amount comprises about 4.5 mg of said nicotine liquid formulation. In some embodiments of the cartridges described herein, a concentration of said nicotine is from about 0.5% (w/w) to about 20% (w/w). In some embodiments of the cartridges described herein, a molar ratio of said acid to said nicotine is from about 0.25:1 to about 4:1. In some embodiments of the cartridges described herein, said acid comprises one or more acidic functional groups, and wherein a molar ratio of said acidic functional groups to said nicotine is from about 0.25:1 to about 4:1. In some embodiments of the cartridges described herein, said acid and said nicotine form a nicotine salt. In some embodiments of the cartridges described herein, said nicotine is stabilized in said nicotine salt in said inhalable aerosol. In some embodiments of the cartridges described herein, said inhalable aerosol comprises one or more of said nicotine, said acid, said carrier, and said nicotine salt. In some embodiments of the cartridges described herein, one or more particles of said inhalable aerosol are sized for delivery to alveoli in a lung of said user. In some embodiments of the cartridges described herein, said acid is selected from the group consisting of: benzoic acid, pyruvic acid, salicylic acid, levulinic acid, succinic acid, and citric acid. In some embodiments of the cartridges described herein, said acid is selected from the group consisting of: benzoic acid, pyruvic acid, and salicylic acid. In some embodiments of the cartridges described herein, said acid is benzoic acid. In some embodiments of the cartridges described herein, said concentration is from about 2% (w/w) to about 6% (w/w). In some embodiments of the cartridges described herein, said concentration is about 5% (w/w). In some embodiments of the cartridges described herein, said biologically acceptable liquid carrier comprises from about 20% to about 50% of propylene glycol and from about 80% to about 50% of vegetable glycerin. In some embodiments of the cartridges described herein, said biologically acceptable liquid carrier comprises about 30% propylene glycol and about 70% vegetable glycerin. In some embodiments of the cartridges described herein, said heater heats said amount of said nicotine liquid formulation from about 150° C. to about 250° C. In some embodiments of the cartridges described herein, said heater heats said amount of said nicotine liquid formulation from about 180° C. to about 220° C. In some embodiments of the cartridges described herein, said heater heats said amount of said nicotine liquid formulation to about 200° C. In some embodiments of the cartridges described herein, said nicotine liquid formulation further comprises an additional acid selected from said group consisting of: benzoic acid, pyruvic acid, salicylic acid, levulinic acid, malic acid, succinic acid, and citric acid. In some embodiments of the cartridges described herein, said additional acid forms an additional nicotine salt. In some embodiments of the cartridges described herein, at least about 60% to about 90% of said acid in said amount is in said aerosol. In some embodiments of the cartridges described herein, at least about 70% to about 90% of said acid in said amount is in said aerosol. In some embodiments of the cartridges described herein, at least about 80% to about 90% of said acid in said amount is in said aerosol. In some embodiments of the cartridges described herein, more than about 90% of said acid in said amount is in said aerosol.

In some aspects, provided here is a cartridge for use with low temperature electronic vaporization device, i.e. an electronic cigarette, said cartridge comprising a fluid compartment configured to be in fluid communication with a heating element, said fluid compartment comprising a nicotine formulation comprising: said nicotine at a concentration from about 0.5% (w/w) to about 20% (w/w); an acid at a molar ratio of said acid to said nicotine from about 0.25:1 to about 4:1; and a biologically acceptable liquid carrier; wherein using said electronic cigarette comprises: providing an amount of said nicotine liquid formulation to said heater; said heater forming an aerosol by heating said amount of said nicotine liquid formulation, wherein at least about 50% of said acid in said amount is in said aerosol, and wherein at least about 90% of said nicotine in said amount is in said aerosol.

In some aspects, provided here is a cartridge for use with low temperature electronic vaporization device, i.e. an electronic cigarette, said cartridge comprising a fluid compartment configured to be in fluid communication with a heating element, said fluid compartment comprising a nicotine formulation comprising: said nicotine at a concentration from about 2% (w/w) to about 6% (w/w); an acid at a molar ratio of said acid to said nicotine from about 1:1 to about 4:1; and a biologically acceptable liquid carrier wherein using said electronic cigarette comprises: providing an amount of said nicotine liquid formulation to said heater; said heater forming an aerosol by heating said amount of said nicotine liquid formulation, wherein at least about 50% of said acid in said amount is in said aerosol, and wherein at least about 90% of said nicotine in said amount is in said aerosol.

In some aspects, provided here is a cartridge for use with low temperature electronic vaporization device, i.e. an electronic cigarette, said cartridge comprising a fluid compartment configured to be in fluid communication with a heating element, said fluid compartment comprising a nicotine formulation comprising: said nicotine at a concentration from about 2% (w/w) to about 6% (w/w); an acid at a molar ratio of said acid to said nicotine from about 1:1 to about 4:1; and a biologically acceptable liquid carrier; wherein using said electronic cigarette comprises: providing an amount of said nicotine liquid formulation to said heater; said heater forming an aerosol by heating said amount of said nicotine liquid formulation, wherein at least about 90% of said acid in said amount is in said aerosol, and wherein at least about 90% of said nicotine in said amount is in said aerosol.

In some aspects, provided here is a cartridge for use with low temperature electronic vaporization device, i.e. an electronic cigarette, said cartridge comprising a fluid compartment configured to be in fluid communication with a heating element, said fluid compartment comprising a nicotine formulation comprising: said nicotine at a concentration from about 2% (w/w) to about 6% (w/w); benzoic acid at a molar ratio of said benzoic acid to said nicotine of about 1:1; and a biologically acceptable liquid carrier; wherein using the electronic cigarette comprises: providing an amount of said nicotine liquid formulation to a heater; said heater forming an aerosol by heating said amount of said nicotine liquid formulation, wherein at least about 90% of said benzoic acid in said amount is in said aerosol, and wherein at least about 90% of said nicotine in said amount is in said aerosol.

In some aspects, provided here is a formulation for use in low temperature electronic vaporization device, i.e. an electronic cigarette, comprising a heater, the formulation comprising nicotine, an acid, and a biologically acceptable liquid carrier, wherein using the electronic cigarette comprises: providing an amount of said nicotine liquid formulation to said heater; said heater forming an aerosol by heating said amount of said nicotine liquid formulation, wherein at least about 50% of said acid in said amount is in said aerosol, and wherein at least about 90% of said nicotine in said amount is in said aerosol.

In some embodiments of the formulations described herein, said amount comprises about 4 μL of said nicotine liquid formulation. In some embodiments of the formulations described herein, wherein said amount comprises about 4.5 mg of said nicotine liquid formulation. In some embodiments of the formulations described herein, a concentration of said nicotine is from about 0.5% (w/w) to about 20% (w/w). In some embodiments of the formulations described herein, a molar ratio of said acid to said nicotine is from about 0.25:1 to about 4:1. In some embodiments of the formulations described herein, said acid comprises one or more acidic functional groups, and wherein a molar ratio of said acidic functional groups to said nicotine is from about 0.25:1 to about 4:1. In some embodiments of the formulations described herein, said acid and said nicotine form a nicotine salt. In some embodiments of the formulations described herein, wherein said nicotine is stabilized in said nicotine salt in said inhalable aerosol. In some embodiments of the formulations described herein, said inhalable aerosol comprises one or more of said nicotine, said acid, said carrier, and said nicotine salt. In some embodiments of the formulations described herein, one or more particles of said inhalable aerosol are sized for delivery to alveoli in a lung of said user. In some embodiments of the formulations described herein, said acid is selected from the group consisting of: benzoic acid, pyruvic acid, salicylic acid, levulinic acid, succinic acid, and citric acid. In some embodiments of the formulations described herein, said acid is selected from the group consisting of: benzoic acid, pyruvic acid, and salicylic acid. In some embodiments of the formulations described herein, said acid is benzoic acid. In some embodiments of the formulations described herein, said concentration is from about 2% (w/w) to about 6% (w/w). In some embodiments of the formulations described herein, said concentration is about 5% (w/w). In some embodiments of the formulations described herein, said biologically acceptable liquid carrier comprises from about 20% to about 50% of propylene glycol and from about 80% to about 50% of vegetable glycerin. In some embodiments of the formulations described herein, said biologically acceptable liquid carrier comprises about 30% propylene glycol and about 70% vegetable glycerin. In some embodiments of the formulations described herein, said heater heats said amount of said nicotine liquid formulation from about 150° C. to about 250° C. In some embodiments of the formulations described herein, said heater heats said amount of said nicotine liquid formulation from about 180° C. to about 220° C. In some embodiments of the formulations described herein, said heater heats said amount of said nicotine liquid formulation to about 200° C. In some embodiments of the formulations described herein, said nicotine liquid formulation further comprises an additional acid selected from said group consisting of: benzoic acid, pyruvic acid, salicylic acid, levulinic acid, malic acid, succinic acid, and citric acid. In some embodiments of the formulations described herein, said additional acid forms an additional nicotine salt. In some embodiments of the formulations described herein, at least about 60% to about 90% of said acid in said amount is in said aerosol. In some embodiments of the formulations described herein, at least about 70% to about 90% of said acid in said amount is in said aerosol. In some embodiments of the formulations described herein, at least about 80% to about 90% of said acid in said amount is in said aerosol. In some embodiments, wherein more than about 90% of said acid in said amount is in said aerosol.

In some aspects, provided herein is a formulation for use in low temperature electronic vaporization device, i.e. an electronic cigarette, comprising a heater, the formulation comprising: said nicotine at a concentration from about 0.5% (w/w) to about 20% (w/w); an acid at a molar ratio of said acid to said nicotine from about 0.25:1 to about 4:1; and a biologically acceptable liquid carrier, wherein using the electronic cigarette comprises: providing an amount of said nicotine liquid formulation to said heater, and said heater forming an aerosol by heating said amount of said nicotine liquid formulation, wherein at least about 50% of said acid in said amount is in said aerosol, and wherein at least about 90% of said nicotine in said amount is in said aerosol.

In some aspects, provided herein is a formulation for use in low temperature electronic vaporization device, i.e. an electronic cigarette, comprising a heater, the formulation comprising: nicotine at a concentration from about 2% (w/w) to about 6% (w/w); an acid at a molar ratio of said acid to said nicotine from about 1:1 to about 4:1; and a biologically acceptable liquid carrier; wherein using the electronic cigarette comprises: providing an amount of said nicotine liquid formulation to said heater; and said heater forming an aerosol by heating said amount of said nicotine liquid formulation, wherein at least about 50% of said acid in said amount is in said aerosol, and wherein at least about 90% of said nicotine in said amount is in said aerosol.

In some aspects, provided herein is a formulation for use in low temperature electronic vaporization device, i.e. an electronic cigarette, comprising a heater, the formulation comprising: nicotine at a concentration from about 2% (w/w) to about 6% (w/w); an acid at a molar ratio of said acid to said nicotine from about 1:1 to about 4:1; and a biologically acceptable liquid carrier wherein using the electronic cigarette comprises: providing an amount of said nicotine liquid formulation to said heater; and said heater forming an aerosol by heating said amount of said nicotine liquid formulation, wherein at least about 90% of said acid in said amount is in said aerosol, and wherein at least about 90% of said nicotine in said amount is in said aerosol.

In some aspects, provided herein is a formulation for use in low temperature electronic vaporization device, i.e. an electronic cigarette, comprising a heater, the formulation comprising: nicotine at a concentration from about 2% (w/w) to about 6% (w/w); benzoic acid at a molar ratio of said benzoic acid to said nicotine of about 1:1; and a biologically acceptable liquid carrier; wherein using the electronic cigarette comprises: providing an amount of said nicotine liquid formulation to said heater; and said heater forming an aerosol by heating said amount of said nicotine liquid formulation, wherein at least about 90% of said acid in said amount is in said aerosol, and wherein at least about 90% of said nicotine in said amount is in said aerosol.

INCORPORATION BY REFERENCE

All publications, patents and patent applications mentioned in this specification are herein incorporated by reference to the same extent as if each individual publication, patent or patent application was specifically and individually indicated to be incorporated by reference.

BRIEF DESCRIPTION OF THE DRAWINGS

A better understanding of the features and advantages of the present invention will be obtained by reference to the following detailed description that sets forth illustrative embodiments, in which the principles of the invention are used, and the accompanying drawings of which.

DETAILED DESCRIPTION OF THE INVENTION

Figure 1:
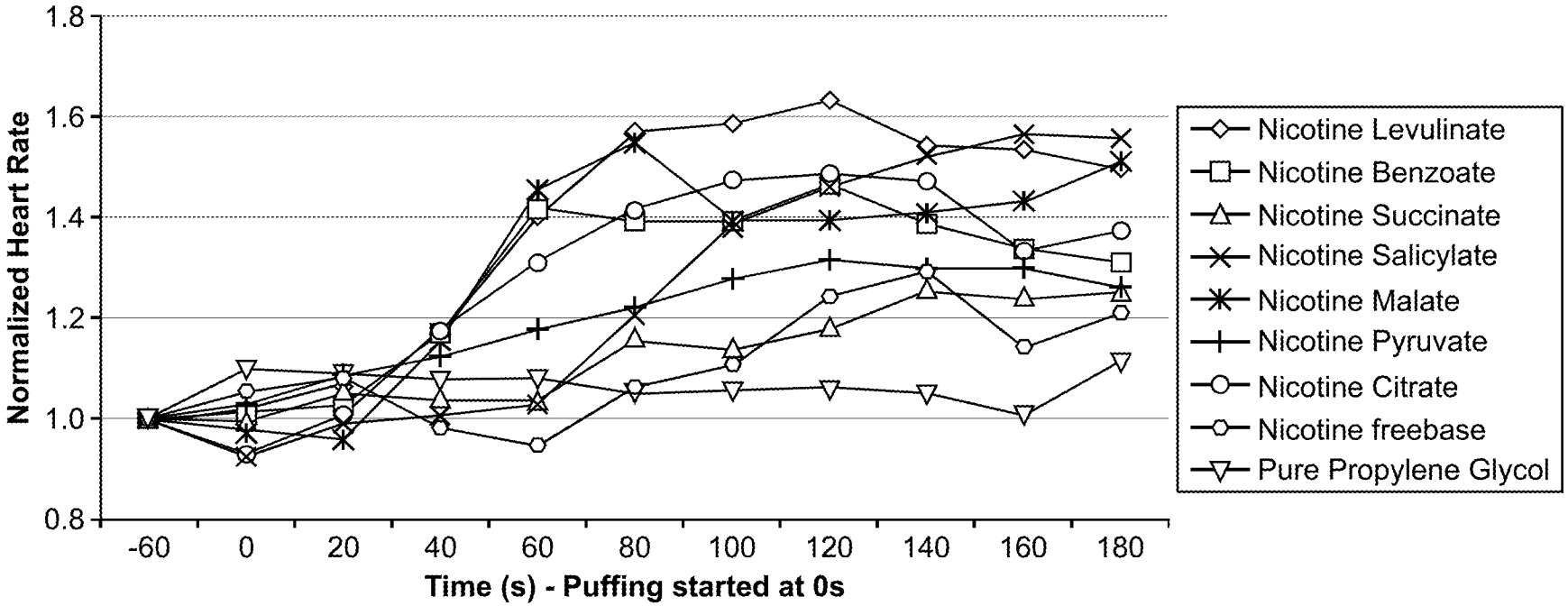
FIG. 1 illustrates a non-limiting example of results of heart rate data measured for six minutes from start of puffing. Y-axis is heart rate (bpm) and X-axis represent duration of the test (−60 to 180 seconds)

Nicotine is a chemical stimulant and increases heart rate and blood pressure when provided to an individual or animal. Nicotine transfer to an individual is associated with a feeling of physical and/or emotional satisfaction. Conflicting reports have been published regarding the transfer efficiency of free base nicotine in comparison to mono- or di-protonated nicotine salts. Studies on the transfer efficiency of free base nicotine and nicotine salts are complex and have yielded unpredictable results. Further, such transfer efficiency studies have been performed wider extremely high temperature conditions, comparable to smoking; therefore, they offer scant guidance on the transfer efficiency of free base nicotine and nicotine salts under low-temperature vaporization conditions, for example low temperature vaporization device, i.e. an electronic cigarette, conditions. Some reports have posited that nicotine free base should give rise to a greater satisfaction in a user than any corresponding nicotine salt.

It has been unexpectedly discovered herein that certain nicotine liquid formulations provide satisfaction in an individual superior to that of free base nicotine, and more comparable to the satisfaction in an individual smoking a traditional cigarette. The satisfaction effect is consistent with an efficient transfer of nicotine to the lungs, for example the alveoli of the lungs, of an individual and a rapid rise of nicotine absorption in the plasma as shown, in a non-limiting example, in Examples 8, 13 and 14, at least. It has also been unexpectedly discovered herein that certain nicotine liquid formulations provide greater satisfaction than other nicotine liquid formulations. Such effect has been shown in blood plasma levels of example nicotine liquid formulations herein, as a non-limiting example, in Examples 3 and 8, at least. These results demonstrate a rate of nicotine uptake in the blood is higher for nicotine liquid formulations, for example nicotine salt liquid formulations, than nicotine freebase formulations. Moreover, the studies depicted herein, demonstrate that the transfer efficiency of a nicotine liquid formulation, for example a nicotine salt, is dependent on the acid used in the formulation. As demonstrated in, at least, the non-limiting Example 13, certain acids used in the nicotine liquid formulation result in better transfer from the liquid formulation to the vapor and/or the aerosol. Therefore, described herein are nicotine liquid formulations, for example a nicotine salt liquid formulation, for use in low temperature electronic vaporization device, i.e. an electronic cigarette, or the like, that provide a general satisfaction effect consistent with an efficient transfer of nicotine to the lungs of an individual and a rapid rise of nicotine absorption in the plasma. Provided herein, therefore, are devices, nicotine liquid formulations comprising one or more nicotine salts, systems, cartomizers, kits and methods that are used to inhale an aerosol generated from a nicotine salt liquid formulation in a low temperature vaporization device, i.e. low temperature electronic vaporization device, i.e. an electronic cigarette, through the mouth or nose as described herein or as would be obvious to one of skill in the art upon reading the disclosure herein.

Consistent with these satisfaction effects, it has unexpectedly been found herein that there is a difference between the $C_{max}$ (maximum concentration) and $T_{max}$ (time at which the maximum concentration is measured) when measuring blood plasma nicotine levels of freebase nicotine liquid formulations inhaled using a low temperature vaporization device, i.e. electronic cigarette, as compared to the $C_{max}$ and $T_{max}$ (similarly measuring blood plasma nicotine levels) of a traditional cigarette. Also consistent with these satisfaction effects, it has unexpectedly been found herein that there is a difference between the $C_{max}$ and $T_{max}$ when measuring blood plasma nicotine levels of freebase nicotine liquid formulations inhaled using a low temperature vaporization device, i.e. electronic cigarette, as compared to the $C_{max}$ and $T_{max}$ (similarly measuring blood plasma nicotine levels) of nicotine liquid formulations, for example nicotine salt liquid formulations, inhaled using a low temperature vaporization device, i.e. electronic cigarette. Additionally, it has unexpectedly been found that there is a difference between the rate of nicotine uptake in the plasma of users inhaling freebase nicotine liquid formulations using a low temperature vaporization device, i.e. electronic cigarette, as compared to the rate of nicotine uptake in the plasma of users inhaling smoke of a traditional cigarette. Furthermore, it has unexpectedly been found that there is a difference between the rate of nicotine uptake in the plasma of users inhaling freebase nicotine liquid formulations using a low temperature vaporization device, i.e. electronic cigarette, as compared to the rate of nicotine uptake in the plasma of users inhaling nicotine liquid formulations, for example a nicotine salt liquid formulations, using a low temperature vaporization device, i.e. electronic cigarette.

In some embodiments, inhalation of a vapor and/or an aerosol generated using a freebase nicotine composition in a low temperature vaporization device, i.e. an electronic cigarette, is not necessarily comparable in blood plasma levels ($C_{max}$ and $T_{max}$) to a traditional cigarette's nicotine delivery to blood when inhaled. Further, inhalation of a vapor and/or an aerosol generated using a freebase nicotine composition in a low temperature vaporization device, i.e. an electronic cigarette, is not necessarily comparable in blood plasma levels ($C_{max}$ and $T_{max}$) to inhalation of a vapor and/or an aerosol comprising nicotine generated from a nicotine liquid formulation, for example a nicotine salt liquid formulation. Further, inhalation of a vapor and/or an aerosol generated using a freebase nicotine composition in a low temperature vaporization device, i.e. an electronic cigarette, is not necessarily comparable in blood plasma levels when measuring the rate of nicotine uptake in the blood within the first 0-8 minutes to a traditional cigarette's nicotine delivery to blood when inhaled. Further, inhalation of a vapor and/or an aerosol generated using a freebase nicotine composition in a low temperature vaporization device, i.e. an electronic cigarette, is not necessarily comparable in blood plasma levels when measuring the rate of nicotine uptake in the blood within the first 0-8 minutes to inhalation of a vapor and/or an aerosol comprising nicotine generated from a nicotine liquid formulation, for example a nicotine salt liquid formulation.

Consistent with the observed differences in nicotine blood plasma levels when using freebase nicotine as a source of nicotine in a low temperature vaporization device, i.e. an electronic cigarette, in comparison to a nicotine liquid formulation, for example a nicotine salt liquid formulation, the transfer efficiency of the nicotine liquid formulation delivers more nicotine from the liquid formulation to the vapor and/or to the aerosol. As demonstrated, in a non-limiting Example 13 freebase nicotine as a source of nicotine in low temperature electronic vaporization device, i.e. an electronic cigarette, results in less nicotine present in an aerosol as compared to using a nicotine liquid formulation, for example a nicotine salt liquid formulation, as a source of nicotine in low temperature electronic vaporization device, i.e. an electronic cigarette. Further, this is consistent with the observed differences in nicotine blood plasma levels when using freebase nicotine as a source of nicotine in a low temperature vaporization device, i.e. an electronic cigarette, compared to using a nicotine liquid formulation, for example a nicotine salt liquid formulation, wherein the higher transfer efficiency of the nicotine liquid formulation from the liquid to the vapor and/or the aerosol results in a higher rate of nicotine uptake in the blood. One explanation for this observation is that the aerosol comprising nicotine, for example liquid droplets of the aerosol, is more readily delivered to the user's lungs and/or alveoli therein resulting in more efficient uptake into the user's bloodstream. Moreover, the aerosol is delivered in particles sized to be delivered through the oral or nasal cavity and to a user's lungs, for example the alveoli of a user's lungs.

Compared to vaporized nicotine, aerosolized nicotine is more likely to travel to a user's lungs and be absorbed in alveoli. One reason that aerosolized nicotine has a greater chance of being absorbed in the lungs compared to vaporized nicotine is, for example, vaporized nicotine has a greater chance of being absorbed in mouth tissues and upper respiratory tract tissues of the user. Moreover, it is likely nicotine will absorb at a slower rate in the mouth and upper respiratory tract compared to nicotine absorbed in the lung tissue thus resulting in a less satisfying effect for a user. As shown in non-limiting Examples 8 and 13, at least, using a low temperature electronic vaporization device, i.e. an electronic cigarette, to deliver nicotine to a user, there is a direct correlation between the time to max concentration of nicotine in blood ($T_{max}$) to the amount of aerosolized nicotine delivered to aerosol. For example, using a freebase nicotine liquid formulation results in a significant decrease in the amount of aerosolized nicotine compared to nicotine benzoate (1:1 nicotine:benzoic acid molar ratio) and nicotine malate (1:2 nicotine:malate molar ratio). Further, as shown in a non-limiting Example 8, the $T_{max}$ is longer for freebase compared to nicotine benzoic acid and nicotine malate resulting from less aerosolized nicotine and thus less rapid uptake in the user's lungs.

In comparison to acids that do not degrade at room temperature and/or an operating temperature(s) of the device, acids that degrade at room temperature and/or an operating temperature of the device require a higher molar ratio of acid to nicotine to transfer the same molar amount of the acid from the liquid to the aerosol. As such, in some embodiments, twice the molar amount of acids that degrade at room temperature and/or an operating temperature(s) of the device compared to acids that do not degrade is required to generate an aerosol comprising the same molar amount of nicotine in the aerosol, in some embodiments in a non-gas phase (e.g. liquid droplets) of the aerosol. As shown in a non-limiting Example 13, the correlation between the benzoic acid to nicotine molar ratio and the percent of acid captured demonstrates that more acid is the aerosol, in some embodiments in a non-gas phase of the aerosol, and as such, more nicotine is likely present the aerosol, in some embodiments in a non-gas phase of the aerosol. Further, malic acid is known to decompose at about 150° C., which is below the temperature at which low temperature electronic vaporization device, i.e. an electronic cigarette, operates, and as shown in a non-limiting Example 13, less than 50% of the malic acid in the liquid formulation is recovered when using malic acid in the nicotine liquid formulation. This is significantly different than 90% of benzoic acid in the liquid formulation being recovered when using benzoic acid in the nicotine liquid formulation. The lower percent recovery of malic acid is likely due to degradation of malic acid. Therefore, as shown in Example 13, about twice the amount of malic acid compared to benzoic acid is needed to generate an aerosol comprising the same molar amount of acid in the aerosol, in some embodiments in a non-gas phase of the aerosol, and as such, twice the amount of malic acid is more nicotine is likely required to generate an aerosol comprising the same amount of nicotine the aerosol, in some embodiments in a non-gas phase of the aerosol. Moreover, the degradation products of malic acid are likely present in the aerosol, which may be result in a user having an unfavorable experience when using the device and a malic acid nicotine liquid formulation. In some embodiments, an unfavorable experience comprises a flavor, a nervous response, and/or an irritation of one or more of an oral cavity, an upper respiratory tract, and/or the lungs.

The presence of acid in the aerosol stabilizes and/or carries nicotine to a user's lungs. In some embodiments, the formulation comprises a 1:1 ratio of moles of acid functional groups to moles of nicotine such that nicotine is stabilized in the aerosol produced by low temperature electronic vaporization device. i.e. an electronic cigarette. In some embodiments, the formulation comprises a 1:1 ratio of moles of carboxylic acid functional group hydrogens to moles of nicotine such that nicotine is stabilized in the aerosol produced by low temperature electronic vaporization device, i.e. an electronic cigarette. As shown in Example 14, nicotine is aerosolized at a 1:1 ratio of moles of benzoic acid to moles of nicotine, and since benzoic acid comprises one carboxylic acid functional group, nicotine is aerosolized at a 1:1 ratio of moles of carboxylic acid functional groups to moles of nicotine. Further, as shown in Example 14, nicotine is aerosolized at a 0.5:1 ratio of moles of succinic acid to moles of nicotine, and since succinic acid comprises two carboxylic acid functional groups, nicotine is aerosolized at a 1:1 ratio of moles of carboxylic acid functional groups to moles of nicotine. As shown in Example 14, each nicotine molecule is associated with one carboxylic acid functional group and thus is likely protonated by the acid. Moreover, this demonstrates nicotine is likely delivered to the lungs of the user in a protonated form in the aerosol.

Some reasons for not using acids in a nicotine liquid formulation are listed below. Other reasons for using certain acids in a nicotine liquid formulation are unrelated to the rate of nicotine uptake. In some embodiments, an acid that is corrosive or otherwise incompatible with the electronic vaporization device materials is not used in the nicotine liquid formulation. As a non-limiting example, sulfuric acid would corrode and/or react with device components making it inappropriate to be included in the nicotine liquid formulation. In some embodiments, an acid that is toxic to a user of the electronic vaporization device is not useful in the nicotine liquid formulation because it is not compatible for human consumption, ingestion, or inhalation. As a non-limiting example, sulfuric acid is an example of such an acid, which may be inappropriate for a user of low temperature electronic vaporization device, i.e. an electronic cigarette, device, depending on the embodiment of the composition. In some embodiments, an acid in the nicotine liquid formulation is that is bitter or otherwise bad-tasting to a user is not useful in the nicotine liquid formulation. A non-limiting example of such an acid is acetic acid or citric acid at a high concentration. In some embodiments, acids that oxidize at room temperature and/or at the operating temperature of the device are not included in the nicotine liquid formulation. A non-limiting example of such acids comprises sorbic acid and malic, which are unstable at the room temperature and/or the operating temperature of the device. Decomposition of acids at room or operating temperatures may indicate that the acid is inappropriate for use in the embodiment formulations. As a non-limiting example, citric acid decomposes at 175° C., and malic acid decomposes at 140° C., thus for a device operating at 200° C., these acids may not be appropriate. In some embodiments, acids that have poor solubility in the composition constituents are inappropriate for use in certain embodiments of the compositions herein. As a non-limiting example, nicotine bitartrate with a composition of nicotine and tartaric acid at a 1:2 molar ratio will not produce a solution at a concentration of 0.5% (w/w) nicotine or higher and 0.9% (w/w) tartaric acid or higher in propylene glycol (PG) or vegetable glycerin (VG) or any mixture of PG and VG at ambient conditions. As used herein, weight percentage (w/w) refers to the weight of the individual component over the weight of the total formulation.

In some embodiments, a nicotine liquid formulation, for example a nicotine salt liquid formulation, made using an acid having a Vapor Pressure between 20-300 mmHg @200° C., or Vapor Pressure >20 mmHg @200° C., or a Vapor Pressure from 20 to 300 mmHg @200° C., or a Vapor Pressure from 20 to 200 mmHg @200° C., a Vapor Pressure between 20 and 300 mmHg @200° C. provide satisfaction comparable to a traditional cigarette or closer to a traditional cigarette (as compared to other nicotine salt formulations or as compared to nicotine freebase formulations). For non-limiting example, acids that meet one or more criteria of the prior sentence comprise salicylic acid, sorbic acid, benzoic acid, lauric acid, and levulinic acid. In some embodiments, a nicotine liquid formulation, for example a nicotine salt liquid formulation, made using an acid that has a difference between boiling point and melting point of at least 50° C., and a boiling point greater than 160° C., and a melting point less than 160° C. provide satisfaction comparable to a traditional cigarette or closer to a traditional cigarette (as compared to other nicotine salt formulations or as compared to nicotine freebase formulations). For non-limiting example, acids that meet the criteria of the prior sentence comprise salicylic acid, sorbic acid, benzoic acid, pyruvic acid, lauric acid, and levulinic acid. In some embodiments, a nicotine liquid formulation, for example a nicotine salt liquid formulation, made using an acid that has a difference between boiling point and melting point of at least 50° C., and a boiling point at most 40° C. less than operating temperature, and a melting point at least 40° C. lower than operating temperature provide satisfaction comparable to a traditional cigarette or closer to a traditional cigarette (as compared to other nicotine salt formulations or as compared to nicotine freebase formulations). In some embodiments, an operating temperature can be 100° C. to 300° C., or about 200° C., about 150° C. to about 250° C., 180 C to 220° C., about 180° C. to about 220° C., 185° C. to 215° C., about 185° C. to about 215° C., about 190° C. to about 210° C., 190° C. to 210° C., 195° C. to 205° C., or about 195° C. to about 205° C. For non-limiting example, acids that meet the aforementioned criteria comprise salicylic acid, sorbic acid, benzoic acid, pyruvic acid, lauric acid, and levulinic acid. In some embodiments, a combination of these criteria for preference of certain nicotine salt formulations are contemplated herein.

As used in this specification and the claims, the singular forms "a," "an," and "the" include plural referents unless the context clearly dictates otherwise.

As used in this specification and the claims, the term "vapor" refers to a gas or a gas phase of a material. As used in the specification and the claims, the term "aerosol" refers to a colloidal suspension of particles, for example liquid droplets, dispersed in air or gas.

The term "organic acid" as used herein, refers to an organic compound with acidic properties (e.g., by Brønsted-Lowry definition, or Lewis definition). A common organic acid is the carboxylic acids, whose acidity is associated with their carboxyl group —COOH. A dicarboxylic acid possesses two carboxylic acid groups. The relative acidity of an organic is measured by its $pK_a$ value and one of skill in the art knows how to determine the acidity of an organic acid based on its given pKa value. The term "keto acid" as used herein, refers to organic compounds that contain a carboxylic acid group and a ketone group. Common types of keto acids include alpha-keto acids, or 2-oxoacids, such as pyruvic acid or oxaloacetic acid, having the keto group adjacent to the carboxylic acid; beta-keto acids, or 3-oxoacids, such as acetoacetic acid, having the ketone group at the second carbon from the carboxylic acid; gamma-keto acids, or 4-oxoacids, such as levulinic acid, having the ketone group at the third carbon from the carboxylic acid.

The term "electronic cigarette" or "low temperature vaporization device" as used herein, refers to an electronic inhaler that vaporizes a liquid solution into an aerosol mist, simulating the act of tobacco smoking. The liquid solution comprises a formulation comprising nicotine. There are many a low temperature vaporization device, i.e. an electronic cigarette, which do not resemble conventional cigarettes at all. The amount of nicotine contained can be chosen by the user via the inhalation. In general, low temperature electronic vaporization device, i.e. an electronic cigarette, contains three essential components: a plastic cartridge that serves as a mouthpiece and a reservoir for liquid, an "atomizer" that vaporizes the liquid, and a battery. Other embodiment a low temperature vaporization device, i.e. an electronic cigarette, include a combined atomizer and reservoir, called a "cartomizer" that may or may not be disposable, a mouthpiece that may be integrated with the cartomizer or not, and a battery.

As used in this specification and the claims, unless otherwise stated, the term "about" refers to variations of 1%, 2%, 3%, 4%, 5%, 10%, 15%, or 25%, depending on the embodiment.

Suitable carriers (e.g., a liquid solvent) for the nicotine salts described herein include a medium in which a nicotine salt is soluble at ambient conditions, such that the nicotine salt does not form a solid precipitate. Examples include, but are not limited to, glycerol, propylene glycol, trimethylene glycol, water, ethanol and the like, as well as combinations thereof. In some embodiments, the liquid carrier comprises from about 0% to about 100% of propylene glycol and from about 100% to about 0% of vegetable glycerin. In some embodiments, the liquid carrier comprises from about 10% to about 70% of propylene glycol and from about 90% to about 30% of vegetable glycerin. In some embodiments, the liquid carrier comprises from about 20% to about 50% of propylene glycol and from about 80% to about 50% of vegetable glycerin. In some embodiments, the liquid carrier comprises about 30% propylene glycol and about 70% vegetable glycerin.

The formulations described herein vary in nicotine concentration. In some formulations, the concentration of nicotine in the formulation is dilute. In some formulations, the nicotine concentration in the formulation is less dilute. In some formulations the concentration of nicotine in the nicotine liquid formulation is from about 1% (w/w) to about 25% (w/w). In some formulations the concentration of nicotine in the nicotine liquid formulation is from about 1% (w/w) to about 20% (w/w). In some formulations the concentration of nicotine in the nicotine liquid formulation is from about 1% (w/w) to about 18% (w/w). In some embodiments the concentration of nicotine in the nicotine liquid formulation is from about 1% (w/w) to about 15% (w/w). In some formulations the concentration of nicotine in the nicotine liquid formulation is from about 4% (w/w) to about 12% (w/w). In some formulations the concentration of nicotine in the nicotine liquid formulation is from about 2% (w/w) to about 6% (w/w). In some formulations the concentration of nicotine in the nicotine liquid formulation is about 5% (w/w). In some formulations the concentration of nicotine in the nicotine liquid formulation is about 4% (w/w). In some formulations the concentration of nicotine in the nicotine liquid formulation is about 3% (w/w). In some formulations the concentration of nicotine in the nicotine liquid formulation is about 2% (w/w). In some embodiments the concentration of nicotine in the nicotine liquid formulation is about 1% (w/w). In some formulations the concentration of nicotine in the nicotine liquid formulation is form about 1% (w/w) to about 25% (w/w).

The formulations described herein vary in nicotine salt concentration. In some formulations, the concentration of nicotine salt in the nicotine liquid formulation is dilute. In some formulations, the nicotine concentration in the formulation is less dilute. In some formulations the concentration of nicotine salt in the nicotine liquid formulation is from about 1% (w/w) to about 25% (w/w). In some formulations the concentration of nicotine salt in the nicotine liquid formulation is from about 1% (w/w) to about 20% (w/w). In some formulations the concentration of nicotine salt in the nicotine liquid formulation is from about 1% (w/w) to about 18% (w/w). In some embodiments the concentration of nicotine salt in the nicotine liquid formulation is from about 1% (w/w) to about 15% (w/w). In some formulations the concentration of nicotine salt in the nicotine liquid formulation is from about 4% (w/w) to about 12% (w/w). In some formulations the concentration of nicotine salt in the nicotine liquid formulation is from about 2% (w/w) to about 6% (w/w). In some Formulations the concentration of nicotine salt in the nicotine liquid formulation is about 5% (w/w). In some formulations the concentration of nicotine salt in the nicotine liquid formulation is about 4% (w/w). In some formulations the concentration of nicotine salt in the nicotine liquid formulation is about 3% (w/w). In some formulations the concentration of nicotine salt in the nicotine liquid formulation is about 2% (w/w).

In some embodiments the concentration of nicotine salt in the nicotine liquid formulation is about 1% (w/w). In some formulations, a less dilute concentration of one nicotine salt is used in conjunction with a more dilute concentration of a second nicotine salt. In some formulations, the concentration of nicotine in the first nicotine liquid formulation is from about 1% to about 20%, and is combined with a second nicotine liquid formulation having a concentration of nicotine from about 1% to about 20% or any range or concentration therein. In some formulations, the concentration of nicotine salt in the first nicotine liquid formulation is from about 1% to about 20%, and is combined with a second nicotine liquid formulation having a concentration of nicotine from 1% to 20% or any range or concentration therein. In some formulations, the concentration of nicotine salt in the first nicotine liquid formulation is from about 1% to about 20%, and is combined with a second nicotine liquid formulation having a concentration of nicotine salt from 1% to 20% or any range or concentration therein. As used with respect to concentrations of nicotine in the nicotine liquid formulations, the term "about" refers to ranges of 0.05% (i.e. if the concentration is from about 2%, the range is 1.95%-2.05%), 0.1 (i.e. if the concentration is from about 2%, the range is 1.9%-2.1%), 0.25 (i.e. if the concentration is from about 2%, the range is 1.75%-2.25%), 0.5 (i.e. if the concentration is from about 2%, the range is 1.5%-2.5%), or 1 (i.e. if the concentration is from about 4%, the range is 3%-5%), depending on the embodiment.

In some embodiments, the formulation comprises an organic acid and/or inorganic acid. In some embodiments, suitable organic acids comprise carboxylic acids. In some embodiments, organic carboxylic acids disclosed herein are monocarboxylic acids, dicarboxylic acids (organic acid containing two carboxylic acid groups), and carboxylic acids containing an aromatic group such as benzoic acids, hydroxycarboxylic acids, heterocyclic carboxylic acids, terpenoid acids, and sugar acids; such as the pectic acids, amino acids, cycloaliphatic acids, aliphatic carboxylic acids, keto carboxylic acids, and the like. In some embodiments, suitable acids comprise formic acid, acetic acid, propionic acid, butyric acid, valeric acid, caproic acid, caprylic acid, capric acid, citric acid, lauric acid, myristic acid, palmitic acid, stearic acid, oleic acid, linoleic acid, linolenic acid, phenylacetic acid, benzoic acid, pyruvic acid, levulinic acid, tartaric acid, lactic acid, malonic acid, succinic acid, fumaric acid, gluconic acid, saccharic acid, salicyclic acid, sorbic acid, malonic acid, malic acid, or a combination thereof. In some embodiments, a suitable acid comprises one or more of benzoic acid, pyruvic acid, salicylic acid, levulinic acid, malic acid, succinic acid, and citric acid. In some embodiments, a suitable acid comprises one or more of benzoic acid, pyruvic acid, and salicylic acid. In some embodiments, a suitable acid comprises benzoic acid.

Nicotine salts are formed by the addition of a suitable acid, including organic or inorganic acids. In some embodiments, suitable organic acids comprise carboxylic acids. In some embodiments, organic carboxylic acids disclosed herein are monocarboxylic acids, dicarboxylic acids (organic acid containing two carboxylic acid groups), carboxylic acids containing an aromatic group such as benzoic acids, hydroxycarboxylic acids, heterocyclic carboxylic acids, terpenoid acids, sugar acids; such as the pectic acids, amino acids, cycloaliphatic acids, aliphatic carboxylic acids, keto carboxylic acids, and the like. In some embodiments, organic acids used herein are monocarboxylic acids. Nicotine salts are formed from the addition of a suitable acid to nicotine. In some embodiments, suitable acid, comprise formic acid, acetic acid, propionic acid, butyric acid, valeric acid, caproic acid, caprylic acid, capric acid, citric acid, lauric acid, myristic acid, palmitic acid, stearic acid, oleic acid, linoleic acid, linolenic acid, phenylacetic acid, benzoic acid, pyruvic acid, levulinic acid, tartaric acid, lactic acid, malonic acid, succinic acid, fumaric acid, gluconic acid, saccharic acid, salicyclic acid, sorbic acid, masonic acid, malic acid, or a combination thereof. In some embodiments, a suitable acid comprises one or more of benzoic acid, pyruvic acid, salicylic acid, levulinic acid, malic acid, succinic acid, and citric acid. In some embodiments, a suitable acid comprises one or more of benzoic acid, pyruvic acid, and salicylic acid. In some embodiments, a suitable acid comprises benzoic acid.

In some embodiments, the formulation comprises various stoichiometric ratios and/or molar ratios of acid to nicotine, acidic functional groups to nicotine, and acidic functional group hydrogens to nicotine. In some embodiments, the stoichiometric ratios of the nicotine to acid (nicotine:acid) are 1:1, 1:2, 1:3, 1:4, 2:3, 2:5, 2:7, 3:4, 3:5, 3:7, 3:8, 3:10, 3:11, 4:5, 4:7, 4:9, 4:10, 4:11, 4:13, 4:14, 4:15, 5:6, 5:7, 5:8, 5:9, 5:11, 5:12, 5:13, 5:14, 5:16, 5:17, 5:18, or 5:19. In some formulations provided herein, the stoichiometric ratios of the nicotine to acid are 1:1, 1:2, 1:3, or 1:4. In some embodiments, the molar ratio of acid to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1. In some embodiments, the molar ratio of acidic functional groups to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1. In some embodiments, the molar ratio of acidic functional group hydrogens to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1. In some embodiments, the molar ratio of acid to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1. In some embodiments, the molar ratio of acidic functional groups to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1. In some embodiments, the molar ratio of acidic functional group hydrogens to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

Nicotine is an alkaloid molecule that comprises two basic nitrogens. It may occur in different states of protonation. For example, if no protonation exists, nicotine is referred to as the "free base." If one nitrogen is protonated, then the nicotine is "mono-protonated."

In some embodiments, nicotine liquid formulations are formed by adding a suitable acid to nicotine, stirring the neat mixture at ambient temperature or at elevated temperature, and then diluting the neat mixture with a carrier mixture, such as a mixture of propylene glycol and glycerin. In some embodiments, the suitable acid is completely dissolved by the nicotine prior to dilution. The suitable acid may not completely dissolved by the nicotine prior to dilution. The addition of the suitable acid to the nicotine to form a neat mixture may cause an exothermic reaction. The addition of the suitable acid to the nicotine to form a neat mixture may be conducted at 55° C. The addition of the suitable acid to the nicotine to form a neat mixture may be conducted at 90° C. The neat mixture may be cooled to ambient temperature prior to dilution. The dilution may be carried out at elevated temperature.

In some embodiments, nicotine liquid formulations are prepared by combining nicotine and a suitable acid in a carrier mixture, such as a mixture of propylene glycol and glycerin. The mixture of nicotine and a first carrier mixture is combined with a mixture of a suitable acid in a second carrier mixture. In some embodiments, the first and second carrier mixtures are identical in composition. In some embodiments, the first and second carrier mixtures are not identical in composition. In some embodiments, heating of nicotine/acid/carrier mixture is required to facilitate complete dissolution. In some embodiments, stirring of nicotine/acid/carrier mixture is sufficient to facilitate complete dissolution.

In some embodiments, nicotine liquid formulations are prepared and added to a solution of 3:7 ratio by weight of propylene glycol (PG)/vegetable glycerin (VG), and mixed thoroughly. While described herein as producing 10 g of each of the formulations, all procedures noted infra are scalable. Other manners of formulation may also be employed form the formulations noted infra, without departing from the disclosure herein, and as would be known to one of skill in the art upon reading the disclosure herein.

Figure 3:
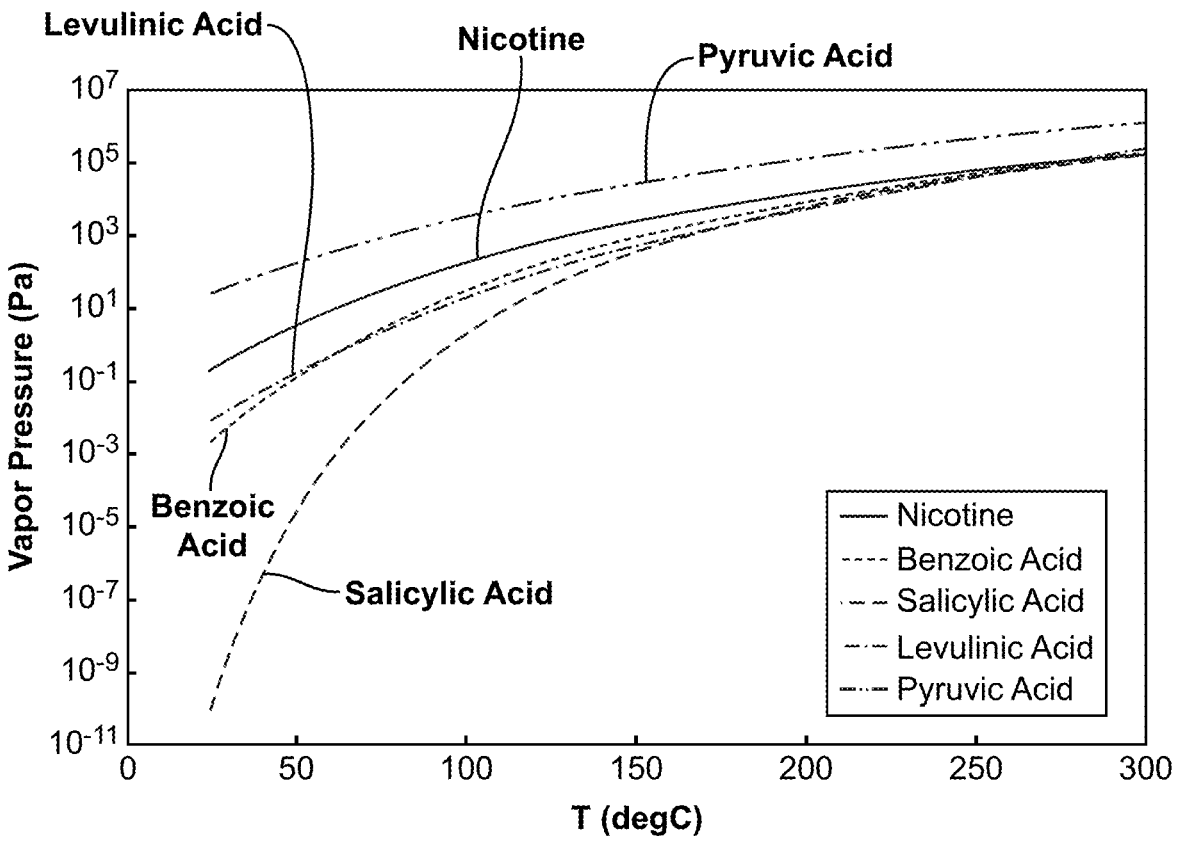
FIG. 3 illustrates a non-limiting example of calculated vapor pressures of various acids relative to nicotine.

In some embodiments, the acid included in the nicotine liquid formulation is determined by the vapor pressure of the acid. In some embodiments, the nicotine liquid formulation comprises an acid with a vapor pressure that is similar to the vapor pressure of free base nicotine. In some embodiments, the nicotine liquid formulations am formed from an acid with a vapor pressure that is similar to the vapor pressure of free base nicotine at the heating temperature of the device. As a non-limiting example, FIG. 3 illustrates this trend. Nicotine salts formed from nicotine and benzoic acid; nicotine and pyruvic acid; nicotine and salicylic acid; or nicotine and levulinic acid are salts that produce a satisfaction in an individual user consistent with efficient transfer of nicotine and a rapid rise in nicotine plasma levels. This pattern may be due to the mechanism of action during heating of the nicotine liquid formulation. The nicotine salt may disassociate at, or just below, the heating temperature of the device, resulting in a mixture of free base nicotine and the individual acid. At that point, if both the nicotine and acid have similar vapor pressures, they may aerosolize at the same time, giving rise to a transfer of both free base nicotine and the constituent acid to the user. In some embodiments, the nicotine liquid formulation, for example a nicotine salt liquid formulation, for generating an inhalable aerosol upon heating in low temperature electronic vaporization device, i.e. an electronic cigarette, may comprise a nicotine salt in a biologically acceptable liquid carrier; wherein the acid used to form said nicotine salt is characterized by a vapor pressure between 20-4000 mmHg at 200° C. In some embodiments, the acid used to form the nicotine salt is characterized by vapor pressure between 20-2000 mmHg at 200° C. In some embodiments, the acid used to form the nicotine salt is characterized by vapor pressure between 100-300 mmHg at 200° C.

Unexpectedly, different nicotine liquid formulations produced varying degrees of satisfaction in an individual. In some embodiments, the extent of protonation of the nicotine salt effects satisfaction, such that more protonation was less satisfying as compared to less protonation. In some embodiments, nicotine, for example a nicotine salt, in the formulation, vapor, and/or aerosol is monoprotonated. In some embodiments, nicotine, for example a nicotine salt, in the formulation, vapor and/or aerosol is diprotonated. In some embodiments, nicotine, for example a nicotine salt, in the formulation, vapor and/or aerosol exists in more than one protonation state, e.g., an equilibrium of mono-protonated and di-protonated nicotine salts. In some embodiments, the extent of protonation of nicotine is dependent upon the stoichiometric ratio of nicotine:acid used in the salt formation reaction. In some embodiments, the extent of protonation of nicotine is dependent upon the solvent. In some embodiments, the extent of protonation of nicotine is unknown.

In some embodiments, monoprotonated nicotine salts produced a high degree of satisfaction in the user. For example, nicotine benzoate and nicotine salicylate are mono-protonated nicotine salts and produce a high degree of satisfaction in the user. The reason for this trend may be explained by a mechanism of action wherein the nicotine is first deprotonated prior to transfer to the vapor with the constituent acid, then stabilized by the acid in the aerosol after re-protonation, and carried by the acid going down stream to the lungs of the user. In addition, the lack of satisfaction of free base nicotine indicates that a second factor may be important. A nicotine salt may be best performing when it is at its optimal extent of protonation, depending on the salt. For example, as depicted in a non-limiting Example 13, nicotine benzoate transfers the maximum amount of nicotine to the aerosol at a 1:1 ratio of benzoic acid to nicotine. A lower molar ratio results in less nicotine being transferred to the aerosol, and a higher than 1:1 molar ratio of benzoic acid to nicotine does results in the transfer of any additional nicotine to the aerosol. This may be explained as 1 mole of nicotine associates or interacts with 1 mole of benzoic acid to form a salt. When there is not enough benzoic acid to associate with all nicotine molecules, the free base nicotine left unprotonated in the formulation is vaporized thus reducing the satisfaction for the user.

In some embodiments, acids that degrade at room temperature or an operating temperature of a low temperature electronic vaporization device, i.e. a low temperature electronic cigarette, do not afford the same degree of satisfaction to a user. For example, twice the amount of malic acid, which degrades at the operating temperature of the low temperature electronic cigarette, compared to benzoic acid is required to transfer the same molar amount of the acid from the liquid to the aerosol. As such, in some embodiments, twice the molar amount of malic acid compared to benzoic acid is required to generate an aerosol comprising the same molar amount of nicotine in the aerosol, in some embodiments in a non-gas phase of the aerosol. Moreover, because malic acid comprises two carboxylic acid groups and benzoic acid comprises one, four times the amount of acidic functional groups are required when using malic acid compared to benzoic acid in the nicotine liquid formulation. Moreover, because malic acid comprises two carboxylic acid groups and benzoic acid comprises one, four times the amount of acidic functional group hydrogens are required when using malic acid compared to benzoic acid in the nicotine liquid formulation. In some embodiments, the one or more chemicals produced on degradation of the acid results in an unfavorable experience to the user. In some embodiments, an unfavorable experience comprises a flavor, a nervous response, and/or an irritation of one or more of an oral cavity, an upper respiratory tract, and/or the lungs.

In some embodiments, provided here are method, systems, devices, formulations, and kits for generating an inhalable aerosol comprising nicotine for delivery to a user comprising using low temperature electronic vaporization device, i.e. an electronic cigarette, comprising a nicotine liquid formulation and a heater, wherein the nicotine liquid formulation comprises said nicotine, an acid, and a biologically acceptable liquid carrier, wherein using the electronic cigarette comprises: providing an amount of said nicotine liquid formulation to said heater; said heater forming an aerosol by heating said amount of said nicotine liquid formulation, wherein at least about 50% of said acid in said amount is in said aerosol, and wherein at least about 90% of said nicotine in said amount is in said aerosol. In some embodiments, at least about 50%, at least about 60%, at least about 70%, at least about 80%, at least about 90%, at least 95%, or at least about 99% of said acid in said amount is in said aerosol. In some embodiments, at least about 50% to about 99% of said acid in said amount is in said aerosol. In some embodiments, at least about 50% to about 95% of said acid in said amount is in said aerosol. In some embodiments, at least about 50% to about 90% of said acid in said amount is in said aerosol. In some embodiments, at least about 50% to about 80% of said acid in said amount is in said aerosol. In some embodiments, at least about 50% to about 70% of said acid in said amount is in said aerosol. In some embodiments, at least about 50% to about 60% of said acid in said amount is in said aerosol. In some embodiments, at least about 60% to about 99% of said acid in said amount is in said aerosol. In some embodiments, at least about 60% to about 95% of said acid in said amount is in said aerosol. In some embodiments, at least about 60% to about 90% of said acid in said amount is in said aerosol. In some embodiments, at least about 60% to about 80% of said acid in said amount is in said aerosol. In some embodiments, at least about 60% to about 70% of said acid in said amount is in said aerosol. In some embodiments, at least about 70% to about 99% of said acid in said amount is in said aerosol. In some embodiments, at least about 70% to about 95% of said acid in said amount is in said aerosol. In some embodiments, at least about 70% to about 90% of said acid in said amount is in said aerosol. In some embodiments, at least about 70% to about 80% of said acid in said amount is in said aerosol.

In some embodiments, the aerosol is delivered in particles sized to be delivered through the oral or nasal cavity and to a user's lungs, for example the alveoli of a user's lungs. In some embodiments, the aerosol generated using a nicotine liquid formulation, for example a nicotine salt liquid formulation, generated using a low temperature vaporization device, for example a low temperature electronic cigarette, is delivered in particles sized to be delivered through the oral or nasal cavity and to a user's lungs, for example the alveoli of a user's lung. In some embodiments, the rate of uptake in the user's lungs, for example alveoli in the user's lungs, is affected by aerosol particle size. In some embodiments the aerosol particles are sized from about 0.1 microns to about 5 microns, from about 0.1 microns to about 4.5 microns, from about 0.1 microns to about 4 microns, from about 0.1 microns to about 3.5 microns, from about 0.1 microns to about 3 microns, from about 0.1 microns to about 2.5 microns, from about 0.1 microns to about 2 microns, from about 0.1 microns to about 1.5 microns, from about 0.1 microns to about 1 microns, from about 0.1 microns to about 0.9 microns, from about 0.1 microns to about 0.8 microns, from about 0.1 microns to about 0.7 microns, from about 0.1 microns to about 0.6 microns, from about 0.1 microns to about 0.5 microns, from about 0.1 microns to about 0.4 microns, from about 0.1 microns to about 0.3 microns, from about 0.1 microns to about 0.2 microns, from about 0.2 microns to about 5 microns, from about 0.2 microns to about 4.5 microns, from about 0.2 microns to about 4 microns, from about 0.2 microns to about 3.5 microns, from about 0.2 microns to about 3 microns, from about 0.2 microns to about 2.5 microns, from about 0.2 microns to about 2 microns, from about 0.2 microns to about 1.5 microns, from about 0.2 microns to about 1 microns, from about 0.2 microns to about 0.9 microns, from about 0.2 microns to about 0.8 microns, from about 0.2 microns to about 0.7 microns, from about 0.2 microns to about 0.6 microns, from about 0.2 microns to about 0.5 microns, from about 0.2 microns to about 0.4 microns, from about 0.2 microns to about 0.3 microns, from about 0.3 microns to about 5 microns, from about 0.3 microns to about 4.5 microns, from about 0.3 microns to about 4 microns, from about 0.3 microns to about 3.5 microns, from about 0.3 microns to about 3 microns, from about 0.3 microns to about 2.5 microns, from about 0.3 microns to about 2 microns, from about 0.3 microns to about 1.5 microns, from about 0.3 microns to about 1 microns, from about 0.3 microns to about 0.9 microns, from about 0.3 microns to about 0.8 microns, from about 0.3 microns to about 0.7 microns, from about 0.3 microns to about 0.6 microns, from about 0.3 microns to about 0.5 microns, from about 0.3 microns to about 0.4, from about 0.4 microns to about 5 microns, from about 0.4 microns to about 4.5 microns, from about 0.4 microns to about 4 microns, from about 0.4 microns to about 3.5 microns, from about 0.4 microns to about 3 microns, from about 0.4 microns to about 2.5 microns, from about 0.4 microns to about 2 microns, from about 0.4 microns to about 1.5 microns, from about 0.4 microns to about 1 microns, from about 0.4 microns to about 0.9 microns, from about 0.4 microns to about 0.8 microns, from about 0.4 microns to about 0.7 microns, from about 0.4 microns to about 0.6 microns, from about 0.4 microns to about 0.5 microns, from about 0.5 microns to about 5 microns, from about 0.5 microns to about 4.5 microns, from about 0.5 microns to about 4 microns, from about 0.5 microns to about 3.5 microns, from about 0.5 microns to about 3 microns, from about 0.5 microns to about 2.5 microns, from about 0.5 microns to about 2 microns, from about 0.5 microns to about 1.5 microns, from about 0.5 microns to about 1 microns, from about 0.5 microns to about 0.9 microns, from about 0.5 microns to about 0.8 microns, from about 0.5 microns to about 0.7 microns, from about 0.5 microns to about 0.6 microns, from about 0.6 microns to about 5 microns, from about 0.6 microns to about 4.5 microns, from about 0.6 microns to about 4 microns, from about 0.6 microns to about 3.5 microns, from about 0.6 microns to about 3 microns, from about 0.6 microns to about 2.5 microns, from about 0.6 microns to about 2 microns, from about 0.6 microns to about 1.5 microns, from about 0.6 microns to about 1 microns, from about 0.6 microns to about 0.9 microns, from about 0.6 microns to about 0.8 microns, from about 0.6 microns to about 0.7 microns, from about 0.8 microns to about 5 microns, from about 0.8 microns to about 4.5 microns, from about 0.8 microns to about 4 microns, from about 0.8 microns to about 3.5 microns, from about 0.8 microns to about 3 microns, from about 0.8 microns to about 2.5 microns, from about 0.8 microns to about 2 microns, from about 0.8 microns to about 1.5 microns, from about 0.8 microns to about 1 microns, from about 0.8 microns to about 0.9 microns, from about 0.9 microns to about 5 microns, from about 0.9 microns to about 4.5 microns, from about 0.9 microns to about 4 microns, from about 0.9 microns to about 3.5 microns, from about 0.9 microns to about 3 microns, from about 0.9 microns to about 2.5 microns, from about 0.9 microns to about 2 microns, from about 0.9 microns to about 1.5 microns, from about 0.9 microns to about 1 microns, from about 1 microns to about 5 microns, from about 1 microns to about 4.5 microns, from about 1 microns to about 4 microns, from about 1 microns to about 3.5 microns, from about 1 microns to about 3 microns, from about 1 microns to about 2.5 microns, from about 1 microns to about 2 microns, from about 1 microns to about 1.5 microns In some embodiments, an amount of nicotine liquid formulation provided to said heater comprises a volume or a mass. In some embodiments the amount is quantified "per puff." In some embodiments the amount comprises a volume of about 1 μL, about 2 μL, about 3 μL, about 4 μL, about 5 μL, about 6 μL, about 7 μL, about 8 μL, about 9 μL, about 10 μL, about 15 μL, about 20 μL, about 25 μL, about 30 μL, about 35 μL, about 40 μL, about 45 μL, about 50 μL, about 60 μL, about 70 μL, about 80 μL, about 90 μL, about 100 μL, or greater than about 100 μL. In some embodiments the amount comprises a mass of about 1 mg, about 2 mg, about 3 mg, about 4 mg, about 5 mg, about 6 mg, about 7 mg, about 8 mg, about 9 mg, about 10 mg, about 15 mg, about 20 mg, about 25 mg, about 30 mg, about 35 mg, about 40 mg, about 45 mg, about 50 mg, about 60 mg, about 70 mg, about 80 mg, about 90 mg, about 100 mg, or greater than about 100 mg.

The flavor of the constituent acid used in the salt formation may be a consideration in choosing the acid. A suitable acid may have minimal or no toxicity to humans in the concentrations used. A suitable acid may be compatible with the electronic cigarette components it contacts or could contact at the concentrations used. That is, such acid does not degrade or otherwise react with the electronic cigarette components it contacts or could contact. The odor of the constituent acid used in the salt formation may be a consideration in choosing a suitable acid. The concentration of the nicotine salt in the carrier may affect the satisfaction in the individual user. In some embodiments, the flavor of the formulation is adjusted by changing the acid. In some embodiments, the flavor of the formulation is adjusted by adding exogenous flavorants. In some embodiments, an unpleasant tasting or smelling acid is used in minimal quantities to mitigate such characteristics. In some embodiments, exogenous pleasant smelling or tasting acid is added to the formulation. Examples of salts which can provide flavor and aroma to the mainstream aerosol at certain levels include nicotine acetate, nicotine oxalate, nicotine malate, nicotine isovalerate, nicotine lactate, nicotine citrate, nicotine phenylacetate and nicotine myristate.

Nicotine liquid formulations may generate an inhalable aerosol upon heating in low temperature electronic vaporization device, i.e. an electronic cigarette. The amount of nicotine or nicotine salt aerosol inhaled may be user-determined. The user may, for example, modify the amount of nicotine or nicotine salt inhaled by adjusting his inhalation strength.

Formulations are described herein comprising two or more nicotine salts. In some embodiments, wherein a formulation comprises two or more nicotine salts, each individual nicotine salt is formed as described herein.

Nicotine liquid formulations, as used herein, refer to a single or mixture of nicotine salts with other suitable chemical components used for electronic cigarette, such as carriers, stabilizers, diluents, dispersing agents, suspending agents, thickening agents, and/or excipients. In certain embodiments, the nicotine liquid formulation is stirred at ambient conditions for 20 minutes. In certain embodiments, the nicotine liquid formulation is heated and stirred at 55 C for 20 minutes. In certain embodiments, the nicotine liquid formulation is heated and stirred at 90 C for 60 minutes. In certain embodiments, the formulation facilitates administration of nicotine to an organism (e.g., lung).

The nicotine of nicotine liquid formulations provided herein is either naturally occurring nicotine (e.g., from extract of nicotineous species such as tobacco), or synthetic nicotine. In some embodiments, the nicotine is (−)-nicotine, (+)-nicotine, or a mixture thereof. In some embodiments, the nicotine is employed in relatively pure form (e.g., greater than about 80% pure, 85% pure, 90% pure, 95% pure, or 99% pure). In some embodiments, the nicotine for nicotine liquid formulation provided herein is "water clear" in appearance in order to avoid or minimize the formation of tarry residues during the subsequent salt formation steps.

Nicotine liquid formulations used for a low temperature vaporization device, i.e. an electronic cigarette, described herein, in some embodiments, have a nicotine concentration of about 0.5% (w/w) to about 20% (w/w), wherein the concentration is of nicotine weight to total solution weight, i.e. (w/w). In certain embodiments, nicotine liquid formulations provided herein have a nicotine concentration of about 1% (w/w) to about 20% (w/w). In certain embodiments, nicotine liquid formulations provided herein have a nicotine concentration of about 1% (w/w) to about 18% (w/w). In certain embodiments, nicotine liquid formulations provided herein have a nicotine concentration of about 1% (w/w) to about 15% (w/w). In certain embodiments, nicotine liquid formulations provided herein have a nicotine concentration of about 4% (w/w) to about 12% (w/w). In certain embodiments, nicotine liquid formulations provided herein have a nicotine concentration of about 1% (w/w) to about 18% (w/w), about 3% (w/w) to about 15% (w/w), or about 4% (w/w) to about 12% (w/w). In certain embodiments, nicotine liquid formulations provided herein have a nicotine concentration of about 0.5% (w/w) to about 10% (w/w). In certain embodiments, nicotine liquid formulations provided herein have a nicotine concentration of about 0.5% (w/w) to about 5% (w/w). In certain embodiments, nicotine liquid formulations provided herein have a nicotine concentration of about 0.5% (w/w) to about 4% (w/w). In certain embodiments, nicotine liquid formulations provided herein have a nicotine concentration of about 0.5% (w/w) to about 3% (w/w). In certain embodiments, nicotine liquid formulations provided herein have a nicotine concentration of about 0.5% (w/w) to about 2% (w/w). In certain embodiments, nicotine liquid formulations provided herein have a nicotine concentration of about 0.5% (w/w) to about 1% (w/w). In certain embodiments, nicotine liquid formulations provided herein have a nicotine concentration of about 1% (w/w) to about 10% (w/w). In certain embodiments, nicotine liquid formulations provided herein have a nicotine concentration of about 1% (w/w) to about 5% (w/w). In certain embodiments, nicotine liquid formulations provided herein have a nicotine concentration of about 1% (w/w) to about 4% (w/w). In certain embodiments, nicotine liquid formulations provided herein have a nicotine concentration of about 1% (w/w) to about 3% (w/w). In certain embodiments, nicotine liquid formulations provided herein have a nicotine concentration of about 1% (w/w) to about 2% (w/w). In certain embodiments, nicotine liquid formulations provided herein have a nicotine concentration of about 2% (w/w) to about 10% (w/w). In certain embodiments, nicotine liquid formulations provided herein have a nicotine concentration of about 2% (w/w) to about 5% (w/w). In certain embodiments, nicotine liquid formulations provided herein have a nicotine concentration of about 2% (w/w) to about 4% (w/w). Certain embodiments provide a nicotine liquid formulation having a nicotine concentration of about 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, 3.0%, 3.1%, 3.2%, 3.3%, 3.4%, 3.5%, 3.6%, 3.7%, 3.8%, 3.9%, 4.0%, 4.5%, 5.0%, 5.5%, 6.0%, 6.5%, 7.0%, 7.5%, 8.0%, 8.5%, 9.0%, 9.5%, 10%, 11%, 12%, 13%, 14%, 15%, 16%, 17%, 18%, 19%, or 20% (w/w), or more, including any increments therein. Certain embodiments provide a nicotine liquid formulation having a nicotine concentration of about 5% (w/w). Certain embodiments provide a nicotine liquid formulation having a nicotine concentration of about 4% (w/w). Certain embodiments provide a nicotine liquid formulation having a nicotine concentration of about 3% (w/w). Certain embodiments provide a nicotine liquid formulation having a nicotine concentration of about 2% (w/w). Certain embodiments provide a nicotine liquid formulation having a nicotine concentration of about 1% (w/w). Certain embodiments provide a nicotine liquid formulation having a nicotine concentration of about 0.5% (w/w).

Nicotine liquid formulations used for a low temperature vaporization device, i.e. an electronic cigarette, described herein, in some embodiments, have a nicotine concentration of about 0.5% (w/w), 1% (w/w), about 2% (w/w), about 3% (w/w), about 4% (w/w), about 5% (w/w), about 6% (w/w), about 7% (w/w), about 8% (w/w), about 9% (w/w), about 10% (w/w), about 11% (w/w), about 12% (w/w), about 13% (w/w), about 14% (w/w), about 15% (w/w), about 16% (w/w), about 17% (w/w), about 18% (w/w), about 19% (w/w), or about 20% (w/w). In some embodiments, the nicotine liquid formulations used for a low temperature vaporization device, i.e. an electronic cigarette, described herein have a nicotine concentration from about 0.5% (w/w) to about 20% (w/w), from about 0.5% (w/w) to about 18% (w/w), from about 0.5% (w/w) to about 15% (w/w), from about 0.5% (w/w) to about 12% (w/w), from about 0.5% (w/w) to about 10% (w/w), from about 0.5% (w/w) to about 8% (w/w), from about 0.5% (w/w) to about 7% (w/w), from about 0.5% (w/w) to about 6% (w/w), from about 0.5% (w/w) to about 5% (w/w), from about 0.5% (w/w) to about 4% (w/w), from about 0.5% (w/w) to about 3% (w/w), or from about 0.5% (w/w) to about 2% (w/w). In some embodiments, the nicotine liquid formulations used for a low temperature vaporization device, i.e. an electronic cigarette, described herein have a nicotine concentration from about 1% (w/w) to about 20% (w/w), from about 1% (w/w) to about 18% (w/w), from about 1% (w/w) to about 15% (w/w), from about 1% (w/w) to about 12% (w/w), from about 1% (w/w) to about 0.10% (w/w), from about 1% (w/w) to about 8% (w/w), from about 1% (w/w) to about 7% (w/w), from about 1% (w/w) to about 6% (w/w), from about 1% (w/w) to about 5% (w/w), from about 1% (w/w) to about 4% (w/w), from about 1% (w/w) to about 3% (w/w), or from about 1% (w/w) to about 2% (w/w). In some embodiments, the nicotine liquid formulations used for a low temperature vaporization device, i.e. an electronic cigarette, described herein have a nicotine concentration from about 2% (w/w) to about 20% (w/w), from about 2% (w/w) to about 18% (w/w), from about 2% (w/w) to about 15% (w/w), from about 2% (w/w) to about 12% (w/w), from about 2% (w/w) to about 10% (w/w), from about 2% (w/w) to about 8% (w/w), from about 2% (w/w) to about 7% (w/w), from about 2% (w/w) to about 6% (w/w), from about 2% (w/w) to about 5% (w/w), from about 2% (w/w) to about 4% (w/w), or from about 2% (w/w) to about 3% (w/w). In some embodiments, the nicotine liquid formulations used for a low temperature vaporization device, i.e. an electronic cigarette, described herein have a nicotine concentration from about 3% (w/w) to about 20% (w/w), from about 3% (w/w) to about 18% (w/w), from about 3% (w/w) to about 15% (w/w), from about 3% (w/w) to about 12% (w/w), from about 3% (w/w) to about 10% (w/w), from about 3% (w/w) to about 8% (w/w), from about 3% (w/w) to about 7% (w/w), from about 3% (w/w) to about 6% (w/w), from about 3% (w/w) to about 5% (w/w), or from about 3% (w/w) to about 4% (w/w). In some embodiments, the nicotine liquid formulations used for a low temperature vaporization device, i.e. an electronic cigarette, described herein have a nicotine concentration from about 4% (w/w) to about 20% (w/w), from about 4% (w/w) to about 18% (w/w), from about 4% (w/w) to about 15% (w/w), from about 4% (w/w) to about 12% (w/w), from about 4% (w/w) to about 10% (w/w), from about 4% (w/w) to about 8% (w/w), from about 4% (w/w) to about 7% (w/w), from about 4% (w/w) to about 6% (w/w), or from about 4% (w/w) to about 5% (w/w). In some embodiments, the nicotine liquid formulations used for a low temperature vaporization device, i.e. an electronic cigarette, described herein have a nicotine concentration from about 5% (w/w) to about 20% (w/w), from about 5% (w/w) to about 18% (w/w), from about 5% (w/w) to about 15% (w/w), from about 5% (w/w) to about 12% (w/w), from about 5% (w/w) to about 10% (w/w), from about 5% (w/w) to about 8% (w/w), from about 5% (w/w) to about 7% (w/w), or from about 5% (w/w) to about 6% (w/w). In some embodiments, the nicotine liquid formulations used for a low temperature vaporization device, i.e. an electronic cigarette, described herein have a nicotine concentration from about 6% (w/w) to about 20% (w/w), from about 6% (w/w) to about 18% (w/w), from about 6% (w/w) to about 15% (w/w), from about 6% (w/w) to about 12% (w/w), from about 6% (w/w) to about 10% (w/w), from about 6% (w/w) to about 8% (w/w), or from about 6% (w/w) to about 7% (w/w). In some embodiments, the nicotine liquid formulations used for a low temperature vaporization device, i.e. an electronic cigarette, described herein have a nicotine concentration from about 2% (w/w) to about 6% (w/w). In some embodiments, the nicotine liquid formulations used for a low temperature vaporization device, i.e. an electronic cigarette, described herein have a nicotine concentration of about 5% (w/w).

In some embodiments, the formulation further may comprise one or more flavorants. In some embodiments, the flavor of the formulation is adjusted by changing the acid. In some embodiments, the flavor of the formulation is adjusted by adding exogenous flavorants. In some embodiments, an unpleasant tasting or smelling acid is used in minimal quantities to mitigate such characteristics. In some embodiments, exogenous pleasant smelling or tasting acid is added to the formulation. Examples of salts which can provide flavor and aroma to the mainstream aerosol at certain levels include nicotine acetate, nicotine oxalate, nicotine malate, nicotine isovalerate, nicotine lactate, nicotine citrate, nicotine phenylacetate and nicotine myristate.

In some embodiments, the suitable acid for the nicotine liquid formulation has a vapor pressure >20 mmHg at 200° C., and is non-corrosive to the electronic cigarette or is non-toxic to humans. In some embodiments, the suitable acid for nicotine salt formation is selected from the group consisting of salicylic acid, formic acid, sorbic acid, acetic acid, benzoic acid, pyruvic acid, lauric acid, and levulinic acid.

In some embodiments, the suitable acid for the nicotine liquid formulation has a vapor pressure of about 20 to 200 mmHg at 200° C., and is non-corrosive to the electronic cigarette or is non-toxic to humans. In some embodiments, the suitable acid for nicotine salt formation is selected from the group consisting of salicylic acid, benzoic acid, lauric acid, and levulinic acid.

In some embodiments, the suitable acid for the nicotine liquid formulation has a melting point <160° C., a boiling point >160° C., at least a 50-degree difference between the melting point and the boiling point, and is non-corrosive to the electronic cigarette or is non-toxic to humans. In some embodiments, the suitable acid for nicotine salt formation has a melting point at least 40 degrees lower than the operating temperature of the electronic cigarette, a boiling point no more than 40 degrees lower than the operating temperature of the electronic cigarette, at least a 50-degree difference between the melting point and the boiling point, and is non-corrosive to the electronic cigarette or is non-toxic to humans; wherein the operating temperature is 200° C. In some embodiments, the suitable acid for nicotine salt formation is selected from the group consisting of salicylic acid, sorbic acid, benzoic acid, pyruvic acid, lauric acid, and levulinic acid.

In some embodiments, the suitable acid for the nicotine liquid formulation does not decompose at the operating temperature of the electronic cigarette. In some embodiments, the suitable acid for nicotine salt formation does not oxidize at the operating temperature of the electronic cigarette. In some embodiments, the suitable acid for nicotine salt formation does not oxidize at room temperature. In some embodiments, the suitable acid for nicotine salt formation does not provide an unpleasant taste. In some embodiments, the suitable acid for nicotine salt formation has good solubility in a liquid formulation for use in low temperature electronic vaporization device, i.e. an electronic cigarette.

Figure 4:
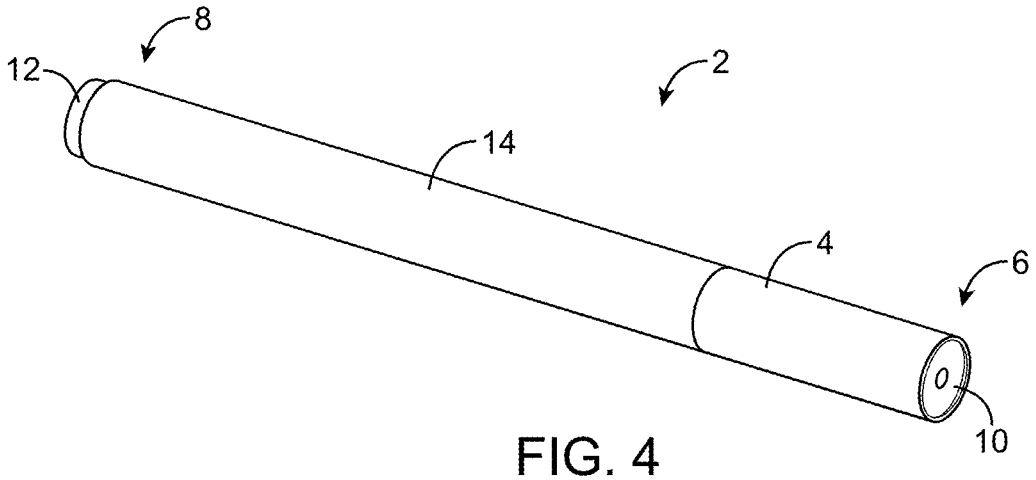
FIG. 4 depicts a non-limiting example of low temperature electronic vaporization device, i.e. an electronic cigarette, having a fluid storage compartment comprising an embodiment nicotine liquid formulation described herein.

Provided herein is low temperature electronic vaporization device, i.e. an electronic cigarette, 2 having a fluid storage compartment 4 comprising an embodiment nicotine liquid formulation of any embodiment described herein within the fluid storage compartment described herein. An embodiment is shown in FIG. 4. The electronic cigarette 2 of FIG. 4 includes a mouth end 6, and a charging end S. The mouth-end 6 includes a mouthpiece 10. The charging end 8 may connect to a battery or a charger or both, wherein the battery is within a body of the electronic cigarette, and the charger is separate from the battery and couples to the body or the battery to charge the battery. In some embodiments the electronic cigarette comprises a rechargeable battery within a body 14 of the electronic cigarette and the charge end 8 comprises a connection 12 for charging the rechargeable battery. In some embodiments, the electronic cigarette comprises a cartomizer that comprises the fluid storage compartment and an atomizer. In some embodiments, the atomizer comprises a heater. In some embodiments the fluid storage compartment 4 is separable from an atomizer. In some embodiments the fluid storage compartment 4 is replaceable as part of a replaceable cartridge. In some embodiments the fluid storage compartment 4 is refillable. In some embodiments, the mouthpiece 10 is replaceable.

Figure 5:
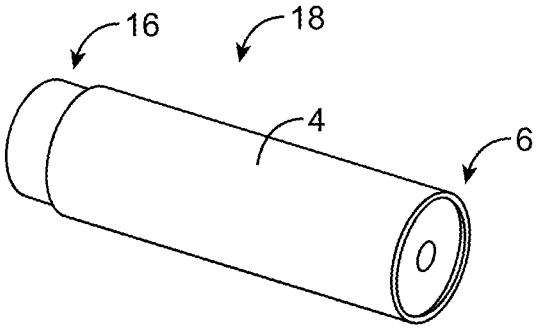
FIG. 5 depicts a non-limiting example of low temperature electronic vaporization device, i.e. an electronic cigarette, cartomizer having a fluid storage compartment, a heater, and comprising an embodiment nicotine liquid formulation described herein.

Provided herein is a cartomizer 18 for low temperature electronic vaporization device, i.e. an electronic cigarette, 2 having a fluid storage compartment 4 comprising an embodiment nicotine liquid formulation of any embodiment described herein within the fluid storage compartment described herein. The cartomizer 18 embodiment of FIG. 5 includes a mouth end 6, and a connection end 16. The connection end 16 in the embodiment of FIG. 5 couples the cartomizer 14 to a body of low temperature electronic vaporization device, i.e. an electronic cigarette, or to a battery of the electronic cigarette, or both. The mouth end 6 includes a mouthpiece 10. In some embodiments, the cartomizer does not include a mouthpiece, and in such embodiments, the cartomizer can be coupled to a mouthpiece of low temperature electronic vaporization device, i.e. an electronic cigarette, or the cartomizer can be coupled to a battery or body of low temperature electronic vaporization device, i.e. an electronic cigarette, while the mouthpiece is also coupled to the battery or the body of the electronic cigarette. In some embodiments, the mouthpiece is integral with the body of the electronic cigarette. In some embodiments, including the embodiment of FIG. 5, the cartomizer 18 comprises the fluid storage compartment 4 and an atomizer (not shown). In some embodiments, the atomizer comprises a heater (not shown).

EXAMPLES

Example 1: Preparation of Nicotine Liquid Formulations

Various nicotine liquid formulations were prepared and added to a solution of 3:7 ratio by weight of propylene glycol (PG)/vegetable glycerin (VG), and mixed thoroughly. The examples shown below were used to make 10 g of each of the formulations. All procedures are scalable.

For example, in order to make nicotine liquid formulations with a final nicotine free base equivalent concentration of 2% (w/w), the following procedures were applied to each individual formulation.

- Nicotine benzoate salt formulation: 0.15 g benzoic acid was added to a beaker followed by adding 0.2 g nicotine to the same beaker. The mixture was stirred at 55° C. for 20 minutes until benzoic acid was completely dissolved and an orange oily mixture was formed. The mixture was cooled down to ambient conditions. 9.65 g PG/VG (3:7) solution was added to the orange nicotine benzoate salt and the mixture was stirred until a visually homogenous formulation solution was achieved.
- Nicotine benzoate salt formulation can also be made by adding 0.15 g benzoic acid to a beaker followed by adding 0.2 g nicotine and 9.65 g PG/VG (3:7) solution to the same beaker. The mixture was then stirred at 55° C. for 20 minutes until a visually homogenous formulation solution was achieved with no undissolved chemicals.
- Nicotine citrate salt formulation was made by adding 0.47 g citric acid to a beaker followed by adding 0.2 g nicotine and 9.33 g PG/VG (3:7) solution to the same beaker. The mixture was then stirred at 90° C. for 60 minutes until a visually homogenous formulation solution was achieved with no undissolved chemicals.
- Nicotine malate salt formulation was made by adding 0.33 g Malic acid to a beaker followed by adding 0.2 g nicotine and 9.47 g PG/VG (3:7) solution to the same beaker. The mixture was then stirred at 90° C. for 60 minutes until a visually homogenous formulation solution was achieved with no undissolved chemicals.
- Nicotine succinate salt formulation was made by adding 0.29 g succinic acid to a beaker followed by adding 0.2 g nicotine and 9.51 g PG/VG (3:7) solution to the same beaker. The mixture was then stirred at 90° C. for 60 minutes until a visually homogenous formulation solution was achieved with no undissolved chemicals.

Nicotine salicylate salt formulation was made by adding 0.17 g salicylic acid to a beaker followed by adding 0.2 g nicotine and 9.63 g PG/VG (3:7) solution to the same beaker. The mixture was then stirred at 90° C. for 60 minutes until a visually homogenous formulation solution was achieved with no undissolved chemicals.

Nicotine salicylate salt formulation can also be made by adding 0.17 g salicylic acid to a beaker followed by adding 0.2 g nicotine to the same beaker. The mixture was stirred at 90° C. for 60 minutes until salicylic acid was completely dissolved and an orange oily mixture was formed. The mixture was either cooled to ambient conditions or kept at 90° C. when 9.63 g PG/VG (3:7) solution was added. The mixture was then stirred at 90° C. until a visually homogenous formulation solution was achieved with no undissolved chemicals.

Nicotine free base formulation was made by adding 0.2 g nicotine to a beaker followed by adding 9.8 g PG/VG (3:7) solution to the same beaker. The mixture was then stirred at ambient conditions for 10 minutes until a visually homogenous formulation solution was achieved.

For example, in order to make nicotine liquid formulations with a final nicotine free base equivalent concentration of 3% (w/w), the following procedures were applied to each individual formulation.

Nicotine benzoate salt formulation: 0.23 g benzoic acid was added to a beaker followed by adding 0.3 g nicotine to the same beaker. The mixture was stirred at 55° C. for 20 minutes until benzoic acid was completely dissolved and an orange oily mixture was formed. The mixture was cooled down to ambient conditions. 9.47 g PG/VG (3:7) solution was added to the orange nicotine benzoate salt and the blend was stirred until a visually homogenous formulation solution was achieved.

Nicotine benzoate salt formulation can also be made by adding 0.23 g benzoic acid to a beaker followed by adding 0.3 g nicotine and 9.47 g PG/VG (3:7) solution to the same beaker. The mixture was then stirred at 55° C. for 20 minutes until a visually homogenous formulation solution was achieved with no undissolved chemicals.

Nicotine citrate salt formulation was made by adding 0.71 g citric acid to a beaker followed by adding 0.3 g nicotine and 8.99 g PG/VG (3:7) solution to the same beaker. The mixture was then stirred at 90° C. for 60 minutes until a visually homogenous formulation solution was achieved with no undissolved chemicals.

Nicotine malate salt formulation was made by adding 0.5 g Malic acid to a beaker followed by adding 0.3 g nicotine and 9.2 g PG/VG (3:7) solution to the same beaker. The mixture was then stirred at 90° C. for 60 minutes until a visually homogenous formulation solution was achieved with no undissolved chemicals.

Nicotine levulinate salt formulation was made by adding melted 0.64 g levulinic acid to a beaker followed by adding 0.3 g nicotine to the same beaker. The mixture was stirred at ambient conditions for 10 minutes. Exothermic reaction took place and oily product was produced. The mixture was allowed to cool down to ambient temperature and 9.06 g PG/VG (3:7) solution was added to the same beaker. The mixture was then stirred at ambient conditions for 20 minutes until a visually homogenous formulation solution was achieved.

Nicotine pyruvate salt formulation was made by adding 0.33 g pyruvic acid to a beaker followed by adding 0.3 g nicotine to the same beaker. The mixture was stirred at ambient conditions for 10 minutes. Exothermic reaction took place and oily product was produced. The mixture was allowed to cool down to ambient temperature and 9.37 g PG/VG (3:7) solution was added to the same beaker. The mixture was then stirred at ambient conditions for 20 minutes until a visually homogenous formulation solution was achieved.

Nicotine succinate salt formulation was made by adding 0.44 g succinic acid to a beaker followed by adding 0.3 g nicotine and 9.26 g PG/VG (3:7) solution to the same beaker. The mixture was then stirred at 90° C. for 60 minutes until a visually homogenous formulation solution was achieved with no undissolved chemicals.

Nicotine salicylate salt formulation was made by adding 0.26 g salicylic acid to a beaker followed by adding 0.3 g nicotine and 9.44 g PG/VG (3:7) solution to the same beaker. The mixture was then stirred at 90° C. for 60 minutes until a visually homogenous formulation solution was achieved with no undissolved chemicals.

Nicotine salicylate salt formulation can also be made by adding 0.26 g salicylic acid to a beaker followed by adding 0.3 g nicotine to the same beaker. The mixture was stirred at 90° C. for 60 minutes until salicylic acid was completely dissolved and an orange oily mixture was formed. The mixture was either cooled to ambient conditions or kept at 90° C. when 9.44 g PG/VG (3:7) solution was added. The blend was then stirred at 90 C until a visually homogenous formulation solution was achieved with no undissolved chemicals.

Nicotine free base formulation was made by adding 0.3 g nicotine to a beaker followed by adding 9.7 g PG/VG (3:7) solution to the same beaker. The mixture was then stirred at ambient conditions for 10 minutes until a visually homogenous formulation solution was achieved.

For example, in order to make nicotine liquid formulations with a final nicotine free base equivalent concentration of 4% (w/w), the following procedures were applied to each individual formulation.

Nicotine benzoate salt formulation: 0.3 g benzoic acid was added to a beaker followed by adding 0.4 g nicotine to the same beaker. The mixture was stirred at 55° C. for 20 minutes until benzoic acid was completely dissolved and an orange oily mixture was formed. The mixture was cooled down to ambient conditions. 9.7 g PG/VG (3:7) solution was added to the orange nicotine benzoate salt and the blend was stirred until a visually homogenous formulation solution was achieved.

Nicotine benzoate salt formulation can also be made by adding 0.3 g benzoic acid to a beaker followed by adding 0.4 g nicotine and 9.7 g PG/VG (3:7) solution to the same beaker. The mixture was then stirred at 55° C. for 20 minutes until a visually homogenous formulation solution was achieved with no undissolved chemicals.

For example, in order to make nicotine liquid formulations with a final nicotine free base equivalent concentration of 5% (w/w), the following procedures were applied to each individual formulation.

Nicotine benzoate salt formulation: 0.38 g benzoic acid was added to a beaker followed by adding 0.5 g nicotine to the same beaker. The mixture was stirred at 55° C. for 20 minutes until benzoic acid was completely dissolved and an orange oily mixture was formed. The mixture was cooled down to ambient conditions. 9.12 g PG/VG (3:7) solution was added to the orange nicotine benzoate salt and the blend was stirred until a visually homogenous formulation solution was achieved.

Nicotine benzoate salt formulation can also be made by adding 0.38 g benzoic acid to a beaker followed by adding 0.5 g nicotine and 9.12 g PG/VG (3:7) solution to the same beaker. The mixture was then stirred at 55° C. for 20 minutes until a visually homogenous formulation solution was achieved with no undissolved chemicals.

Nicotine malate salt formulation was made by adding 0.83 g Malic acid to a beaker followed by adding 0.5 g nicotine and 8.67 g PG/VG (3:7) solution to the same beaker. The mixture was then stirred at 90° C. for 60 minutes until a visually homogenous formulation solution was achieved with no undissolved chemicals.

Nicotine levulinate salt formulation was made by adding melted 1.07 g levulinic acid to a beaker followed by adding 0.5 g nicotine to the same beaker. The mixture was stirred at ambient conditions for 10 minutes. Exothermic reaction took place and oily product was produced. The mixture was allowed to cool down to ambient temperature and 8.43 g PG/VG (3:7) solution was added to the same beaker. The mixture was then stirred at ambient conditions for 20 minutes until a visually homogenous formulation solution was achieved.

Nicotine pyruvate salt formulation was made by adding 0.54 g pyruvic acid to a beaker followed by adding 0.5 g nicotine to the same beaker. The mixture was stirred at ambient conditions for 10 minutes. Exothermic reaction took place and oily product was produced. The mixture was allowed to cool down to ambient temperature and 8.96 g PG/VG (3:7) solution was added to the same beaker. The mixture was then stirred at ambient conditions for 20 minutes until a visually homogenous formulation solution was achieved.

Nicotine succinate salt formulation was made by adding 0.73 g succinic acid to a beaker followed by adding 0.5 g nicotine and 8.77 g PG/VG (3:7) solution to the same beaker. The mixture was then stirred at 90° C. for 60 minutes until a visually homogenous formulation solution was achieved with no undissolved chemicals.

Nicotine salicylate salt formulation was made by adding 0.43 g salicylic acid to a beaker followed by adding 0.5 g nicotine and 9.07 g PG/VG (3:7) solution to the same beaker. The mixture was then stirred at 90° C. for 60 minutes until a visually homogenous formulation solution was achieved with no undissolved chemicals.

Nicotine salicylate salt formulation can also be made by adding 0.43 g salicylic acid to a beaker followed by adding 0.5 g nicotine to the same beaker. The mixture was stirred at 90° C. for 60 minutes until salicylic acid was completely dissolved and an orange oily mixture was formed. The mixture was either cooled to ambient conditions or kept at 90 C when 9.07 g PG/VG (3:7) solution was added. The blend was then stirred at 90° C. until a visually homogenous formulation solution was achieved with no undissolved chemicals.

Nicotine free base formulation was made by adding 0.5 g nicotine to a beaker followed by adding 9.5 g PG/VG (3:7) solution to the same beaker. The mixture was then stirred at ambient conditions for 10 minutes until a visually homogenous formulation solution was achieved.

Various formulations comprising different nicotine salts can be prepared similarly, or different concentrations of the above-noted nicotine liquid formulations or other nicotine liquid formulations can be prepared as one of skill in the art would know to do upon reading the disclosure herein.

Various formulations comprising two or more nicotine salts can be prepared similarly in a solution of 3:7 ratio of propylene glycol (PG)/vegetable glycerin (VG). For example, 0.43 g (2.5% w/w nicotine) of nicotine levulinate salt and 0.34 g (2.5% w/w nicotine) of nicotine acetate salt are added to 9.23 g of PG/VG solution, to achieve a 5% w/w nicotine liquid formulation.

Also provided is another exemplary formulation. For example, 0.23 g (1.33% w/w nicotine) of nicotine benzoate salt (molar ratio 1:1 nicotine/benzoic acid), 0.25 g (1.33% w/w nicotine) of nicotine salicylate salt (molar ratio 1:1 nicotine/salicylic acid) and 0.28 g (1.34% w/w nicotine) of nicotine pyruvate salt (molar ratio 1:2 nicotine/pyruvic acid) are added to 9.25 g of PG/VG solution, to achieve a 5% w/w nicotine liquid formulation.

Example 2: Heart Rate Study of Nicotine Solutions Via Electronic Cigarette

Exemplary formulations of nicotine levulinate, nicotine benzoate, nicotine succinate, nicotine salicylate, nicotine malate, nicotine pyruvate, nicotine citrate, nicotine freebase, and a control of propylene glycol were prepared as noted in Example 1 in 3% w/w solutions and were administered in the same fashion by low temperature electronic vaporization device, i.e. an electronic cigarette, to the same human subject. About 0.5 mL of each solution was loaded into an "eRoll" cartridge atomizer (joyetech.com) to be used in the study. The atomizer was then attached to an "eRoll" electronic cigarette (same manufacturer). The operating temperature was from about 150° C. to about 250° C., or from about 180° C. to about 220° C.

Heart rate measurements were taken for 6 minutes; from 1 minute before start of puffing, for 3 minutes during puffing, and continuing until 2 minutes after end of puffing. The test participant took 10 puffs over 3 minutes in each case. The base heart rate was the average heart rate over the first 1 minute before start of puffing. Heart rate after puffing started was averaged over 20-second intervals. Puffing (inhalation) occurred every 20 seconds for a total of 3 minutes. Normalized heart rate was defined as the ratio between individual heart rate data point and the base heart rate. Final results were presented as normalized heart rate, shown for the first 4 minutes in FIG. 1.

FIG. 1 summarizes results from heart rate measurements taken for a variety of nicotine liquid formulations. For ease of reference in reviewing FIG. 1, at the 180-second timepoint, from top to bottom (highest normalized heart rate to lowest normalized heart rate), the nicotine liquid formulations are as follows: nicotine salicylate formulation, nicotine malate formulation, nicotine levulinate formulation (nearly identical to nicotine malate formulation at 180 seconds, thus, as a second reference point: the nicotine malate formulation curve is lower than the nicotine levulinate formulation curve at the 160-second time point), nicotine pyruvate formulation, nicotine benzoate formulation, nicotine citrate formulation, nicotine succinate formulation, and nicotine free base formulation. The bottom curve (lowest normalized heart rate) at the 180-second timepoint is associated with the placebo (100% propylene glycol). The test formulations comprising a nicotine salt cause a faster and more significant rise in heart rate than the placebo. The test formulations comprising a nicotine salt also cause faster and more significant rise when compared with a nicotine freebase formulation with the same amount of nicotine by weight. In addition, the nicotine salts (e.g., nicotine benzoate and nicotine pyruvate) prepared from the acids having calculated vapor pressures between 20-200 mmHg at 200° C. (benzoic acid (171.66 mmHg), with the exception of pyruvic acid (having a boiling point of 165 C), respectively) cause a faster rise in heart rate than the rest. The nicotine salts (e.g., nicotine levulinate, nicotine benzoate, and nicotine salicylate) prepared from the acids (benzoic acid, levulinic acid and salicylic acid, respectively) also cause a more significant heart rate increase. Thus, other suitable nicotine salts formed by the acids with the similar vapor pressure and/or similar boiling point may be used in accordance with the practice of the present invention. This experience of increased heart rate theoretically approaching or theoretically comparable to that of a traditional burned cigarette has not been demonstrated or identified in other electronic cigarette devices. Nor has it been demonstrated or identified in low temperature tobacco vaporization devices (electronic cigarettes) that do not burn the tobacco, even when a nicotine salt was used (a solution of 20% (w/w) or more of nicotine salt) as an additive to the tobacco. Thus the results from this experiment are surprising and unexpected.

Example 3: Satisfaction Study of Nicotine Salt Solution Via Electronic Cigarette In addition to the heart rate study shown in Example 2, nicotine liquid formulations (using 3% w/w nicotine liquid formulations as described in Example 1) were used to conduct a satisfaction study using 11 test participants. The test participant, low temperature electronic vaporization device. i.e. an electronic cigarette, and/or traditional cigarette user, was required to have no nicotine intake for at least 12 hour % before the test. The participant took 10 puffs using low temperature electronic vaporization device, i.e. an electronic cigarette, (same as used in Example 2) over 3 minutes in each case, and then was asked to rate the level of physical and emotional satisfaction he or she felt on a scale of 0-10, with 0 being no physical or emotional satisfaction. Using the ratings provided for each formulation, the formulations were then ranked from 1-8 with 1 having the highest rating and 8 having the lowest rating. The rankings for each acid were then averaged over the 11 participant to generate average rankings in Table 1. Nicotine benzoate, nicotine pyruvate, nicotine salicylate, and nicotine levulinate all performed well, followed by nicotine malate, nicotine succinate, and nicotine citrate.

TABLE 1

| % Nicotine (w/w) | Salt (molar ratio nicotine:acid) | Avg. Rank |
|---|---|---|
| 3% | Benzoaic (1:1) | 2.9 |
| 3% | Pyruvate (1:2) | 3.3 |
| 3% | Salicylate (1:1) | 3.6 |
| 3% | Levulinate (1:3) | 4.1 |
| 3% | Malate (1:2) | 4.1 |
| 3% | Succinate (1:2) | 4.4 |

TABLE 1-continued

| % Nicotine (w/w) | Salt (molar ratio nicotine:acid) | Avg. Rank |
|---|---|---|
| 3% | Citrate (1:2) | 5.9 |
| 3% | Freebase (NA) | 6.6 |

Based on the Satisfaction Study, the nicotine salts formulations with acids having vapor pressure ranges between >20 mmHg @200° C., or 20-200 mmHg @200° C., or 100-300 mmHg @200° C. provide more Satisfaction than the rest (except the pyruvic acid which has boiling point of 165° C.). For reference, it has been determined that salicylic acid has a vapor pressure of about 135.7 mmHg @200° C., benzoic acid has a vapor pressure of about 171.7 mmHg @200° C., and levulinic acid has a vapor pressure of about 149 mmHg @200° C.

Further, based on the Satisfaction Study, nicotine liquid formulations, for example a nicotine salt liquid formulations, comprising acids that degrade at the operating temperature of the device (i.e. malic acid) were ranked low. However, nicotine liquid formulations, for example a nicotine salt liquid formulations, comprising acids that do not degrade at the operating temperature of the device (i.e. benzoic acid) were ranked high. Thus, acids prone to degradation at the operating temperature of the device are less favorable compared to acids not prone to degradation.

Example 4: Test Formulation 1 (TF1)

A solution of nicotine levulinate in glycerol comprising nicotine salt used: 1.26 g (12.6% w/w) of 1:3 nicotine levulinate 8.74 g (87.4% w/w) of glycerol—Total weight 10.0 g.

Neat nicotine levulinate was added to the glycerol, and mixed thoroughly. L-Nicotine has a molar mass of 162.2 g, and levulinic acid molar mass is 116.1 g. In a 1:3 molar ratio, the percentage of nicotine in nicotine levulinate by weight is given by: 162.2 g/(162.2 g+(3×116.1 g))=31.8% (w/w).

Example 5: Test Formulation 2 (TF2)

A solution of free base nicotine in glycerol comprising 0.40 g (4.00% w/w) of L-nicotine was dissolved in 9.60 g (96.0% w/w) of glycerol and mixed thoroughly.

Example 6: Heart Rate Study of Nicotine Solutions Via Electronic Cigarette

Both formulations (TF1 and TF2) were administered in the same fashion by low temperature electronic vaporization device, i.e. an electronic cigarette, to the same human subject; about 0.6 mL of each solution was loaded into "eGo-C" cartridge atomizer (joyetech.com). The atomizer was then attached to an "Vic" electronic cigarette (same manufacturer). This model of electronic cigarette allows for adjustable voltage, and therefore wattage, through the atomizer. The operating temperature of the electronic cigarette is from about 150° C. to about 250° C., or from about 180° C. to about 220° C.

The atomizer in both cases has resistance 2.4 ohms, and the electronic cigarette was set to 4.24V, resulting in 7.49 W of power. (P=V^2/R)

Heart rate was measured in a 30-second interval for ten minutes from start of puffing. Test participants took 10 puffs over 3 minutes in each case (solid line ($2^{nd}$ highest peak): cigarette, dark dotted line (highest peak): test formulation 1

(TF1—nicotine liquid formulation), light dotted line: test formulation 2 (TF2—nicotine liquid formulation). Comparison between cigarette, TF1, and TF2 is shown in FIG. 2.

Figure 2:
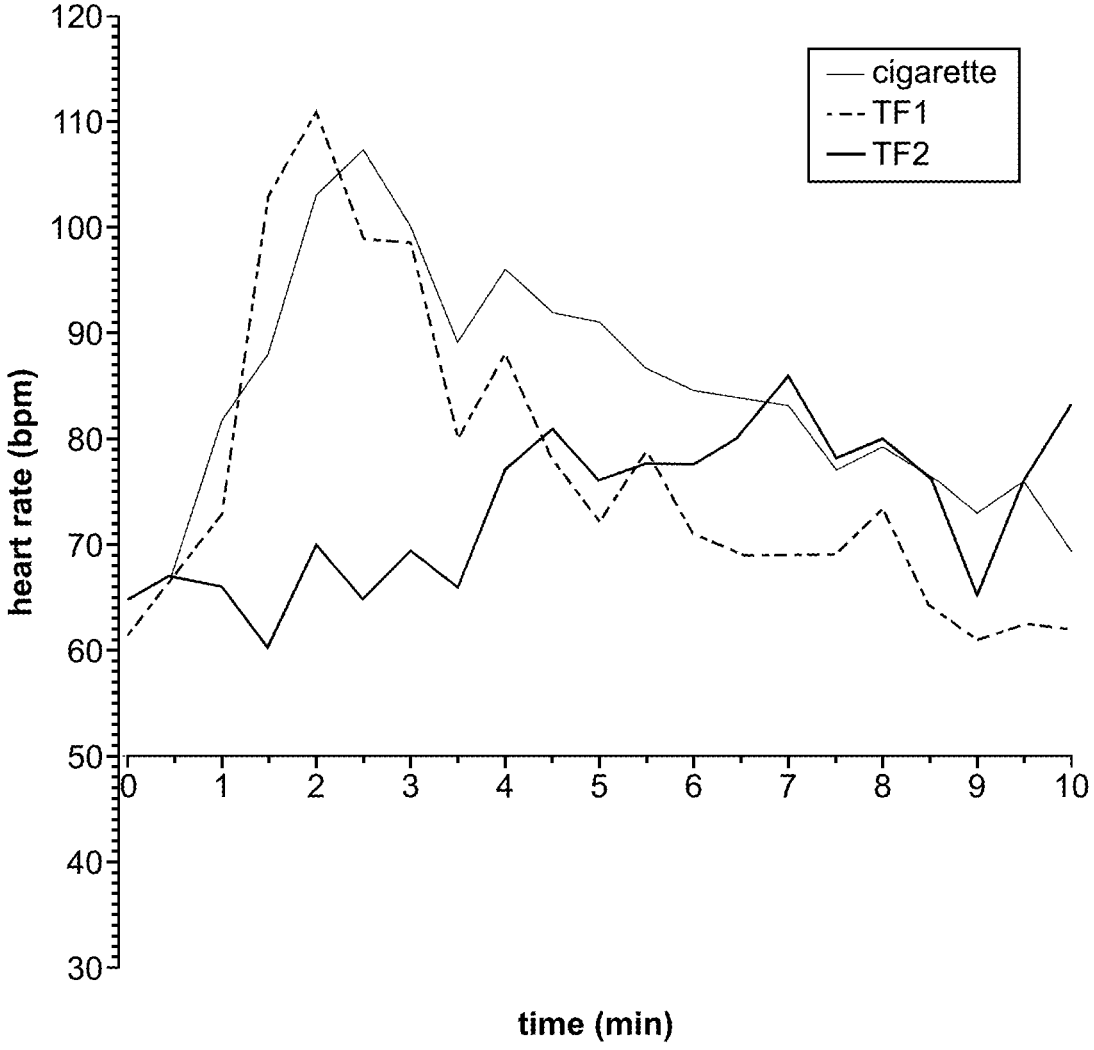
FIG. 2 illustrates results of heart rate data measured for ten minutes from start of puffing. Y-axis is heart rate (bpm) and X-axis represents duration of the test (0 to 10 minutes)

It is clearly shown in FIG. 2 that the test formulation with nicotine levulinate (TF1) causes a faster rise in heart rate than just nicotine (TF2). Also, TF1 more closely resembles the rate of increase for a cigarette. Other salts were tried and also found to increase heart rate relative to a pure nicotine solution. Thus, other suitable nicotine salts that cause the similar effect may be used in accordance with the practice of the present invention. For example, other keto acids (alpha-keto acids, beta-keto acids, gamma-keto acids, and the like) such as pyruvic acid, oxaloacetic acid, acetoacetic acid, and the like. This experience of increased heart rate comparable to that of a traditional burned cigarette has not been demonstrated or identified in other electronic cigarette devices, nor has it been demonstrated or identified in low temperature tobacco vaporization devices that do not burn the tobacco, even when a nicotine salt was used (a solution of 20% (W/W) or more of nicotine salt) as an additive to the tobacco. Thus the results from this experiment are surprising and unexpected.

In addition, the data appears to correlate well with the previous findings shown in FIG. 2.

As previously noted in the Satisfaction Study, the nicotine salts formulations with acids having vapor pressures between 20-300 mmHg @200° C. provide more satisfaction than the rest, with the exception of the nicotine liquid formulation made with pyruvic acid, which has a boiling point of 165° C., as noted in FIG. 3. Further, based on the Satisfaction Study, nicotine liquid formulations, for example a nicotine salt liquid formulations, comprising acids that degrade at the operating temperature of the device (i.e. malic acid) were ranked low, and nicotine liquid formulations, for example a nicotine salt liquid formulations, comprising acids that do not degrade at the operating temperature of the device (i.e. benzoic acid) were ranked high. Thus, acids prone to degradation at the operating temperature of the device are less favorable compared to acids not prone to degradation. Based on the findings herein, it was anticipated that these nicotine liquid formulations having one or more of the following properties:

- a Vapor Pressure between 20 . . . 300 mmHg @200° C.,
- a Vapor Pressure >20 mmHg @200° C.,
- a difference between boiling point and melting point of at least 50° C., and a boiling point greater than 160° C., and a melting point less than 160° C.,
- a difference between boiling point and melting point of at least 50° C., and a boiling point greater than 160° C., and a melting point less than 160° C.,
- a difference between boiling point and melting point of at least 50° C., and a boiling point at most 40° C. less than operating temperature, and a melting point at least 40° C. lower than operating temperature, and
- resistant to degradation at the operating temperature of the device.

$T_{max}$—Time to maximum blood concentration: Based on the results established herein, a user of low temperature electronic vaporization device, i.e. an electronic cigarette, comprising the nicotine liquid formulation will experience a comparable rate of physical and emotional satisfaction from using a formulation comprising a mixture of nicotine salts prepared with an appropriate acid at least 1.2× to 3× faster than using a formulation comprising a freebase nicotine. As illustrated in FIG. 1: Nicotine from a nicotine salts formulation appears to generate a heartbeat that is nearly 1.2 times that of a normal heart rate for an individual approximately 40 seconds after the commencement of puffing; whereas the nicotine from a nicotine freebase formulation appears to generate a heartbeat that is nearly 1.2 times that of a normal heart rate for an individual approximately 110 seconds after the commencement of puffing: a 2.75× difference in time to achieve a comparable initial satisfaction level.

Again this would not be inconsistent with the data from FIG. 2, where the data illustrated that at approximately 120 seconds (2 minutes), the heart rate of test participants reached a maximum of 105-110 bpm with either a regular cigarette or a nicotine liquid formulation (TF1); whereas those same participants heart rates only reached a maximum of approximately 86 bpm at approximately 7 minutes with a nicotine freebase formulation (TF2); also a difference in effect of 1.2 times greater with nicotine salts (and regular cigarettes) versus freebase nicotine.

Further, when considering peak satisfaction levels (achieved at approximately 120 seconds from the initiation of puffing (time=0) and looking at the slope of the line for a normalized heart rate, the approximate slope of those nicotine liquid formulations that exceeded the freebase nicotine liquid formulation range between 0.0054 $hr_n$/sec and 0.0025 $hr_n$/sec. By comparison, the slope of the line for the freebase nicotine liquid formulation is about 0.002. This would suggest that the concentration of available nicotine will be delivered to the user at a rate that is between 1.25 and 2.7 times faster than a freebase formulation.

In another measure of performance; $C_{max}$—Maximum blood nicotine concentration; it is anticipated that similar rates of increase will be measured in blood nicotine concentration, as those illustrated above. That is, it was anticipated based on the findings herein, and unexpected based on the art known to date, that there would be comparable $C_{max}$ between the common cigarette and certain nicotine liquid formulations, but with a lower $C_{max}$ in a freebase nicotine solution.

Similarly, anticipated based on the findings herein, and unexpected based on the art known to date, that certain nicotine liquid formulations would have higher rate of nicotine uptake levels in the blood at early time periods. Indeed, Example 8 presents data for two salt formulations consistent with these predictions which were made based on the findings and tests noted herein, and unexpected compared to the art available to date.

Example 7: Heart Rate Study of Nicotine Solutions Via Electronic Cigarette

Exemplary formulations of nicotine levulinate, nicotine benzoate, nicotine succinate, nicotine salicylate, nicotine malate, nicotine pyruvate, nicotine citrate, nicotine sorbate, nicotine laurate, nicotine freebase, and a control of propylene glycol are prepared as noted in Example 1 and are administered in the same fashion by low temperature electronic vaporization device, i.e. an electronic cigarette, to the same human subject. About 0.5 mL of each solution is loaded into an "eRoll" cartridge atomizer (joyetech.com) to be used in the study. The atomizer is then attached to an "eRoll" electronic cigarette (same manufacturer). The operating temperature of the electronic cigarette is from about 150° C. to about 250° C., or from about 180° C. to about 220° C.

Heart rate measurements are taken for 6 minutes; from 1 minute before start of puffing, for 3 minutes during puffing, and continuing until 2 minutes after end of puffing. The test participant takes 10 puffs over 3 minutes in each case. The base heart rate is the average heart rate over the first 1 minute before start of puffing. Heart rate after puffing started is averaged over 20-second intervals. Normalized heart rate is defined as the ratio between individual heart rate data point and the base heart rate. Final results are presented as normalized heart rate.

Example 9: Blood Plasma Testing

Blood plasma testing was conducted on 24 subjects (n=24). Four test articles were used in this study: one reference cigarette and three nicotine liquid formulations used in low temperature electronic vaporization device, i.e. an electronic cigarette, having an operating temperature of the electronic cigarette from about 150° C. to about 250° C., or from about 180° C. to about 220° C. The reference cigarette was Pall Mall (New Zealand). Three nicotine liquid formulations were tested in the electronic cigarette: 2% free base (w/w based on nicotine), 2% benzoate (w/w based on nicotine, 1:1 molar ratio of nicotine to benzoic acid), and 2% malate (w/w based on nicotine, 1:2 molar ratio of nicotine to malic acid). The three nicotine liquid formulations were liquid formulations prepared as described in Example 1.

The concentration of nicotine in each of the formulations was confirmed using UV spectrophotometer (Cary 60, manufactured by Agilent). The sample solutions for UV analysis were made by dissolving 20 mg of each of the formulations in 20 mL 0.3% HCl in water. The sample solutions were then scanned in UV spectrophotometer and the characteristic nicotine peak at 259 nm was used to quantify nicotine in the sample against a standard solution of 19.8 μg/mL nicotine in the same diluent. The standard solution was prepared by first dissolving 19.8 mg nicotine in 10 mL 0.3% HCl in water followed by a 1:100 dilution with 0.3% HCl in water. Nicotine concentrations reported for all formulations were within the range of 95%-105% of the claimed concentrations All subjects were able to consume 30-55 mg of the liquid formulation of each tested blend using the electronic cigarette.

Literature results: C. Bullen et al, Tobacco Control 2010, 19:98-103

Cigarette (5 min adlib, n=9): $T_{max}$=14.3 (8.8-19.9), $C_{max}$=13.4 (6.5-20.3)

1.4% E-cig (5 min adlib, n=8): $T_{max}$=19.6 (4.9-34.2), $C_{max}$=1.3 (0.0-2.6)

Nicorette Inhalator (20 mg/20 min, n=10): $T_{max}$=32.0 (18.7-45.3), $C_{max}$=2.1 (1.0-3.1)

Estimated $C_{max}$ of 2% nicotine blends:

$C_{max}$=Mass consumed*Strength*Bioavailability/(Vol of Distribution*Body Weight)=40 mg*2%*80%/(2.6 L/kg*75 kg)=3.3 ng/ml, Estimated $C_{max}$ of 4% nicotine blends:

$C_{max}$=Mass consumed*Strength*Bioavailability/(Vol of Distribution*Body Weight)=40 mg*4%*80%/(2.6 L/kg*75 kg)=6.6 ng/mL.

Figure 6:
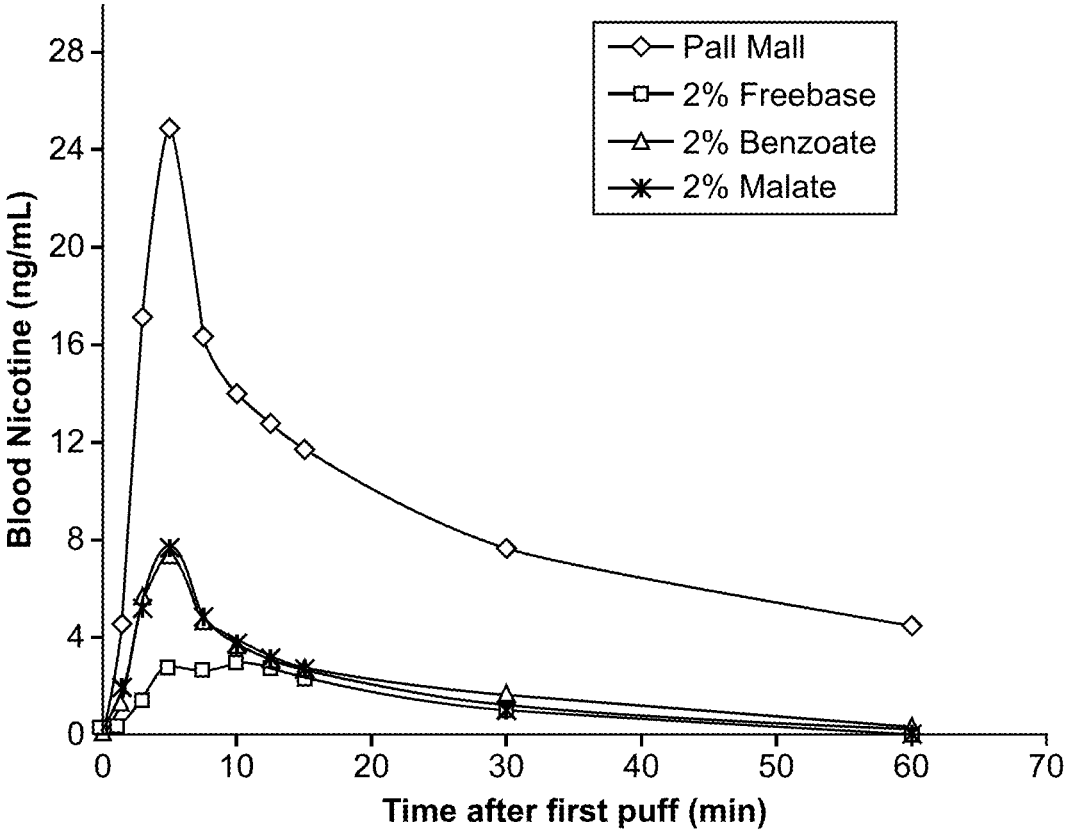
FIG. 6 depicts a non-limiting example of pharmacokinetic profiles for four test articles in a blood plasma study.

Pharmacokinetic profiles of the blood plasma testing are shown in FIG. 6; showing blood nicotine concentrations (ng/mL) over time after the first puff (inhalation) of the aerosol from the electronic cigarette or the smoke of the reference cigarette. Ten puffs were taken at 30 sec intervals starting at time=0 and continuing for 4.5 minutes. It is likely based on the data shown in FIG. 6 and in other studies herein that the freebase formulation is statistically different from salt formulations and/or the reference cigarette with respect to $C_{max}$, since it appears lower than others tested at several time points. Moreover, one of skill in the art, upon review of the disclosure herein could properly power a test to determine actual statistically-based differences between one or more formulations and the cigarette, or between the formulations themselves in low temperature electronic vaporization device, i.e. an electronic cigarette. For ease of reference Table 2 presents the amount of nicotine detected (as an average of all users) for each formulation and the reference cigarette, presented in ng/mL, along with $C_{max}$ and $T_{max}$. Data from these tables, along with the raw data therefore, was used to generate FIGS. 6, 7, and 8.

TABLE 2

| Time | Pall Mall | 2% Freebase | 2% Benzoate | 2% Malate |
|---|---|---|---|---|
| −2 | 0.07 | −0.14 | 0.02 | 0.10 |
| 0 | −0.03 | 0.14 | −0.03 | −0.15 |
| 1.5 | 4.54 | 0.22 | 1.43 | 1.91 |
| 3 | 17.12 | 1.50 | 5.77 | 5.18 |
| 5 | 24.85 | 2.70 | 7.35 | 7.65 |
| 7.5 | 16.36 | 2.60 | 4.73 | 4.79 |
| 10 | 13.99 | 2.87 | 3.90 | 3.71 |
| 12.5 | 12.80 | 2.79 | 3.11 | 3.10 |
| 15 | 11.70 | 2.30 | 2.79 | 2.64 |
| 30 | 7.65 | 1.14 | 1.64 | 1.06 |
| 60 | 4.47 | 0.04 | 0.37 | 0.06 |
| $T_{max}$ (min) | 6.15 | 9.48 | 8.09 | 5.98 |
| $C_{max}$ (ng/mL) | 29.37 | 4.56 | 9.27 | 8.75 |

Figure 7:
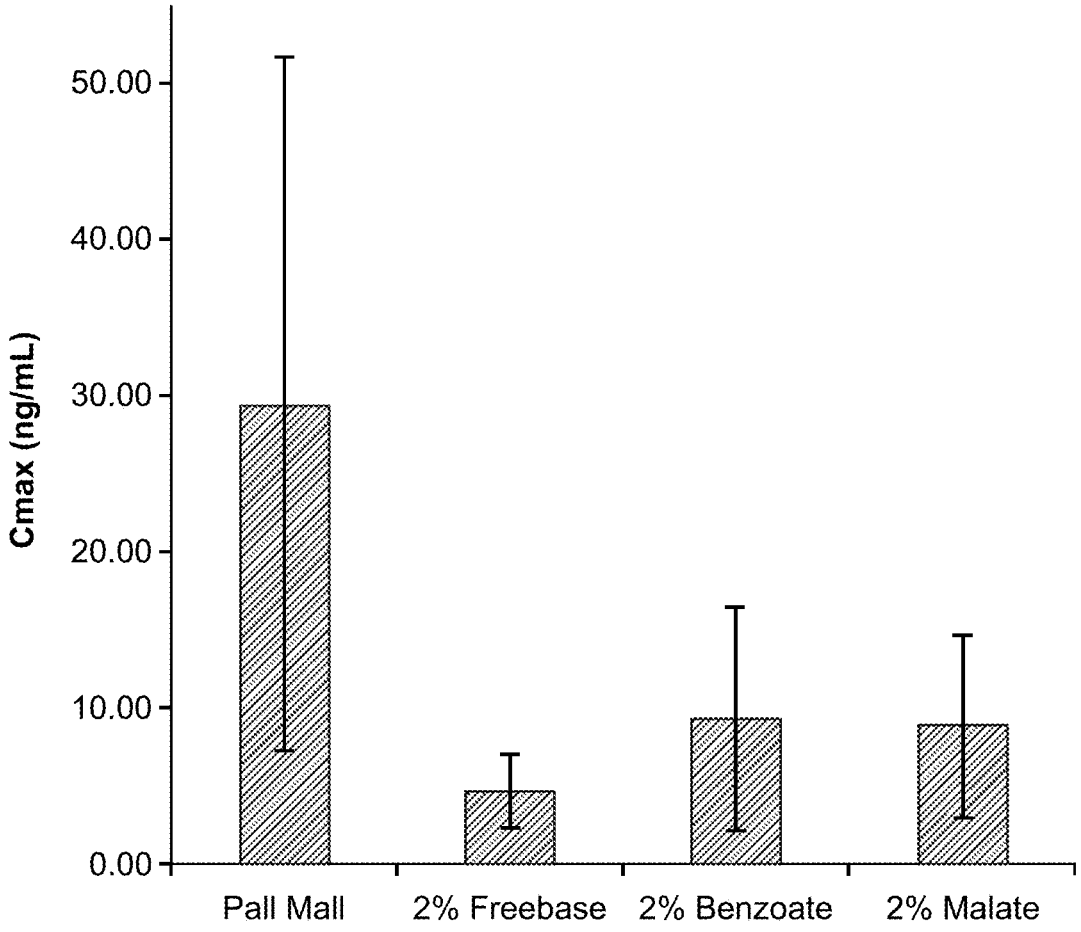
FIG. 7 depicts a non-limiting example of $C_{max}$ for four test articles in a blood plasma study.
Figure 8:
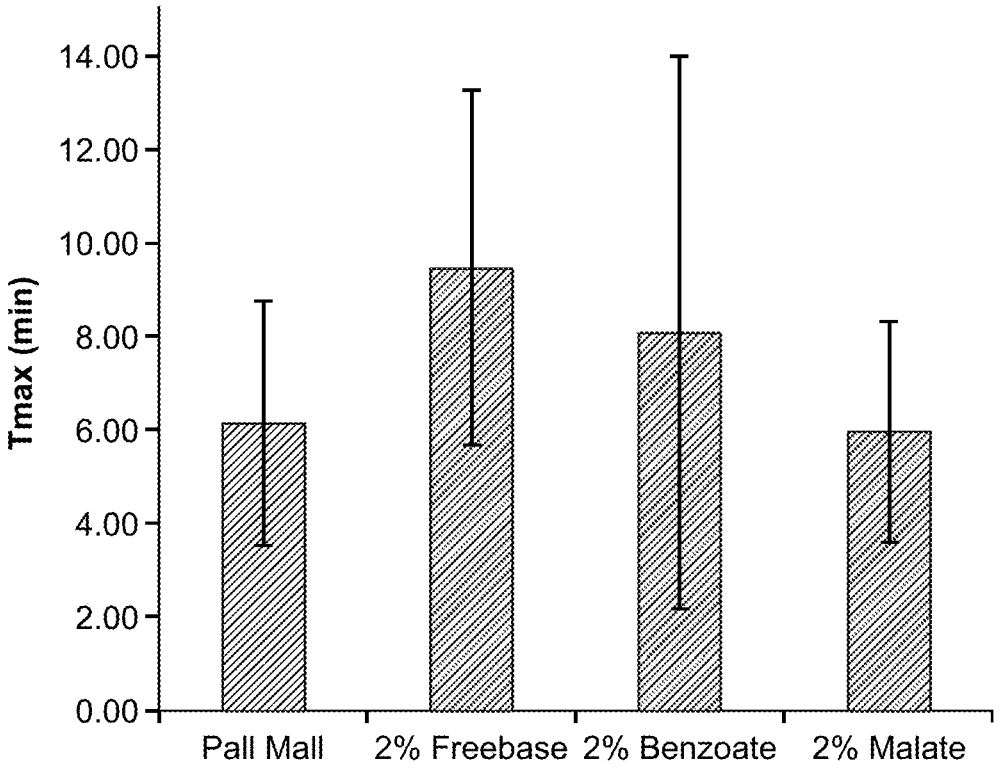
FIG. 8 depicts a non-limiting example of $T_{max}$ for four test articles in a blood plasma study.

Comparison of and $C_{max}$ and $T_{max}$ of the three nicotine liquid formulations and reference cigarette are shown in FIG. 7. Due to the time limit of the wash-period, baseline blood nicotine concentration (at t=−2 and t=0 min) was higher for samples consumed at a later time on the test day. The data in FIGS. 6-7 show corrected blood nicotine concentration values (i.e. apparent blood nicotine concentration at each time point minus baseline nicotine concentration of the same sample). FIG. 8 depicts $T_{max}$ data calculated using the corrected blood nicotine concentration. The reference cigarette, nicotine liquid formulation comprising nicotine benzoate, and nicotine liquid formulation comprising nicotine malate all exhibited a higher $C_{max}$ and lower $T_{max}$ than the nicotine liquid formulation comprising freebase nicotine. The superior performance of the nicotine liquid formulations comprising nicotine benzoate and nicotine malate compared to freebase nicotine is likely due to the superior transfer efficiency of the nicotine salt from the liquid to the aerosol compared to freebase nicotine, which allows nicotine to be delivered more efficiently to the user's lungs and/or alveoli of the user's lungs.

The nicotine liquid formulation contents and properties of the acids tested provide a plausible explanation as to how the blood plasma testing data corroborate the lower ranking of malic acid compared to benzoic acid as described in Example 1. In the blood plasma experiments the nicotine malate formulation comprised a 1:2 molar ratio of nicotine to malic acid and the nicotine benzoate formulation comprised a 1:1 molar ratio of nicotine to benzoic acid. As explained below, extra malic acid is needed to aerosolize nicotine because malic acid degrades at the operating temperature of the electronic cigarette. Thus, it is probable that the aerosol generated using malic acid comprises degradation products, which could result in an unfavorable experience for a user thus resulting in a lower ranking. For example, an unfavorable experience comprises a flavor, a nervous response, and/or an irritation of one or more of an oral cavity, an upper respiratory tract, and/or the lungs.

Example 9: Blood Plasma Testing

Blood plasma testing is conducted on 24 subjects (n=24). Eight test articles are used in this study: one reference cigarette and seven blends delivered to a user in low temperature electronic vaporization device, i.e. an electronic cigarette, as an aerosol. The operating temperature of the electronic cigarette is from about 150° C. to about 250° C., or from about 180° C. to about 220° C. The reference cigarette is Pall Mall (New Zealand). Seven blends are tested: 2% free base, 2% benzoate, 4% benzoate, 2% citrate, 2% malate, 2% salicylate, and 2% succinate. The seven blends are liquid formulations prepared according to protocols similar to that described infra and in Example 1.

All subjects are to consume 30-55 mg of the liquid formulation of each tested blend. Ten puffs are to be taken at 30 sec intervals starting at time=0 and continuing for 4.5 minutes. Blood plasma testing is to occur for at least 60 minutes from the first puff (t=0) Pharmacokinetic data (e.g., $C_{max}$, $T_{max}$, AUC) for nicotine in the plasma of users are obtained at various time periods during those 60 minutes, along with rates of nicotine absorption within the first 90 seconds for each test article.

Example 10: Blood Plasma Testing

Blood plasma testing is conducted on twenty-four subjects (n=24). Eleven test articles are used in this study: one reference cigarette and ten blends delivered to a user in low temperature electronic vaporization device, i.e. an electronic cigarette, as an aerosol. The reference cigarette is Pall Mall (New Zealand). The operating temperature of the electronic cigarette is from about 150° C. to about 250° C., or from about 180° C. to about 220° C. Ten blends are tested: 2% free base, 2% benzoate, 2% sorbate, 2% pyruvate, 2% laurate, 2% levulinate, 2% citrate, 2% malate, 2% salicylate, and 2% succinate. The ten blends are liquid formulations prepared according to protocols similar to that described infra and in Example 1.

All subjects are to consume 30-55 mg of the liquid formulation of each tested blend. Ten puffs are to be taken at 30 sec intervals starting at time=0 and continuing for 4.5 minutes. Blood plasma testing is to occur for at least 60 minutes from the first puff (t=0). Pharmacokinetic data (e.g., $C_{max}$, $T_{max}$, AUC) for nicotine in the plasma of users are obtained at various time periods during those 60 minutes, along with rates of nicotine absorption within the first 90 seconds for each test article.

Example 11: Blood Plasma Testing

Blood plasma testing is conducted on twenty-four subjects (n=24). Twenty-one test articles are used in this study: one reference cigarette and twenty blends delivered to a user in low temperature electronic vaporization device, i.e. an electronic cigarette, as an aerosol. The reference cigarette is Pall Mall (New Zealand). The operating temperature of the electronic cigarette is from about 150° C. to about 250° C., or from about 180° C. to about 220° C. Twenty blends are tested: 2% free base, 4% free base, 2% benzoate, 4% benzoate, 2% sorbate, 4% sorbate, 2% pyruvate, 4% pyruvate, 2% laurate, 4% laurate, 2% levulinate, 4% levulinate, 2% citrate, 4% citrate, 2% malate, 4% malate, 2% salicylate, 4% salicylate, 2% succinate, and 4% succinate. The twenty blends are liquid formulations prepared according to protocols similar to that described infra and in Example 1.

All subjects are to consume 30-55 mg of the liquid formulation of each tested blend. Ten puffs are to be taken at 30 sec intervals starting at time=0 and continuing for 4.5 minutes. Blood plasma testing is to occur for at least 60 minutes from the first puff (t=0). Pharmacokinetic data (e.g., $C_{max}$, $T_{max}$, AUC) for nicotine in the plasma of users are obtained at various time periods during those 60 minutes, along with rates of nicotine absorption within the first 90 seconds for each test article.

Example 12: Blood Plasma Testing

Blood plasma testing is conducted on twenty-four subjects (n=24). Twenty-one test articles are used in this study: one reference cigarette and twenty blends delivered to a user in low temperature electronic vaporization device, i.e. an electronic cigarette, as an aerosol. The reference cigarette is Pall Mall (New Zealand). The operating temperature of the electronic cigarette is from about 150° C. to about 250° C., or from about 180° C. to about 220° C. Twenty blends are tested: 2% free base, 1% free base, 2% benzoate, 1% benzoate, 2% sorbate, 1% sorbate, 2% pyruvate, 1% pyruvate, 2% laurate, 1% laurate, 2% levulinate, 1% levulinate, 2% citrate, 1% citrate, 2% malate, 1% malate, 2% salicylate, 1% salicylate, 2% succinate, and 1% succinate. The twenty blends are liquid formulations prepared according to protocols similar to that described infra and in Example 1.

All subjects are to consume 30-55 mg of the liquid formulation of each tested blend. Ten puffs are to be taken at 30 sec intervals starting at time=0 and continuing for 4.5 minutes. Blood plasma testing is to occur for at least 60 minutes from the first puff (t=0). Pharmacokinetic data (e.g., $C_{max}$, $T_{max}$, AUC) for nicotine in the plasma of users are obtained at various time periods during those 60 minutes, along with rates of nicotine absorption within the first 90 seconds for each test article.

Example 13: Aerosolized Nicotine Salt Testing

The experimental system comprised a glass bubbler (bubbler-1), a Cambridge filter pad, and 2 glass bubblers (trap-1 and trap-2, connected in sequence) to trap any volatiles that pass through the filter pad. Low temperature electronic vaporization device, i.e. an electronic cigarette, was connected to the inlet of bubbler 1, and was activated by a smoking machine connected to the outlet of trap 2 under designed puffing regime. The puffing regime comprised: Number of puffs per sample=30, puff size=60 cc, puff duration=4 s. The trap solvent comprised 0.3% HCl in water. The nicotine liquid formulations tested were: freebase nicotine, nicotine benzoate at molar ratios of nicotine to acid of 1:0.4, 1:0.7, 1:1, and 1:1.5, and nicotine malate at molar ratios of nicotine to acid of 1:0.5 and 1:2. The formulations were generated using the procedures described in Example 1. In the experimental system gaseous (i.e. vapor) analytes were capture by the bubblers.

The procedure comprised:

weighing the following parts prior to the start of puffing: the electronic cigarette filled with nicotine liquid formulation, the bubbler-1 filled with 35 mL trap solvent, a clean filter pad and pad holder, the trap-1 filled with 20 mL trap solvent, and trap-2 filled with 20 mL trap solvent;

connecting in the following sequence: the electronic cigarette, bubbler-1, the filter pad, trap-1, trap-2, and the smoking machine;

smoking was conducted under the aforementioned puffing regime. A clean air puff of the same puff size and duration was done after each smoking puff;

weighing all parts after the end of the puffing regime. The inlet tubing of bubbler-1 was assayed with 10 mL of trap solvent in aliquots of 1 mL. The total solvent amount in bubbler-1 after puffing was calculated with the correction of water loss from 60 puffs. The filter pad was cut in half and each half was extracted in 20 mL trap solvent for 2 hours. The pad extract was filtered through 0.2 μm Nylon syringe filter. The front half of the pad holder was assayed with 5 mL trap solvent. The back half of the pad holder was assayed with 3 mL trap solvent;

analyzing solutions by UV-Vis spectroscopy. The absorbance at 259 nm was used to calculate the nicotine concentration. The absorbance at 230 nm was used to calculate the benzoic acid concentration. Malic acid was quantified using Malic acid UV test kit from NZYTech Inc.

Results and Discussions

Analyte Recovery

The total recovered amount of each analyte (nicotine, benzoic acid, and malic acid) was calculated as the sum of the assayed amount from all parts. No analyte was detected in trap-1 or trap-2. The percent recovery was calculated by dividing the total recovered amount by the theoretical amount generated by the electronic cigarette. Table 3 shows the percent recovery of nicotine in nicotine freebase liquid formulations, nicotine benzoate liquid formulations, and nicotine malate liquid formulations. Table 3 also shows the percent recovery of benzoic acid in nicotine benzoate liquid formulations and the percent recovery of malic acid in nicotine malate liquid formulations.

TABLE 3

| Analyte Measured | % Recovery |
|---|---|
| Nicotine (nicotine freebase liquid formulations) | 80.2 ± 1.3 |
| Nicotine (nicotine benzoate liquid formulations) | 90.4 ± 3.4 |
| Benzoic acid (nicotine benzoate liquid formulations) | 91.8 ± 3.5 |
| Nicotine (nicotine malate liquid formulations) | 92.1 ± 4.9 |
| malic acid (nicotine malate liquid formulations) | 46.4 ± 8.1 |

The percent recovery of malic acid was significantly lower than that of nicotine and benzoic acid, with a larger variability across sample replicates. Malic acid was reported to thermally decompose at 150° C. a temperature that is lower than common electronic cigarette operating temperature. The low recovery of malic acid found in the aerosol agrees with the thermal instability of malic acid. This leads to low effective nicotine to malic ratio in the aerosol compared to the ratio in the nicotine liquid formulation. Thus the protonation state of nicotine is also lower in the aerosol which will result in effectively less nicotine being present in the aerosol generated with a nicotine malate liquid formulation. Lower nicotine recovery in the case of freebase nicotine liquid formulation compared to the nicotine liquid formulations might result from the sample collection and assay procedure that small portion of gaseous nicotine escaped from the smoking system.

Volatile Nicotine in Aerosol

The amount of nicotine in the aerosol exiting the a low temperature vaporization device, i.e. an electronic cigarette, was examined by calculating percent nicotine captured in bubbler-1 compared to the total recovered nicotine. Benzoic acid is expected to reside in the particles (i.e. liquid droplets) in aerosol as it is non-volatile. Benzoic acid was thus used as a particle marker for nicotine since it is expected to protonate nicotine at 1:1 molar ratio, which will result in nicotine being present in the aerosol, in some embodiments in a non-gas phase of the aerosol. The amount of aerosolized nicotine was calculated by comparing the difference between the amount of benzoic acid captured in bubbler-1 and the amount of benzoic acid in the nicotine liquid formulation.

Figure 9:
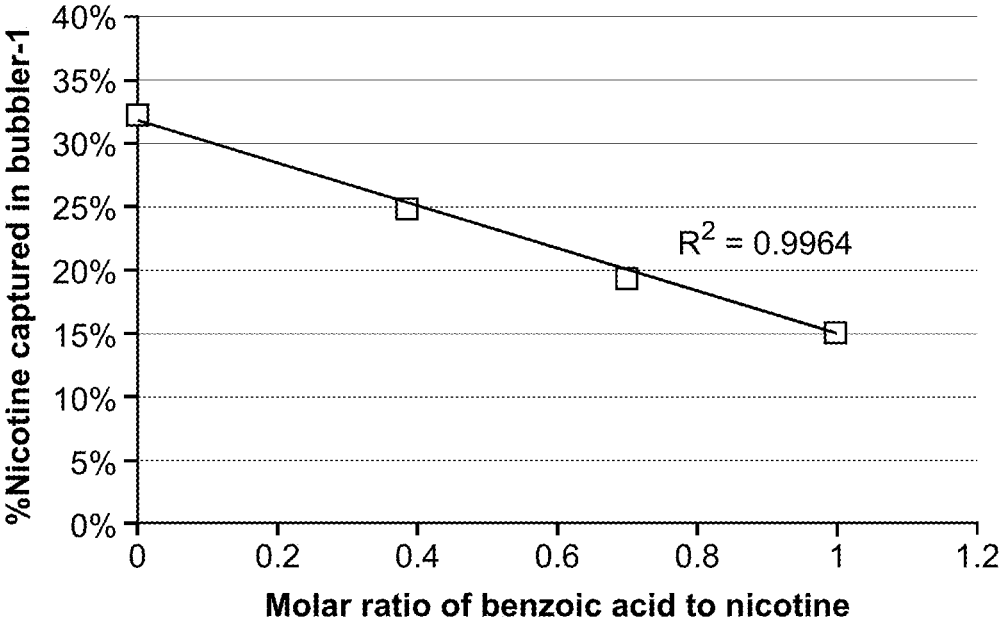
FIG. 9 depicts a non-limiting example of the correlation between a molar ratio of benzoic acid to nicotine and a percent nicotine captured from at least a portion of an aerosol generated using low temperature electronic vaporization device. i.e. an electronic cigarette, and a nicotine liquid formulation.

A linear relationship was found between the amount of nicotine captured in bubbler-1 to the molar ratio of benzoic acid to nicotine in the nicotine liquid formulations (FIG. 9). At a 1:1 molar ratio of nicotine to benzoic acid, nicotine becomes fully protonated and the minimum amount of vapor collected in bubbler-1 was measured. Moreover, at a molar ratio of 1:1.5 of nicotine to benzoic acid, no further decrease in the amount of aerosolized nicotine was detected. It should also be noted that a higher percentage of freebase nicotine was collected by bubbler-1 indicating a higher concentration of gas phase nicotine was nicotine generated when using freebase nicotine in the nicotine liquid formulation.

Figure 10:
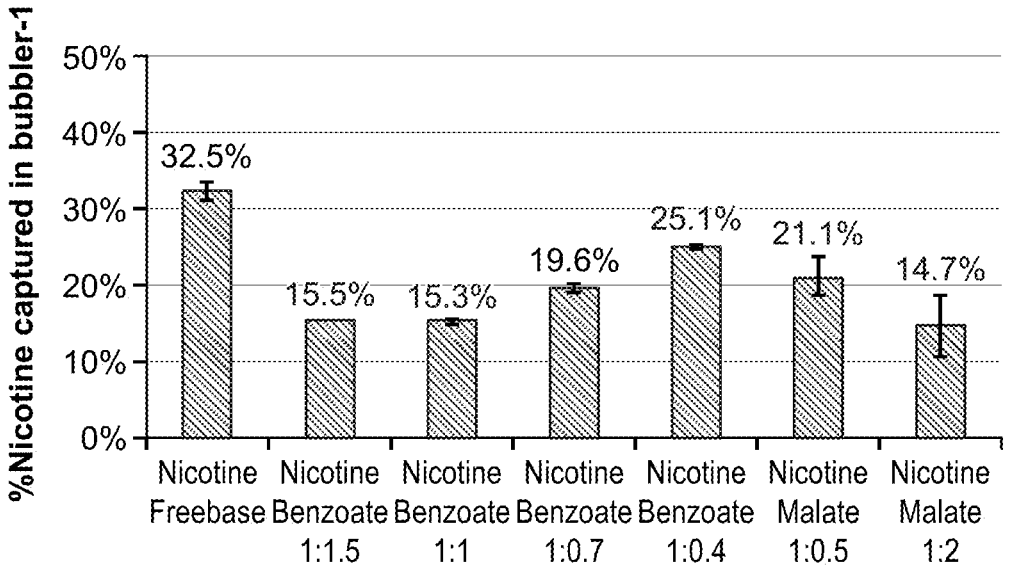
FIG. 10 depicts a non-limiting example of a percent nicotine captured from at least a portion of an aerosol generated using low temperature electronic vaporization device, i.e. an electronic cigarette, and a nicotine liquid formulation.

Theoretically malic acid, which is diprotic, will protonate nicotine at a 0.5:1 molar ratio of malic acid to nicotine. However, malic acid is known to degrade at the operating temperature of the electronic cigarette resulting in a low transfer efficiency from the liquid formulation to the aerosol. Thus, given the low transfer efficiency of malic acid, the effective nicotine to malic ratio in the aerosol was 0.23 when generated using the nicotine liquid formulation comprising a molar ratio of 1:0.5 of nicotine to malic acid and 0.87 when generated using the nicotine liquid formulation comprising a molar ratio of 1:2 of nicotine to malic acid. As expected, the percent acid captured in bubbler-1 when using a nicotine liquid formulation comprising a 1:0.5 nicotine to malic acid molar ratio fell between the percent acid recovered when using nicotine liquid formulations comprising a nicotine to benzoic acid molar ratio of 1:0.4 and 1:0.7. The nicotine liquid formulation comprising a 1:2 molar ratio of nicotine to malic acid delivered an aerosol comprising a molar ratio of nicotine to malic acid of 1:0.87, thus containing excess malic acid than needed to fully protonate nicotine, leaving only 14.7% nicotine captured in bubbler-1 (FIG. 10).

Aerosolized nicotine that stays in particles is more likely to travel down to alveoli and get into the blood of a user. Gaseous nicotine has greater chance to deposit in upper respiratory tract and be absorbed at a different rate from deep lung gas exchange region. Thus, using nicotine liquid formulations with a molar ratio of 1:1 nicotine to benzoic acid or 1:2 nicotine to malic acid, about the same molar amount of aerosolized nicotine in the non-gas phase would be delivered to a user's lungs. This is in agreement with the $T_{max}$ data described in Example 8.

Example 14: Acidic Functional Group Requirements Testing

The experimental system comprised a glass bubbler (bubbler-1), a Cambridge filter pad, and 2 glass bubblers (trap-1 and trap-2, connected in sequence) to trap any volatiles that pass through the filter pad. Low temperature electronic vaporization device, i.e. an electronic cigarette, was connected to the inlet of bubbler 1, and was activated by a smoking machine connected to the outlet of trap 2 under designed puffing regime. The puffing regime comprised: Number of puffs per sample=30, puff size=60 cc, puff duration=4 s. The trap solvent comprised 0.3% HCl in water. The nicotine liquid formulations tested were: freebase nicotine, nicotine benzoate at molar ratios of nicotine to acid of 1:0.4, 1:0.7, 1:1, and 1:1.5, and nicotine malate at molar ratios of nicotine to acid of 1:0.5 and 1:2. The formulations were generated using the procedures described in Example 1. In the experimental system gaseous (i.e. vapor) analytes were capture by the bubblers.

The procedure comprised:

- weighing the following parts prior to the start of puffing: the electronic cigarette filled with nicotine liquid formulation, the bubbler-1 filled with 35 mL trap solvent, a clean filter pad and pad holder, the trap-1 filled with 20 mL trap solvent, and trap-2 filled with 20 mL trap solvent;
- connecting in the following sequence: the electronic cigarette, bubbler-1, the filter pad, trap-1, trap-2, and the smoking machine;
- smoking was conducted under the aforementioned puffing regime. A clean air puff of the same puff size and duration was done after each smoking puff;
- weighing all parts after the end of the puffing regime. The inlet tubing of bubbler-1 was assayed with 10 mL of trap solvent in aliquots of 1 mL. The total solvent amount in bubbler-1 after puffing was calculated with the correction of water loss from 60 puffs. The filter pad was cut in half and each half was extracted in 20 mL trap solvent for 2 hours. The pad extract was filtered through 0.2 μm Nylon syringe filter. The front half of the pad holder was assayed with 5 mL trap solvent. The back half of the pad holder was assayed with 3 mL trap solvent;
- analyzing solutions by UV-Vis spectroscopy. The absorbance at 259 nm was used to calculate the nicotine concentration. The absorbance at 230 nm was used to calculate the benzoic acid concentration. Malic acid was quantified using Malic acid UV test kit from NZYTech Inc.

Results and Discussions

The amount of nicotine in the aerosol exiting the a low temperature vaporization device, i.e. an electronic cigarette, was examined by calculating percent nicotine captured in bubbler-1 compared to the total recovered nicotine. Benzoic acid is expected to reside in the particles (i.e. liquid droplets) in aerosol as it is non-volatile. Benzoic acid was thus used as a particle marker for nicotine since it is expected to protonate nicotine at 1:1 molar ratio, which will result in nicotine being present in the aerosol, in some embodiments in a non-gas phase of the aerosol. The amount of aerosolized nicotine was calculated by comparing the difference between the amount of benzoic acid captured in bubbler-1 and the amount of benzoic acid in the nicotine liquid formulation.

A linear relationship was found between the amount of nicotine captured in bubbler-1 to the molar ratio of benzoic acid to nicotine in the nicotine liquid formulations (FIG. 9). At a 1:1 molar ratio of nicotine to benzoic acid, nicotine becomes fully protonated and the minimum amount of vapor collected in bubbler-1 was measured. Moreover, at a molar ratio of 1:1.5 of nicotine to benzoic acid, no further decrease in the amount of aerosolized nicotine was detected. It should also be noted that a higher percentage of freebase nicotine was collected by bubbler-1 indicating a higher concentration of gas phase nicotine was nicotine generated when using freebase nicotine in the nicotine liquid formulation.

Benzoic acid and succinic acid have similar boiling points, 249° C. for benzoic acid and 235° C. for succinic acid, and both acids melt and evaporate without decomposition. Thus a nicotine liquid formulation generated using either acid should behave similarly and generate an aerosol with about the same molar amount of nicotine in aerosol. Thus, it is likely that the same total amount of acid will be collected when using either acid in the nicotine liquid formulation. Stated differently, it is likely that about the same percentage of succinic acid would be recovered when using a nicotine succinate liquid formulation in the electronic cigarette as compared to the percentage benzoic acid recovered when using a nicotine benzoate liquid formulation as described in Example 13. As such, the same percentage of nicotine will also likely be captured in bubbler-1 when using either succinic acid or benzoic acid in a nicotine liquid formulation.

Figure 11:
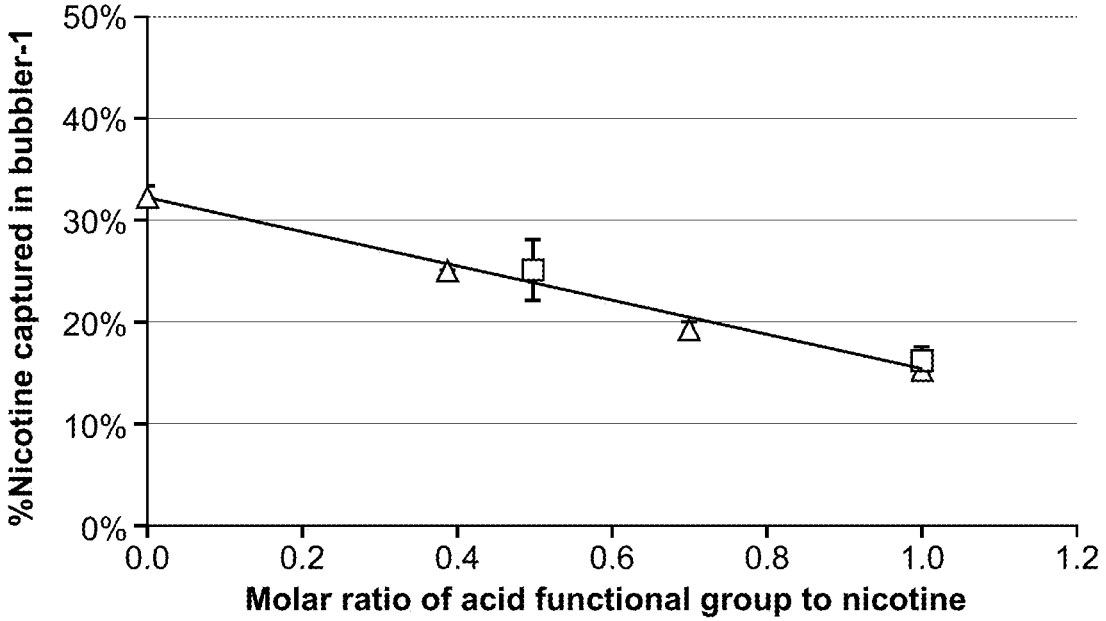
FIG. 11 depicts a non-limiting example of the correlation between a molar ratio of acid functional groups to nicotine and a percent nicotine captured from at least a portion of an aerosol generated using low temperature electronic vaporization device. i.e. an electronic cigarette, and a nicotine liquid formulation.

Here different molar ratios of acidic functional groups to moles of nicotine were investigated. Since succinic acid is a diprotic acid, it was expected that a molar ratio of 1:0.25 of nicotine to succinic acid would result in the same amount of acid captured in bubbler-1 as captured using a 1:0.5 molar ratio of nicotine to benzoic acid. Further, it was expected that a molar ratio of 1:0.5 of nicotine to succinic acid would result in about the same amount of nicotine captured in bubbler-1 as captured using a 1:1 molar ratio of nicotine to benzoic acid. As was expected about the same percentage of acid was collected in bubbler-1 when using a molar ratio of 1:0.25 of nicotine to succinic acid in the nicotine liquid formulation as would be expected based on the amount of nicotine captured using a 1:0.4 and 1:0.7 nicotine to benzoic acid molar ratio nicotine liquid formulation (FIG. 11). Further, as was expected about the same percentage of acid was collected in bubbler-1 when using a molar ratio of 1:0.5 of nicotine to succinic acid in the nicotine liquid formulation compared to using a 1:1 molar ratio of nicotine to benzoic acid (FIG. 11).

Thus, since succinic acid is diprotic, one mole of succinic acid likely protonates two moles of nicotine thus stabilizing the two moles of nicotine in the aerosol. Stated differently, half the molar amount of succinic acid in a nicotine liquid formulation used in low temperature electronic vaporization device, i.e. an electronic cigarette, is needed to fully protonate nicotine and stabilize nicotine in the aerosol compared to using benzoic acid in a nicotine liquid formulation used in low temperature electronic vaporization device, i.e. an electronic cigarette. Moreover, it is plausible that succinic acid was ranked low in the satisfaction study described in Example 3 because excess succinic acid (1:2 molar ratio of nicotine to succinic acid) was included in the formulation and thus it is likely the excess succinic acid was delivered to the user thus resulting in an unfavorable experience for the user. For example, an unfavorable experience comprises a flavor, a nervous response, and/or an irritation of one or more of an oral cavity, an upper respiratory tract, and/or the lungs.

Further understanding may be gained through contemplation of the numbered embodiments below.

1. A method of delivering nicotine to a user comprising deploying low temperature electronic vaporization device, i.e. an electronic cigarette, comprising a nicotine formulation comprising:

a, from about 0.5% (w/w) to about 20% (w/w) nicotine;

b. a molar ratio of acid to nicotine from about 0.25:1 to about 4:1; and c. a biologically acceptable liquid carrier, wherein operation of the electronic cigarette generates an inhalable aerosol comprising at least a portion of the nicotine in the formulation.

2. The method of embodiment 1, wherein a molar ratio of acidic functional groups to nicotine is from about 0.25:1 to about 4:1.

3. The method of any one of the embodiments 1-2, wherein the acid and nicotine form a nicotine salt.

4. The method of embodiment 1-7, wherein nicotine formulation comprises monoprotonated nicotine.

5. The method of any one of the embodiments 1-4, wherein the aerosol comprises monoprotonated nicotine.

6. The method of any one of the embodiments 1-5, wherein the aerosol is delivered to the user's lungs.

7. The method of embodiment 6, wherein the aerosol is delivered to alveoli in the user's lungs 8. The method of any one of the embodiments 1-10, wherein nicotine is stabilized in salt form in the aerosol.

9. The method of anyone of the embodiments 1-10, wherein nicotine is carried in salt form in the aerosol.

10. The method of any one of the embodiments 1-9, wherein the acid comprises one carboxylic acid functional group.

11. The method of any one of the embodiments 1-9, wherein the acid comprises more than one carboxylic acid functional group.

12. The method of any one of the embodiments 1-9, wherein the acid is selected from the group consisting of: formic acid, acetic acid, propionic acid, butyric acid, valeric acid, caproic acid, caprylic acid, capric acid, citric acid, lauric acid, myristic acid, palmitic acid, stearic acid, oleic acid, linoleic acid, linolenic acid, phenylacetic acid, benzoic acid, pyruvic acid, levulinic acid, tartaric acid, lactic acid, malonic acid, succinic acid, fumaric acid, gluconic acid, saccharic acid, salicyclic acid, sorbic acid, masonic acid, or malic acid.

13. The method of any one of the embodiments 1-9, wherein the acid comprises one or more of a carboxylic acid, a dicarboxylic acid, and a keto acid.

14. The method of any one of the embodiments 1-9, wherein the acid comprises one or more of benzoic acid, pyruvic acid, salicylic acid, levulinic acid, malic acid, succinic acid, and citric acid.

15. The method of any one of the embodiments 1-9, wherein the acid comprises benzoic acid.

16. The method of any one of the embodiments 1-11, wherein the molar ratio of acid to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

17. The method of any one of the embodiments 1-11, wherein the molar ratio of acidic functional groups to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

18. The method of any one of the embodiments 1-11, wherein the molar ratio of acidic functional group hydrogens to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

19. The method of any one of the embodiments 1-11, wherein the molar ratio of acid to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

20. The method of any one of the embodiments 1-11, wherein the molar ratio of acidic functional groups to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

21. The method of any one of the embodiments 1-11, wherein the molar ratio of acidic functional groups hydrogens to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

22. The method of any one of the embodiments 1-[0054], wherein the nicotine concentration is about 0.5% (w/w), 1% (w/w), about 2% (w/w), about 3% (w/w), about 4% (w/w), about 5% (w/w), about 6% (w/w), about 7% (w/w), about 8% (w/w), about 9% (w/w), about 10% (w/w), about 11% (w/w), about 12% (w/w), about 13% (w/w), about 14% (w/w), about 15% (w/w), about 16% (w/w), about 17% (w/w), about 18% (w/w), about 19% (w/w), or about 20% (w/w).

23. The method of any one of the embodiments 1-[0054], wherein the nicotine concentration is from about 0.5% (w/w) to about 20% (w/w), from about 0.5% (w/w) to about 18% (w/w), from about 0.5% (w/w) to about 15% (w/w), from about 0.5% (w/w) to about 12% (w/w), from about 0.5% (w/w) to about 10% (w/w), from about 0.5% (w/w) to about 8% (w/w), from about 0.5% (w/w) to about 7% (w/w), from about 0.5% (w/w) to about 6% (w/w), from about 0.5% (w/w) to about 5% (w/w), from about 0.5% (w/w) to about 4% (w/w), from about 0.5% (w/w) to about 3% (w/w), or from about 0.5% (w/w) to about 2% (w/w).

24. The method of any one of the embodiments 1-[0054], wherein the nicotine concentration is from about 1% (w/w) to about 20% (w/w), from about 1% (w/w) to about 18% (w/w), from about 1% (w/w) to about 15% (w/w), from about 1% (w/w) to about 12% (w/w), from about 1% (w/w) to about 10% (w/w), from about 1% (w/w) to about 8% (w/w), from about 1% (w/w) to about 7% (w/w), from about 1% (w/w) to about 6% (w/w), from about 1% (w/w) to about 5% (w/w), from about 1% (w/w) to about 4% (w/w), from about 1% (w/w) to about 3% (w/w), or from about 1% (w/w) to about 2% (w/w).

25. The method of any one of the embodiments 1-[0054], wherein the nicotine concentration is from about 2% (w/w) to about 20% (w/w), from about 2% (w/w) to about 18% (w/w), from about 2% (w/w) to about 15% (w/w), from about 2% (w/w) to about 12% (w/w), from about 2% (w/w) to about 10% (w/w), from about 2% (w/w) to about 8% (w/w), from about 2% (w/w) to about 7% (w/w), from about 2% (w/w) to about 6% (w/w), from about 2% (w/w) to about 5% (w/w), from about 2% (w/w) to about 4% (w/w), or from about 2% (w/w) to about 3% (w/w).

26. The method of any one of the embodiments 0.1-[0054], wherein the nicotine concentration is from about 3% (w/w) to about 20% (w/w), from about 3% (w/w) to about 18% (w/w), from about 3% (w/w) to about 15% (w/w), from about 3% (w/w) to about 12% (w/w), from about 3% (w/w) to about 10% (w/w), from about 3% (w/w) to about 8% (w/w), from about 3% (w/w) to about 7% (w/w), from about 3% (w/w) to about 6% (w/w), from about 3% (w/w) to about 5% (w/w), or from about 3% (w/w) to about 4% (w/w).

27. The method of any one of the embodiments 1-[0054], wherein the nicotine concentration is from about 4% (w/w) to about 20% (w/w), from about 4% (w/w) to about 18% (w/w), from about 4% (w/w) to about 15% (w/w), from about 4% (w/w) to about 12% (w/w), from about 4% (w/w) to about 10% (w/w), from about 4% (w/w) to about 8% (w/w), from about 4% (w/w) to about 7% (w/w), from about 4% (w/w) to about 6% (w/w), or from about 4% (w/w) to about 5% (w/w).

28. The method of any one of the embodiments 1-[0054], wherein the nicotine concentration is from about 5% (w/w) to about 20% (w/w), from about 5% (w/w) to about 18% (w/w), from about 5% (w/w) to about 15% (w/w), from about 5% (w/w) to about 12% (w/w), from about 5% (w/w) to about 10% (w/w), from about 5% (w/w) to about 8% (w/w), from about 5% (w/w) to about 7% (w/w), or from about 5% (w/w) to about 6% (w/w).

29. The method of any one of the embodiments 1-[0054], wherein the nicotine concentration is from about 6% (w/w) to about 20% (w/w), from about 6% (w/w) to about 18% (w/w), from about 6% (w/w) to about 15% (w/w), from about 6% (w/w) to about 12% (w/w), from about 6% (w/w) to about 10% (w/w), from about 6% (w/w) to about 8% (w/w), or from about 6% (w/w) to about 7% (w/w).

30. The method of any one of the embodiments 1-[0054], wherein the nicotine concentration is from about 2% (w/w) to about 6% (w/w).

31. The method of any one of the embodiments 1-[0054], wherein the nicotine concentration is about 5% (w/w).

32. The method of any one of the embodiments 1-[0072], wherein the molar concentration of nicotine in the aerosol is about the same as the molar concentration of the acid in the aerosol.

33. The method of any one of the embodiments 1-32, wherein the aerosol comprises about 50% of the nicotine in the formulation, about 60% of the nicotine in the formulation, about 70% of the nicotine in the formulation, about 75% of the nicotine in the formulation, about 80% of the nicotine in the formulation, about 85% of the nicotine in the formulation, about 90% of the nicotine in the formulation, about 95% of the nicotine in the formulation, or about 99% of the nicotine in the formulation.

34. The method of any one of the embodiments 1-33, wherein the aerosol comprises condensate in particles sizes from about 0.1 microns to about 5 microns, from about 0.1 microns to about 4.5 microns, from about 0.1 microns to about 4 microns, from about 0.1 microns to about 3.5 microns, from about 0.1 microns to about 3 microns, from about 0.1 microns to about 2.5 microns, from about 0.1 microns to about 2 microns, from about 0.1 microns to about 1.5 microns, from about 0.1 microns to about 1 microns, from about 0.1 microns to about 0.9 microns, from about 0.1 microns to about 0.8 microns, from about 0.1 microns to about 0.7 microns, from about 0.1 microns to about 0.6 microns, from about 0.1 microns to about 0.5 microns, from about 0.1 microns to about 0.4 microns, from about 0.1 microns to about 0.3 microns, from about 0.1 microns to about 0.2 microns, or from about 0.3 to about 0.4 microns.

35. The method of embodiment 1-34, wherein the aerosol comprises condensate of nicotine sat.

36. The method of embodiment 1-34, wherein the aerosol comprises condensate comprising one or more of the carrier, nicotine salt, freebase nicotine, and free acid.

37. The method of embodiment 1-9, wherein the acid does not decompose at room temperature and does not decompose at the operating temperature of the electronic cigarette.

38. The method of any one of the embodiments 1-37, wherein an operating temperature is from 150° C. to 250° C.

39. The method of any one of the embodiments 1-37, wherein an operating temperature is from 180° C. to 220° C.

40. The method of any one of the embodiments 1-37, wherein an operating temperature is about 200° C.

41. The method of any one of embodiments 1-40, wherein the acid is stable at and below operating temperature or about 200° C.

42. The method of any one of embodiments 1-40, wherein the acid does not decompose at and below operating temperature or about 200° C.

43. The method of any one of embodiments 1-40, wherein the acid does not oxidize at and below operating temperature or about 200° C.

44. The method of any one of embodiments 1-43, wherein the formulation is non-toxic to a user of the electronic cigarette.

45. The method of any one of the embodiments 1-44, wherein the formulation is non-corrosive to the electronic cigarette.

46. The method of any one of the embodiments 1-45, wherein the formulation comprises a flavorant.

47. The method of any one of the embodiments 1-46, wherein inhaling the aerosol over a period of five minutes at a rate of about one inhalation per 30 seconds results in a nicotine plasma Tmax from about 1 min to about 8 min.

48. The method of embodiment 47, wherein the nicotine plasma Tmax is from about 1 min to about 7 min, from about 1 min to about 6 min, from about 1 min to about 5 min, from about 1 min to about 4 min, from about 1 min to about 3 min, from about 1 min to about 2 min, from about 2 min to about 8 min, from about 2 min to about 7 min, from about 2 min to about 6 min, from about 2 min to about 5 min, from about 2 min to about 4 min, from about 2 min to about 3 min, from about 3 min to about 8 min, from about 3 min to about 7 min, from about 3 min to about 6 min, from about 3 min to about 5 min, from about 3 min to about 4 min, from about 4 min to about 7 min, from about 4 min to about 6 min, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, less than about 3 min, less than about 2 min, less than about 1 min, about 8 min, about 7 min, about 6 min, about 5 min, about 4 min, about 3 min, about 2 min, or about 1 min.

49. The method of any one of the embodiments 1-46, wherein inhaling the aerosol over a period of about five minutes at a rate of about one inhalation per 30 seconds results in a nicotine plasma Tmax from about 2 min to about 8 min.

50. The method of embodiment 49, wherein the nicotine plasma Tmax is from about 2 min to about 8 min, from about 2 min to about 7 min, from about 2 min to about 6 min, from about 2 min to about 5 min, from about 2 min to about 4 min, from about 2 min to about 3 min, from about 3 min to about 8 min, from about 3 min to about 7 min, from about 3 min to about 6 min, from about 3 min to about 5 min, from about 3 min to about 4 min, from about 4 min to about 7 min, from about 4 min to about 6 mini, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, less than about 3 min, less than about 2 min, less than about 1 min, about 8 min, about 7 min, about 6 min, about 5 min, about 4 min, about 3 min, or about 2 min.

51. The method of any one of the embodiments 1-46, wherein inhaling the aerosol over a period of about five minutes at a rate of about one inhalation per 30 seconds results in a nicotine plasma Tmax from about 3 min to about 8 min.

52. The method of embodiment 51, wherein the nicotine plasma Tmax is from about 3 min to about 7 min, from about 3 min to about 6 min, from about 3 min to about 5 min, from about 3 min to about 4 min, from about 4 min to about 8 min, from about 4 min to about 7 min. from about 4 min to about 6 min, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, about h min, about 7 min, about 6 min, about 5 min, about 4 min, or about 3 min.

53. The method of any one of the embodiments 1-46, wherein the Tmax is less than about 8 min.

54. The method of any one of the embodiments 47-53, wherein the Tmax is determined based on at least three independent data sets.

55. The method of embodiment 47-53, wherein the Tmax is a range of at least three independent data sets.

56. The method of embodiment 47-53, wherein the Tmax is an average±a standard deviation of at least three independent data sets.

57. The method of any one of the embodiments 1-56, wherein the liquid carrier comprises glycerol, propylene glycol, trimethylene glycol, water, ethanol or a combination thereof.

58. The method of any one of the embodiments 1-56, wherein the liquid carrier comprises propylene glycol and vegetable glycerin.

59. The method of any one of the embodiments 1-56, wherein the liquid carrier comprises 20% to 50% of propylene glycol and 80% to 50% of vegetable glycerin.

60. The method of any one of the embodiments 1-56, wherein the liquid carrier comprises 30% propylene glycol and 70% vegetable glycerin.

61. The method of any one of embodiments 1-17, wherein the formulation further comprises one or more additional acids.

62. The method of embodiment 21, wherein the one or more additional acids comprises one or more of benzoic acid, pyruvic acid, salicylic acid, levulinic acid, malic acid, succinic acid, and citric acid.

63. The method of embodiment 21, wherein the one or more additional acids comprises benzoic acid.

64. The method of any one of the embodiments 21-63, wherein the one or more additional acids forms one or more additional nicotine salts.

65. A method of delivering nicotine to a user comprising deploying low temperature electronic vaporization device. i.e. an electronic cigarette, comprising a nicotine formulation comprising:

a, from about 0.5% (w/w) to about 20% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 0.25:1 to about 4:1; and c. a biologically acceptable liquid carrier, wherein operation of the electronic cigarette generates an inhalable aerosol comprising at least a portion of the nicotine in the formulation.

66. A method of delivering nicotine to a user comprising deploying low temperature electronic vaporization device, i.e. an electronic cigarette, comprising a nicotine formulation comprising:

a, from about 2% (w/w) to about 6% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 0.25:1 to about 4:1; and c. a biologically acceptable liquid carrier, wherein operation of the electronic cigarette generates an inhalable aerosol comprising at least a portion of the nicotine in the formulation.

67. A method of delivering nicotine to a user comprising deploying low temperature electronic vaporization device, i.e. an electronic cigarette, comprising a nicotine formulation comprising:

a, from about 2% (w/w) to about 6% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 1:1 to about 2:1; and c. a biologically acceptable liquid carrier, wherein operation of the electronic cigarette generates an inhalable aerosol comprising at least a portion of the nicotine in the formulation.

68. A method of delivering nicotine to a user comprising deploying low temperature electronic vaporization device, i.e. an electronic cigarette, comprising a nicotine formulation comprising:

a, from about 2% (w/w) to about 6% (w/w) nicotine;

b. a molar ratio of benzoic acid to nicotine of about 1:1; and c. a biologically acceptable liquid carrier, wherein operation of the electronic cigarette generates an inhalable aerosol comprising at least a portion of the nicotine in the formulation.

69. A formulation for use in low temperature electronic vaporization device, i.e. an electronic cigarette, the formulation comprising:
   a, from about 0.5% (w/w) to about 20% (w/w) nicotine;
   b. a molar ratio of acid to nicotine from about 0.25:1 to about 4:1; and
   c. a biologically acceptable liquid carrier,
   wherein operation of the electronic cigarette generates an inhalable aerosol comprising at least a portion of the nicotine in the formulation.
70. The formulation of embodiment 69, wherein a molar ratio of acidic functional groups to nicotine is from about 1:1 to about 4:1.
71. The formulation of any one of the embodiments 69-70, wherein the acid and nicotine form a nicotine salt.
72. The formulation of embodiment 69-71, comprising monoprotonated nicotine.
73. The formulation of any one of the embodiments 69-72, wherein the aerosol comprises monoprotonated nicotine.
74. The formulation of any one of the embodiments 69-73, wherein the aerosol is delivered to the user's lungs.
75. The formulation of embodiment 74, wherein the aerosol is delivered to alveoli in the user's lungs
76. The formulation of any one of the embodiments 69-75, wherein nicotine is stabilized in salt form in the aerosol.
77. The formulation of any one of the embodiments 69-75, wherein nicotine is carried in salt form in the aerosol.
78. The formulation of any one of the embodiments 69-77, wherein the acid comprises one carboxylic acid functional group.
79. The formulation of any one of the embodiments 69-77, wherein the acid comprises more than one carboxylic acid functional group.
80. The formulation of any one of the embodiments 69-77, wherein the acid is selected from the group consisting of: formic acid, acetic acid, propionic acid, butyric acid, valeric acid, caproic acid, caprylic acid, capric acid, citric acid, lauric acid, myristic acid, palmitic acid, stearic acid, oleic acid, linoleic acid, linolenic acid, phenylacetic acid, benzoic acid, pyruvic acid, levulinic acid, tartaric acid, lactic acid, malonic acid, succinic acid, fumaric acid, gluconic acid, saccharic acid, salicyclic acid, sorbic acid, masonic acid, or malic acid.
81. The formulation of any one of the embodiments 69-77, wherein the acid comprises one or more of a carboxylic acid, a dicarboxylic acid, and a keto acid.
82. The formulation of any one of the embodiments 69-77, wherein the acid comprises one or more of benzoic acid, pyruvic acid, salicylic acid, levulinic acid, malic acid, succinic acid, and citric acid.
83. The formulation of any one of the embodiments 69-77, wherein the acid comprises nicotine benzoate.
84. The formulation of any one of the embodiments 69-83, wherein the molar ratio of acid to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.
85. The formulation of any one of the embodiments 69-83, wherein the molar ratio of acidic functional groups to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.
86. The formulation of any one of the embodiments 69-83, wherein the molar ratio of acidic functional group hydrogens to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.
87. The formulation of any one of the embodiments 69-83, wherein the molar ratio of acid to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.
88. The formulation of any one of the embodiments 69-83, wherein the molar ratio of acidic functional groups to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.
89. The formulation of any one of the embodiments 69-83, wherein the molar ratio of acidic functional group hydrogens to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.
90. The formulation of any one of the embodiments 69-89, wherein the nicotine concentration is from about 0.5% (w/w) to about 20% (w/w), from about 0.5% (w/w) to about 18% (w/w), from about 0.5% (w/w) to about 15% (w/w), from about 0.5% (w/w) to about 12% (w/w), from about 0.5% (w/w) to about 10% (w/w), from about 0.5% (w/w) to about 8% (w/w), from about 0.5% (w/w) to about 7% (w/w), from about 0.5% (w/w) to about 6% (w/w), from about 0.5% (w/w) to about 5% (w/w), from about 0.5% (w/w) to about 4% (w/w), from about 0.5% (w/w) to about 3% (w/w), or from about 0.5% (w/w) to about 2% (w/w).
91. The formulation of any one of the embodiments 69-89, wherein the nicotine concentration is about 0.5% (w/w), about 1% (w/w), about 2% (w/w), about 3% (w/w), about 4% (w/w), about 5% (w/w), about 6% (w/w), about 7% (w/w), about 8% (w/w), about 9% (w/w), about 10% (w/w), about 11% (w/w), about 12% (w/w), about 13% (w/w), about 14% (w/w), about 15% (w/w), about 16% (w/w), about 17% (w/w), about 18% (w/w), about 19% (w/w), or about 20% (w/w).
92. The formulation of any one of the embodiments 69-89, wherein the nicotine concentration is from about 1% (w/w) to about 20% (w/w), from about 1% (w/w) to about 18% (w/w), from about 1% (w/w) to about 15% (w/w), from about 1% (w/w) to about 12% (w/w), from about 1% (w/w) to about 10% (w/w), from about 1% (w/w) to about 8% (w/w), from about 1% (w/w) to about 7% (w/w), from about 1% (w/w) to about 6% (w/w), from about 1% (w/w) to about 5% (w/w), from about 1% (w/w) to about 4% (w/w), from about 1% (w/w) to about 3% (w/w), or from about 1% (w/w) to about 2% (w/w).

93. The formulation of any one of the embodiments 69-89, wherein the nicotine concentration is from about 2% (w/w) to about 20% (w/w), from about 2% (w/w) to about 18% (w/w), from about 2% (w/w) to about 15% (w/w), from about 2% (w/w) to about 12% (w/w), from about 2% (w/w) to about 10% (w/w), from about 2% (w/w) to about 8% (w/w), from about 2% (w/w) to about 7% (w/w), from about 2% (w/w) to about 6% (w/w), from about 2% (w/w) to about 5% (w/w), from about 2% (w/w) to about 4% (w/w), or from about 2% (w/w) to about 3% (w/w).
94. The formulation of any one of the embodiments 69-89, wherein the nicotine concentration is from about 3% (w/w) to about 20% (w/w), from about 3% (w/w) to about 18% (w/w), from about 3% (w/w) to about 15% (w/w), from about 3% (w/w) to about 12% (w/w), from about 3% (w/w) to about 10% (w/w), from about 3% (w/w) to about 8% (w/w), from about 3% (w/w) to about 7% (w/w), from about 3% (w/w) to about 6% (w/w), from about 3% (w/w) to about 5% (w/w), or from about 3% (w/w) to about 4% (w/w).
95. The formulation of any one of the embodiments 69-89, wherein the nicotine concentration is from about 4% (w/w) to about 20% (w/w), from about 4% (w/w) to about 18% (w/w), from about 4% (w/w) to about 15% (w/w), from about 4% (w/w) to about 12% (w/w), from about 4% (w/w) to about 10% (w/w), from about 4% (w/w) to about 8% (w/w), from about 4% (w/w) to about 7% (w/w), from about 4% (w/w) to about 6% (w/w), or from about 4% (w/w) to about 5% (w/w).
96. The formulation of any one of the embodiments 69-89, wherein the nicotine concentration is from about 5% (w/w) to about 20% (w/w), from about 5% (w/w) to about 18% (w/w), from about 5% (w/w) to about 15% (w/w), from about 5% (w/w) to about 12% (w/w), from about 5% (w/w) to about 10% (w/w), from about 5% (w/w) to about 8% (w/w), from about 5% (w/w) to about 7% (w/w), or from about 5% (w/w) to about 6% (w/w).
97. The formulation of anyone of the embodiments 69-87, wherein the nicotine concentration is from about 6% (w/w) to about 20% (w/w), from about 6% (w/w) to about 18% (w/w), from about 6% (w/w) to about 15% (w/w), from about 6% (w/w) to about 12% (w/w), from about 6% (w/w) to about 10% (w/w), from about 6% (w/w) to about 8% (w/w), or from about 6% (w/w) to about 7% (w/w).
98. The formulation of any one of the embodiments 69-89, wherein the nicotine concentration is from about 2% (w/w) to about 6% (w/w).
99. The formulation of any one of the embodiments 69-89, wherein the nicotine concentration is about 5% (w/w).
100. The formulation of any one of the embodiments 69-99, wherein the molar concentration of nicotine in the aerosol is about the same as the molar concentration of the acid in the aerosol.
101. The formulation ofany one of the embodiments 69-100, wherein the aerosol comprises about 50% of the nicotine in the formulation, about 60% of the nicotine in the formulation, about 70% of the nicotine in the formulation, about 75% of the nicotine in the formulation, about 80% of the nicotine in the formulation, about 85% of the nicotine in the formulation, about 90% of the nicotine in the formulation, about 95% of the nicotine in the formulation, or about 99% of the nicotine in the formulation.
102. The formulation of any one of the embodiments 69-101, wherein the aerosol comprises condensate in particles sizes from about 0.1 microns to about 5 microns, from about 0.1 microns to about 4.5 microns, from about 0.1 microns to about 4 microns, from about 0.1 microns to about 3.5 microns, from about 0.1 microns to about 3 microns, from about 0.1 microns to about 2.5 microns, from about 0.1 microns to about 2 microns, from about 0.1 microns to about 1.5 microns, from about 0.1 microns to about 1 microns, from about 0.1 microns to about 0.9 microns, from about 0.1 microns to about 0.8 microns, from about 0.1 microns to about 0.7 microns, from about 0.1 microns to about 0.6 microns, from about 0.1 microns to about 0.5 microns, from about 0.1 microns to about 0.4 microns, from about 0.1 microns to about 0.3 microns, from about 0.1 microns to about 0.2 microns, or from about 0.3 to about 0.4 microns.
103. The formulation of embodiment 69-102, wherein the aerosol comprises condensate of nicotine salt.
104. The formulation of embodiment 69-102, wherein the aerosol comprises condensate comprising one or more of the carrier, nicotine salt, freebase nicotine, and free acid.
105. The formulation of embodiment 69-104, wherein the acid does not decompose at room temperature and does not decompose at the operating temperature of the electronic cigarette.
106. The formulation of any one of the embodiments 69-105, wherein an operating temperature of the electronic cigarette is from 150° C. to 250° C.
107. The formulation of any one of the embodiments 69-105, wherein an operating temperature of the electronic cigarette is from 180° C. to 220° C.
108. The formulation of any one of the embodiments 69-105, wherein an operating temperature of the electronic cigarette is about 200° C.
109. The formulation of any one of embodiments 69-108, wherein the acid is stable at and below operating temperature of the electronic cigarette or about 200° C.
110. The formulation of any one of embodiments 69-108, wherein the acid does not decompose at and below operating temperature of the electronic cigarette or about 200° C.
111. The formulation of any one of embodiments 69-108, wherein the acid does not oxidize at and below operating temperature of the electronic cigarette or about 200° C.
112. The formulation ofany one of embodiments 69-108, wherein the formulation is non-toxic to a user of the electronic cigarette.
113. The formulation of any one of the embodiments 69-112, wherein the formulation is non-corrosive to the electronic cigarette.
114. The formulation of any one of the embodiments 69-113, wherein the formulation comprises a flavorant.
115. The formulation of any one of the embodiments 69-114, wherein inhaling the aerosol over a period of about five minutes at a rate of about one inhalation per 30 seconds results in a nicotine plasma Tmax from about 1 min to about 8 min.
116. The formulation of embodiment 115, wherein the nicotine plasma Tmax is from about 1 min to about 7 min, from about 1 min to about 6 min, from about 1 min to about 5 min, from about 1 min to about 4 min, from about 1 min to about 3 min, from about 1 min to about 2 min, from about 2 min to about 8 min, from about 2 min to about 7 min, from about 2 min to about 6 min, from about 2 min to about 5 min, from about 2 min to about 4 min, from about 2 min to about 3 min, from about 3 min to about 8 min, from about 3 min to about 7 min, from about 3 min to about 6 min, from about 3 min to about 5 min, from about 3 min to about 4 min, from about 4 min to about 7 min, from about 4 min to about 6 min, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, less than about 3 min, less than about 2 min, less than about 1 min, about 8 min, about 7 min, about 6 min, about 5 min, about 4 min, about 3 min, about 2 min, or about 1 min.

117. The formulation of any one of the embodiments 69-114, wherein inhaling the aerosol over a period of about five minutes at a rate of about one inhalation per 30 seconds results in a nicotine plasma Tmax from about 2 min to about 8 min.

118. The formulation of embodiment 117, wherein the nicotine plasma Tmax is from about 2 min to about 8 min, from about 2 min to about 7 min, from about 2 min to about 6 min, from about 2 min to about 5 min, from about 2 min to about 4 min, from about 2 min to about 3 min, from about 3 min to about 8 min, from about 3 min to about 7 min, from about 3 min to about 6 min, from about 3 min to about 5 min, from about 3 min to about 4 min, from about 4 min to about 7 min, from about 4 min to about 6 min, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, less than about 3 min, less than about 2 min, less than about 1 min, about 8 min, about 7 min, about 6 min, about 5 min, about 4 min, about 3 min, or about 2 min.

119. The formulation of any one of the embodiments 69-114, wherein inhaling the aerosol over a period of about five minutes at a rate of about one inhalation per 30 seconds results in a nicotine plasma Tmax from about 3 min to about 8 min.

120. The formulation of embodiment 119, wherein the nicotine plasma Tmax is from about 3 min to about 7 min, from about 3 min to about 6 min, from about 3 min to about 5 min, from about 3 min to about 4 min, from about 4 min to about 8 min, from about 4 min to about 7 min, from about 4 min to about 6 min, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, about 8 min, about 7 min, about 6 min, about 5 min, about 4 min, or about 3 min.

121. The formulation of any one of the embodiments 69-114, wherein the Tmax is less than about 8 min.

122. The formulation of any one of the embodiments 115-121, wherein the Tmax is determined based on at least three independent data sets.

123. The formulation of embodiment 115-121, wherein the Tmax is a range of at least three independent data sets.

124. The formulation of embodiment 115-121, wherein the Tmax is an average±a standard deviation of at least three independent data sets.

125. The formulation of any one of the embodiments 69-124, wherein the liquid carrier comprises glycerol, propylene glycol, trimethylene glycol, water, ethanol or a combination thereof.

126. The formulation of any one of the embodiments 69-124, wherein the liquid carrier comprises propylene glycol and vegetable glycerin.

127. The formulation of any one of the embodiments 69-124, wherein the liquid carrier comprises 20% to 50% of propylene glycol and 80% to 50% of vegetable glycerin.

128. The formulation of any one of the embodiments 69-124, wherein the liquid carrier comprises 30% propylene glycol and 70% vegetable glycerin.

129. The formulation of any one of embodiments 69-128, further comprising one or more additional acids.

130. The formulation of any one of embodiment 129, wherein the one or more additional acids comprises one or more of benzoic acid, pyruvic acid, salicylic acid, levulinic acid, malic acid, succinic acid, and citric acid.

131. The formulation of embodiment 129, wherein the one or more additional acids comprises benzoic acid.

132. The formulation of any one of the embodiments 129-131, wherein the one or more additional acids forms one or more additional nicotine salts.

133. A formulation for use in low temperature electronic vaporization device, i.e. an electronic cigarette, the formulation comprising:

a. from about 0.5% (w/w) to about 20% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 0.25:1 to about 4:1; and c. a biologically acceptable liquid carrier, wherein operation of the electronic cigarette generates an inhalable aerosol comprising at least a portion of the nicotine in the formulation.

134. A formulation for use in low temperature electronic vaporization device, i.e. an electronic cigarette, the formulation comprising:

a. from about 2% (w/w) to about 6% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 0.25:1 to about 4:1; and c. a biologically acceptable liquid carrier, wherein operation of the electronic cigarette generates an inhalable aerosol comprising at least a portion of the nicotine in the formulation.

135. A formulation for use in low temperature electronic vaporization device, i.e. an electronic cigarette, the formulation comprising:

a. from about 2% (w/w) to about 6% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 1:1 to about 2:1; and c. a biologically acceptable liquid carrier, wherein operation of the electronic cigarette generates an inhalable aerosol comprising at least a portion of the nicotine in the formulation.

136. A formulation for use in low temperature electronic vaporization device, i.e. an electronic cigarette, the formulation comprising:
a. from about 2% (w/w) to about 6% (w/w) nicotine;
b. a molar ratio of benzoic acid to nicotine of about 1:1; and
c. a biologically acceptable liquid carrier,
wherein operation of the electronic cigarette generates an inhalable aerosol comprising at least a portion of the nicotine in the formulation.

137. A cartridge for use with low temperature electronic vaporization device, i.e. an electronic cigarette, comprising a fluid compartment configured to be in fluid communication with a heating element, the fluid compartment comprising a nicotine formulation comprising:
a. from about 0.5% (w/w) to about 20% (w/w) nicotine;
b. a molar ratio of acid to nicotine from about 0.25:1 to about 4:1; and
c. a biologically acceptable liquid carrier,
wherein operation of the electronic cigarette generates an inhalable aerosol comprising at least a portion of nicotine in the formulation.

138. The cartridge of embodiment 137, wherein a molar ratio of acidic functional groups to nicotine is from about 1:1 to about 4:1.

139. The cartridge of any one of the embodiments 137-138, wherein the acid and nicotine form a nicotine salt.

140. The cartridge of embodiment 137-139, wherein nicotine formulation comprises monoprotonated nicotine.

141. The cartridge of any one of the embodiments 137-140, wherein the aerosol comprises monoprotonated nicotine.

142. The cartridge of any one of the embodiments 137-141, wherein the aerosol is delivered to the user's lungs.

143. The cartridge of embodiment 142, wherein the aerosol is delivered to alveoli in the user's lungs 144. The cartridge of any one of the embodiments 137-143, wherein nicotine is stabilized in salt form in the aerosol.

145. The cartridge of any one of the embodiments 137-143, wherein nicotine is carried in salt form in the aerosol.

146. The cartridge of any one of the embodiments 137-145, wherein the acid comprises one carboxylic acid functional group.

147. The cartridge of any one of the embodiments 137-145, wherein the acid comprises more than one carboxylic acid functional group.

148. The cartridge of any one of the embodiments 137-145, wherein the acid is selected from the group consisting of: formic acid, acetic acid, propionic acid, butyric acid, valeric acid, caproic acid, caprylic acid, capric acid, citric acid, lauric acid, myristic acid, palmitic acid, stearic acid, oleic acid, linoleic acid, linolenic acid, phenylacetic acid, benzoic acid, pyruvic acid, levulinic acid, tartaric acid, lactic acid, malonic acid, succinic acid, fumaric acid, gluconic acid, saccharic acid, salicyclic acid, sorbic acid, masonic acid, or malic acid.

149. The cartridge of any one of the embodiments 137-145, wherein the acid comprises one or more of a carboxylic acid, a dicarboxylic acid, and a keto acid.

150. The cartridge of any one of the embodiments 137-145, wherein the acid comprises one or more of benzoic acid, pyruvic acid, salicylic acid, levulinic acid, malic acid, succinic acid, and citric acid.

151. The cartridge of any one of the embodiments 137-145, wherein the acid comprises benzoic acid.

152. The cartridge any one of the embodiments 137-151, wherein the molar ratio of acid to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

153. The cartridge any one of the embodiments 137-151, wherein the molar ratio of acidic functional groups to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

154. The cartridge any one of the embodiments 137-151, wherein the molar ratio of acidic functional group hydrogens to nicotine in the formulation is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

155. The cartridge any one of the embodiments 137-151, wherein the molar ratio of acid to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

156. The cartridge any one of the embodiments 137-151, wherein the molar ratio of acidic functional groups to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

157. The cartridge any one of the embodiments 137-151, wherein the molar ratio of acidic functional group hydrogens to nicotine in the aerosol is about 0.25:1, about 0.3:1, about 0.4:1, about 0.5:1, about 0.6:1, about 0.7:1, about 0.8:1, about 0.9:1, about 1:1, about 1.2:1, about 1.4:1, about 1.6:1, about 1.8:1, about 2:1, about 2.2:1, about 2.4:1, about 2.6:1, about 2.8:1, about 3:1, about 3.2:1, about 3.4:1, about 3.6:1, about 3.8:1, or about 4:1.

158. The cartridge any one of the embodiments 137-157, wherein the nicotine concentration is about 0.5% (w/w), about 1% (w/w), about 2% (w/w), about 3% (w/w), about 4% (w/w), about 5% (w/w), about 6% (w/w), about 7% (w/w), about 8% (w/w), about 9% (w/w), about 10% (w/w), about 11% (w/w), about 12% (w/w), about 13% (w/w), about 14% (w/w), about 15% (w/w), about 16% (w/w), about 17% (w/w), about 18% (w/w), about 19% (w/w), or about 20% (w/w).

159. The cartridge of any one of the embodiments 137-157, wherein the nicotine concentration is from about 0.5% (w/w) to about 20% (w/w), from about 0.5% (w/w) to about 18% (w/w), from about 0.5% (w/w) to about 15% (w/w), from about 0.5% (w/w) to about 12% (w/w), from about 0.5% (w/w) to about 10% (w/w), from about 0.5% (w/w) to about 8% (w/w), from about 0.5% (w/w) to about 7% (w/w), from about 0.5% (w/w) to about 6% (w/w), from about 0.5% (w/w) to about 5% (w/w), from about 0.5% (w/w) to about 4% (w/w), from about 0.5% (w/w) to about 3% (w/w), or from about 0.5% (w/w) to about 2% (w/w).

160. The cartridge any one of the embodiments 137-157, wherein the nicotine concentration is from about 1% (w/w) to about 20% (w/w), from about 1% (w/w) to about 18% (w/w), from about 1% (w/w) to about 15% (w/w), from about 1% (w/w) to about 12% (w/w), from about 1% (w/w) to about 10% (w/w), from about 1% (w/w) to about 8% (w/w), from about 1% (w/w) to about 7% (w/w), from about 1% (w/w) to about 6% (w/w), from about 1% (w/w) to about 5% (w/w), from about 1% (w/w) to about 4% (w/w), from about 1% (w/w) to about 3% (w/w), or from about 1% (w/w) to about 2% (w/w).

161. The cartridge any one of the embodiments 137-157, wherein the nicotine concentration is from about 2% (w/w) to about 20% (w/w), from about 2% (w/w) to about 18% (w/w), from about 2% (w/w) to about 15% (w/w), from about 2% (w/w) to about 12% (w/w), from about 2% (w/w) to about 10% (w/w), from about 2% (w/w) to about 8% (w/w), from about 2% (w/w) to about 7% (w/w), from about 2% (w/w) to about 6% (w/w), from about 2% (w/w) to about 5% (w/w), from about 2% (w/w) to about 4% (w/w), or from about 2% (w/w) to about 3% (w/w).

162. The cartridge any one of the embodiments 137-157, wherein the nicotine concentration is from about 3% (w/w) to about 20% (w/w), from about 3% (w/w) to about 18% (w/w), from about 3% (w/w) to about 15% (w/w), from about 3% (w/w) to about 12% (w/w), from about 3% (w/w) to about 10% (w/w), from about 3% (w/w) to about 8% (w/w), from about 3% (w/w) to about 7% (w/w), from about 3% (w/w) to about 6% (w/w), from about 3% (w/w) to about 5% (w/w), or from about 3% (w/w) to about 4% (w/w).

163. The cartridge any one of the embodiments 137-157, wherein the nicotine concentration is from about 4% (w/w) to about 20% (w/w), from about 4% (w/w) to about 18% (w/w), from about 4% (w/w) to about 15% (w/w), from about 4% (w/w) to about 12% (w/w), from about 4% (w/w) to about 10% (w/w), from about 4% (w/w) to about 8% (w/w), from about 4% (w/w) to about 7% (w/w), from about 4% (w/w) to about 6% (w/w), or from about 4% (w/w) to about 5% (w/w).

164. The cartridge any one of the embodiments 137-157, wherein the nicotine concentration is from about 5% (w/w) to about 20% (w/w), from about 5% (w/w) to about 18% (w/w), from about 5% (w/w) to about 15% (w/w), from about 5% (w/w) to about 12% (w/w), from about 5% (w/w) to about 10% (w/w), from about 5% (w/w) to about 8% (w/w), from about 5% (w/w) to about 7% (w/w), or from about 5% (w/w) to about 6% (w/w).

165. The cartridge any one of the embodiments 137-157, wherein the nicotine concentration is from about 6% (w/w) to about 20% (w/w), from about 6% (w/w) to about 18% (w/w), from about 6% (w/w) to about 15% (w/w), from about 6% (w/w) to about 12% (w/w), from about 6% (w/w) to about 10/a (w/w), from about 6% (w/w) to about 8% (w/w), or from about 6% (w/w) to about 7% (w/w).

166. The cartridge any one of the embodiments 137-157, wherein the nicotine concentration is from about 2% (w/w) to about 6% (w/w).

167. The cartridge any one of the embodiments 137-157, wherein the nicotine concentration is about 5% (w/w).

168. The cartridge any one of the embodiments 137-167, wherein the molar concentration of nicotine in the aerosol is about the same as the molar concentration of the acid in the aerosol.

169. The cartridge of any one of the embodiments 137-168, wherein the aerosol comprises about 50% of the nicotine in the formulation, about 60% of the nicotine in the formulation, about 70% of the nicotine in the formulation, about 75% of the nicotine in the formulation, about 80% of the nicotine in the formulation, about 85% of the nicotine in the formulation, about 90% of the nicotine in the formulation, about 95%, of the nicotine in the formulation, or about 99% of the nicotine in the formulation.

170. The cartridge of any one of the embodiments 137-169, wherein the aerosol comprises condensate in particles sizes from about 0.1 microns to about 5 microns, from about 0.1 microns to about 4.5 microns, from about 0.1 microns to about 4 microns, from about 0.1 microns to about 3.5 microns, from about 0.1 microns to about 3 microns, from about 0.1 microns to about 2.5 microns, from about 0.1 microns to about 2 microns, from about 0.1 microns to about 1.5 microns, from about 0.1 microns to about 1 microns, from about 0.1 microns to about 0.9 microns, from about 0.1 microns to about 0.8 microns, from about 0.1 microns to about 0.7 microns, from about 0.1 microns to about 0.6 microns, from about 0.1 microns to about 0.5 microns, from about 0.1 microns to about 0.4 microns, from about 0.1 microns to about 0.3 microns, from about 0.1 microns to about 0.2 microns, or from about 0.3 to about 0.4 microns.

171. The cartridge of embodiment 137-170, wherein the aerosol comprises condensate of nicotine salt.

172. The cartridge of embodiment 137-170, wherein the aerosol comprises condensate comprising one or more of the carrier, nicotine salt, freebase nicotine, and free acid.

173. The cartridge of embodiment 137-172, wherein the acid does not decompose at room temperature and does not decompose at the operating temperature of the electronic cigarette.

174. The cartridge of any one of the embodiments 137-173, wherein an operating temperature is from 150° C. to 250° C.

175. The cartridge of any one of the embodiments 137-173, wherein an operating temperature is from 180° C. to 220° C.

176. The cartridge any one of the embodiments 137-173, wherein an operating temperature is about 200° C.

177. The cartridge of any one of embodiments 137-176, wherein the acid is stable at and below operating temperature or about 200° C.

178. The cartridge of any one of embodiments 137-176, wherein the acid does not decompose at and below operating temperature or about 200° C.

179. The cartridge of any one of embodiments 137-176, wherein the acid does not oxidize at and below operating temperature or about 200° C.

180. The cartridge of any one of embodiments 137-179, wherein the formulation is non-toxic to a user of the electronic cigarette.

181. The cartridge of any one of the embodiments 137-180, wherein the formulation is non-corrosive to the electronic cigarette.

182. The cartridge of any one of the embodiments 137-181, wherein the formulation comprises a flavorant.

183. The cartridge of any one of the embodiments 137-182, wherein inhaling the aerosol over a period of about five minutes at a rate of about one inhalation per 30 seconds results in a nicotine plasma Tmax from about 1 min to about 8 min.

184. The cartridge of embodiment 183, wherein the nicotine plasma Tmax is from about 1 min to about 7 min, from about 1 min to about 6 min, from about 1 min to about 5 min, from about 1 min to about 4 min, from about 1 min to about 3 min, from about 1 min to about 2 min, from about 2 min to about 8 min, from about 2 min to about 7 min, from about 2 min to about 6 min, from about 2 min to about 5 min, from about 2 min to about 4 min, from about 2 min to about 3 min, from about 3 min to about 8 min, from about 3 min to about 7 min, from about 3 min to about 6 min, from about 3 min to about 5 min, from about 3 min to about 4 min, from about 4 min to about 7 min, from about 4 min to about 6 min, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, less than about 3 min, less than about 2 min, less than about 1 min, about 8 min, about 7 min, about 6 min, about 5 min, about 4 min, about 3 min, about 2 min, or about 1 min.

185. The cartridge of any one of the embodiments 137-182, wherein inhaling the aerosol over a period of about five minutes at a rate of about one inhalation per 30 seconds results in a nicotine plasma Tmax from about 2 min to about 8 min.

186. The cartridge of embodiment 185, wherein the nicotine plasma Tmax is from about 2 min to about 8 min, from about 2 min to about 7 min, from about 2 min to about 6 min, from about 2 min. to about 5 min, from about 2 min to about 4 min, from about 2 min to about 3 min, from about 3 min to about 8 min, from about 3 min to about 7 min, from about 3 min to about 6 min, from about 3 min to about 5 min, from about 3 min to about 4 min, from about 4 min to about 7 min, from about 4 min to about 6 min, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, less than about 3 min, less than about 2 min, less than about 1 min, about 8 min, about 7 min, about 6 min, about 5 min, about 4 min, about 3 min, or about 2 min.

187. The cartridge of any one of the embodiments 137-182, wherein inhaling the aerosol over a period of about five minutes at a rate of about one inhalation per 30 seconds results in a nicotine plasma Tmax from about 3 min to about 8 min.

188. The cartridge of embodiment 187, wherein the nicotine plasma Tmax is from about 3 min to about 7 min, from about 3 min to about 6 min, from about 3 min to about 5 min, from about 3 min to about 4 min, from about 4 min to about 8 min, from about 4 min to about 7 min, from about 4 min to about 6 min, from about 4 min to about 5 min, from about 5 min to about 8 min, from about 5 min to about 7 min, from about 5 min to about 6 min, from about 6 min to about 8 min, from about 6 min to about 7 min, from about 7 min to about 8 min, less than about 8 min, less than about 7 min, less than about 6 min, less than about 5 min, less than about 4 min, about 8 min, about 7 min, about 6 min, about 5 min, about 4 min, or about 3 min.

189. The cartridge of any one of the embodiments 137-182, wherein the Tmax is less than about 8 min.

190. The cartridge of any one of the embodiments 183-189, wherein the Tmax is determined based on at least three independent data sets.

191. The cartridge of embodiment 183-189, wherein the Tmax is a range of at least three independent data sets.

192. The cartridge of embodiment 183-189, wherein the Tmax is an average f a standard deviation of at least three independent data sets.

193. The cartridge of any one of the embodiments 137-192, wherein the liquid carrier comprises glycerol, propylene glycol, trimethylene glycol, water, ethanol or a combination thereof.

194. The cartridge of any one of the embodiments 137-192, wherein the liquid carrier comprises propylene glycol and vegetable glycerin.

195. The cartridge of any one of the embodiments 137-192, wherein the liquid carrier comprises 20% to 50% of propylene glycol and 80% to 50% of vegetable glycerin.

196. The cartridge of any one of the embodiments 137-192, wherein the liquid carrier comprises 30% propylene glycol and 70% vegetable glycerin.

197. The cartridge of any one of embodiments 137-196, wherein the formulation further comprises one or more additional acids.

198. The cartridge of embodiment 197, wherein the one or more additional acids comprises one or more of benzoic acid, pyruvic acid, salicylic acid, levulinic acid, malic acid, succinic acid, and citric acid.

199. The cartridge of embodiment 197, wherein the one or more additional acids comprises nicotine benzoic acid.

200. The cartridge of any one of the embodiments 197-199, wherein the one or more additional acids forms one or more additional nicotine salts.

201. A cartridge for use with low temperature electronic vaporization device, i.e. an electronic cigarette, comprising a fluid compartment configured to be in fluid communication with a heating element, the fluid compartment comprising a nicotine formulation comprising:

a. from about 0.5% (w/w) to about 20% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 0.25:1 to about 4:1; and c. a biologically acceptable liquid carrier, wherein operation of the electronic cigarette generates an inhalable aerosol comprising at least a portion of the nicotine in the formulation.

202. A cartridge for use with low temperature electronic vaporization device, i.e. an electronic cigarette, comprising a fluid compartment configured to be in fluid communication with a heating element, the fluid compartment comprising a nicotine formulation comprising:

a. from about 2% (w/w) to about 6% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 0.25:1 to about 4:1; and c. a biologically acceptable liquid carrier.

wherein operation of the electronic cigarette generates an inhalable aerosol comprising at least a portion of the nicotine in the formulation.

203. A cartridge for use with low temperature electronic vaporization device, i.e. an electronic cigarette, comprising a fluid compartment configured to be in fluid communication with a heating element, the fluid compartment comprising a nicotine formulation comprising:

a. from about 2% (w/w) to about 6% (w/w) nicotine;

b. an acid selected from the group consisting of: benzoic acid, pyruvic acid, salicylic acid, levulinic acid, malic acid, succinic acid, and citric acid, wherein the a molar ratio of acid to nicotine from about 1:1 to about 2:1; and c. a biologically acceptable liquid carrier, wherein operation of the electronic cigarette generates an inhalable aerosol comprising at least a portion of the nicotine in the formulation.

204. A cartridge for use with low temperature electronic vaporization device, i.e. an electronic cigarette, comprising a fluid compartment configured to be in fluid communication with a heating element, the fluid compartment comprising a nicotine formulation comprising:

a. from about 2% (w/w) to about 6% (w/w) nicotine;

b. a molar ratio of benzoic acid to nicotine of about 1:1; and c. a biologically acceptable liquid carrier, wherein operation of the electronic cigarette generates an inhalable aerosol comprising at least a portion of the nicotine in the formulation.

Although preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein can be employed in practicing the invention. It is intended that the following embodiments define the scope of the invention and that methods and structures within the scope of these embodiments and their equivalents be covered thereby.

What is claimed is:

1. A method of generating an inhalable aerosol comprising nicotine for delivery to a user using an electronic vaporization device comprising a nicotine salt liquid formulation and a heater, the method comprising:

(i) providing an amount of the nicotine salt liquid formulation to the heater, wherein (a) the nicotine salt liquid formulation comprises at least one nicotine salt in a biologically acceptable liquid carrier;

(b) the at least one nicotine salt comprises a salt of nicotine and lactic acid;

(c) the nicotine salt liquid formulation has a nicotine salt concentration of 0.5% (w/w) to 20% (w/w); and (d) the nicotine salt liquid formulation has a molar ratio of lactic acid to nicotine from 0.7:1 to 1.6:1, and (ii) forming an aerosol by heating the amount of the nicotine salt liquid formulation.

2. The method of claim 1, wherein the nicotine salt concentration is from 1% (w/w) to 15% (w/w).

3. The method of claim 2, wherein the nicotine salt concentration is from 2% (w/w) to 6% (w/w).

4. The method of claim 1, wherein the biologically acceptable liquid carrier comprises from 10% to 70% of propylene glycol and from 90% to 30% of vegetable glycerin.

5. The method of claim 4, wherein the biologically acceptable liquid carrier comprises from 20% to 50% of propylene glycol and from 80% to 50% of vegetable glycerin.

6. The method of claim 1, wherein the nicotine salt liquid formulation has a molar ratio of lactic acid to nicotine of about 1:1.

7. The method of claim 1, wherein the nicotine salt liquid formulation further comprises an additional acid selected from the group consisting of benzoic acid, pyruvic acid, salicylic acid, levulinic acid, malic acid, succinic acid, and citric acid.

8. The method of claim 7, wherein the additional acid forms an additional nicotine salt.

9. The method of claim 1, comprising heating the amount of the nicotine salt liquid formulation from 100° C. to 300° C.

10. The method of claim 1, wherein the amount is at least 60 μL or at least 60 mg.

11. The method of claim 10, wherein the amount is provided over a plurality of puffs, and the amount provided per puff is at least 1 μL or at least 1 mg.

12. A nicotine salt liquid formulation comprising at least one nicotine salt in a biologically acceptable liquid carrier, wherein:

(a) the at least one nicotine salt comprises a salt of nicotine and lactic acid;

(b) the nicotine salt liquid formulation has a nicotine salt concentration of 1% (w/w) to 20% (w/w); and (c) the nicotine salt liquid formulation has a molar ratio of lactic acid to nicotine from 0.7:1 to 1.6:1.

13. The nicotine salt liquid formulation of claim 12, wherein the nicotine salt concentration is from 1% (w/w) to 15% (w/w).

14. The nicotine salt liquid formulation of claim 13, wherein the nicotine salt concentration is from 2% (w/w) to 6% (w/w).

15. The nicotine salt liquid formulation of claim 12, wherein the biologically acceptable liquid carrier comprises from 10% to 70% of propylene glycol and from 90% to 30% of vegetable glycerin.

16. The nicotine salt liquid formulation of claim 15, wherein the biologically acceptable liquid carrier comprises from 20% to 50% of propylene glycol and from 80% to 50% of vegetable glycerin.

17. The nicotine salt liquid formulation of claim 12, wherein the nicotine salt liquid formulation has a molar ratio of lactic acid to nicotine of about 1:1.

18. A method of generating an inhalable aerosol comprising nicotine for delivery to a user using an electronic vaporization device comprising a nicotine liquid formulation and a heater, the method comprising:

(i) providing an amount of the nicotine liquid formulation to the heater, wherein (a) the nicotine liquid formulation comprises from 0.5% (w/w) to 20% (w/w) of nicotine, lactic acid, and a biologically acceptable liquid carrier; and (b) the molar ratio of lactic acid to nicotine is from 0.7:1 to 1.6:1, and (ii) forming an aerosol by heating the amount of the nicotine liquid formulation.

19. The method of claim 18, wherein the nicotine liquid formulation comprises from 1% (w/w) to 15% (w/w) of nicotine.

20. The method of claim 19, wherein the nicotine liquid formulation comprises from 2% (w/w) to 6% (w/w) of nicotine.

21. The method of claim 18, wherein the biologically acceptable liquid carrier comprises from 10% to 70% of propylene glycol and from 90% to 30% of vegetable glycerin.

22. The method of claim 21, wherein the biologically acceptable liquid carrier comprises from 20% to 50% of propylene glycol and from 80% to 50% of vegetable glycerin.

23. The method of claim 18, wherein the nicotine liquid formulation has a molar ratio of lactic acid to nicotine of about 1:1.

24. The method of claim 18, comprising forming an aerosol by heating the amount of the nicotine liquid formulation from 100° C. to 300° C.

25. The method of claim 18, wherein the amount is at least 60 μL or at least 60 mg.

* * * * *